US009982513B2

(12) United States Patent
Lakic

(10) Patent No.: US 9,982,513 B2
(45) Date of Patent: May 29, 2018

(54) APPARATUS FOR DRILLING DEEPER AND WIDER WELL BORE WITH CASING

(71) Applicant: Nikola Lakic, Indio, CA (US)

(72) Inventor: Nikola Lakic, Indio, CA (US)

( * ) Notice: Subject to any disclaimer, the term of this patent is extended or adjusted under 35 U.S.C. 154(b) by 353 days.

(21) Appl. No.: 14/961,435

(22) Filed: Dec. 7, 2015

(65) Prior Publication Data

US 2016/0168916 A1 Jun. 16, 2016

Related U.S. Application Data

(63) Continuation-in-part of application No. 13/424,184, filed on Mar. 19, 2012, now Pat. No. 9,206,650, which is a continuation-in-part of application No. PCT/US2010/049532, filed on Sep. 20, 2010.

(60) Provisional application No. 61/276,967, filed on Sep. 19, 2009, provisional application No. 61/395,235, (Continued)

(51) Int. Cl.

| | |
|---|---|
| ***E21B 7/28*** | (2006.01) |
| ***E21B 36/00*** | (2006.01) |
| ***E21B 21/12*** | (2006.01) |
| ***E21B 7/00*** | (2006.01) |
| ***E21B 10/26*** | (2006.01) |
| ***E21B 17/18*** | (2006.01) |
| ***E21B 21/01*** | (2006.01) |
| ***E21B 4/00*** | (2006.01) |
| ***E21B 7/20*** | (2006.01) |

(52) U.S. Cl.

CPC ..... *E21B 36/001* (2013.01); *E21B 4/006* (2013.01); *E21B 7/002* (2013.01); *E21B 7/005* (2013.01); *E21B 7/20* (2013.01); *E21B 7/201* (2013.01); *E21B 10/26* (2013.01); *E21B 17/18* (2013.01); *E21B 21/01* (2013.01); *E21B 21/12* (2013.01)

(58) Field of Classification Search

CPC ..... E21B 21/12; E21B 17/18; E21B 10/26; E21B 21/01; E21B 7/002; E21B 7/005; E21B 4/006; E21B 36/001; E21B 7/20; E21B 7/201

See application file for complete search history.

(56) References Cited

U.S. PATENT DOCUMENTS 3,416,618 A * 12/1968 Kunnemann ..... E21B 10/04 175/213

3,789,919 A 2/1974 Huber (Continued)

*Primary Examiner* — Daniel P Stephenson

(74) *Attorney, Agent, or Firm* — Schmeiser, Olsen & Watts LLP

(57) ABSTRACT

An apparatus and method for drilling deeper and wider well bores is provided. The apparatus includes a motorized drill head for cutting and shredding ground material; a separate excavation line; a separate fluid delivery line; a separate close loop engine cooling line; and a casing system. Excavation line includes repetitive stationary segments of the main pipe with periodical segments of an in-line excavation pump. The close loop cooling line includes a heat exchanger in the motorized drill head and in the in-line excavation pump and one on the ground surface in the binary unit where fluid is cooled and in process electricity produced. The diameter of the excavation line and rate of flow of mud and cuttings through it and the diameter of the fluid delivery line and rate of fluid flow through it are in balance requiring only limited fluid column at the bottom of the well bore.

20 Claims, 58 Drawing Sheets

Related U.S. Application Data filed on May 10, 2010, provisional application No. 61/397,109, filed on Jun. 7, 2010.

(56) References Cited

U.S. PATENT DOCUMENTS 3,948,330 A * 4/1976 Langford, Jr. ..... E21B 10/18 175/213
3,986,362 A 10/1976 Baciu
4,227,583 A * 10/1980 Benjamin ..... E21B 7/20 175/171
4,343,999 A 8/1982 Wolf
4,368,787 A 1/1983 Messenger
4,407,126 A 10/1983 Aplenc
4,776,169 A 10/1988 Coles, Jr.
4,819,746 A 4/1989 Brown et al.
5,033,545 A 7/1991 Sudol
5,058,386 A 10/1991 Senanayake
6,073,448 A 7/2000 Lozada
6,095,261 A 8/2000 Trevino, Jr.
6,892,829 B2 5/2005 Livingstone
7,055,627 B2 6/2006 Fontana et al.
7,134,512 B2 11/2006 Head
7,152,700 B2 12/2006 Church et al.
7,806,203 B2 10/2010 Krueger et al.
7,810,583 B2 10/2010 Ruggier et al.
8,011,450 B2 9/2011 Krueger et al.
8,132,630 B2 3/2012 Krueger et al.
9,206,650 B2 * 12/2015 Lakic ..... E21B 10/26
2003/0141111 A1 7/2003 Pia
2004/0104030 A1 6/2004 Livingstone
2010/0263859 A1 * 10/2010 Kriesels ..... E21B 7/20 166/207
2012/0292112 A1 11/2012 Lakic
2015/0159467 A1 * 6/2015 Hartman ..... E21B 43/103 166/292
2016/0168916 A1 * 6/2016 Lakic ..... E21B 36/001 175/17

* cited by examiner

APPARATUS FOR DRILLING DEEPER AND WIDER WELL BORE WITH CASING

CROSS-REFERENCE TO RELATED APPLICATIONS

The present application is a continuation-in-part of U.S. patent application Ser. No. 13/424,184, filed Mar. 19, 2012, which is a continuation-in-part of PCT Application No. PCT/US2010/049532, filed Sep. 20, 2010, which claims priority to U.S. Provisional Application No. 61/276,967 filed Sep. 19, 2009, U.S. Provisional Application No. 61/395,235 filed May 10, 2010 and U.S. Provisional Application No. 61/397,109 filed Jun. 7, 2010 the contents of which are hereby incorporated entirely herein by reference.

BACKGROUND

Field of Invention

The subject matter described herein generally relates to a drilling apparatus and related method, and more specifically to well bore drilling for an emerging technology such as "Self Contained In-Ground Geothermal Generators" (SCI-GGG) where drilling relatively deeper wells having a wider diameter and reduced drilling cost are applicable.

Related Art

Nearly all oil, gas, and geothermal wells are drilled using a rotating system. In rotary drilling, a steel tower supports a length of hollow heat treated alloy steel drill pipe having a drill bit positioned at one end. The drill pipe is rotated by a rotary table to cut a hole in the earth called a well bore. The well bore may have a diameter of 20 inches (51 cm) or more, but is typically less.

Four major systems generally comprise an operational rotary drilling (rig) system: a power supply, a hoisting system, a rotating system (mentioned above), and a circulating system. A drill system requires the power supply in order for the other rig systems to operate. Power may be supplied through one or more diesel engines used alone or in combination with an electrical power supply.

The hoisting system raises, lowers, and suspends equipment in the well bore and typically includes a drill or hoist line composed of wound steel cable spooled over a revolving reel. The cable passes through a number of pulleys, including one suspended from the top of the tower. The hoisting system is used to move drill pipe into or out of the well bore. As the depth of the well bore increases additional sections of drill pipe are added to the opposite end of the drill pipe to form a drill string.

During drilling, the circulating system pumps drilling mud or fluid down through the hollow drill pipe into the well bore. A liquid, oil, or synthetic based mud is typically used during the drilling process. The mud and cutting exit the pipe through holes or nozzles in the drill bit and return to the surface through the space between the drill pipe and the well bore wall.

The mud and cuttings separated and the mud is recirculated into the well bore. Drilling mud cools the drill bit, stabilizes the well bore walls, and controls the formation fluid that may flow into the well bore.

Alternatively, an air drilling system may be employed to remove drill cuttings. The air drilling rig and operations are identical to those for the rotary drilling rig, except there is no circulating system. Instead of mud, air is pumped down the drill string and out the drill bit, forcing the cuttings up and out of the well bore.

Several types of drilling techniques are currently employed in oil and gas drilling: straight hole drilling, directional/slant drilling, horizontal drilling, air drilling, and foam drilling. Regardless of the drilling technique, a well bore is typically drilled in a series of progressively smaller-diameter intervals. Thus, a well bore typically exhibits a largest diameter at the surface and relatively smaller diameter at the bottom of the well bore.

Accordingly, existing technologies have limitations relevant to the depth and diameter of the well bore. In this regard, well bores having a wider diameter cannot be drilled as deep as a well bore with a smaller diameter. More specifically, as the well bore depth and diameter increases, tremendous pumping force is required to force rock chips (cuttings) out of the well bore by a fluid (or air) column formed between the drill pipe and the well bore wall.

Exploration and well bore drilling are major cost components of any oil, gas, or geothermal project. Accordingly, there exists a need for a drilling apparatus and a method for drilling a relatively deeper well bore having a relatively wider diameter and reduced drilling cost when compared to conventional drilling technologies to accommodate emerging technology in geothermal energy such as those described in U.S. patent application Ser. No. 12/197,073 entitled "Self Contained In-Ground Geothermal Generators" (SCI-GGG). The mentioned technology/method consist of: Lowering SCI-GGG apparatus deep down into predrilled well, producing electricity down in the ground and then transporting electricity up to the ground surface by wire. The apparatus can be lowered into well by filling well first with water and then lowering apparatus by gradually empting the well or controlling buoyancy by filling or empting the boiler of the apparatus with fluids.

SUMMARY

For purposes of summarizing the disclosure, exemplary embodiments of systems and methods for drilling a relatively deeper well bore having a relatively wider diameter and reduced drilling cost when compared to conventional drilling technologies have been described herein.

A method for drilling deeper and wider well bores with continues diameter consist of an apparatus having motorized drill head for cutting and shredding ground material with retractable bits to pull out of wellbore after casing process is finished; a separate excavation line for transporting cuttings up to the ground surface; a separate line for delivering filtered fluid to the bottom of the well bore; a separate close loop engine cooling line; and a system for building casing for the wellbore at the same time. Excavation line consists of repetitive segments of the stationary main pipe with periodical segments of in-line excavation electrical pumps with continues spiral blade inside hollow shaft of the rotor. Alternatively, in another embodiment, excavation line consists of multiple connected segments of a stationary (not rotating) main pipe with rotating continues screw inside and configured to move mud and cuttings upward. Close loop cooling line consist of several heat exchangers in the motorized drill head and in In-Line-Pumps and one on the ground surface in the binary power unit where fluid is cooled and in process electricity produced which can be used as a supplement for powering drill head, pumps, equipment, etc.

Diameter of the excavation line and rate of flow of mud and cuttings through it and diameter of the fluid delivery line and rate of fluid flow through it are in balance requiring only limited fluid column at the bottom of the well bore. The excavation process continues regardless of diameter of the drill head (well bore) and therefore this method eliminates well known drilling limitations relative to depth and diameter of the well bore.

These and other features of the subject matter described herein will be more readily apparent from the detailed description of the embodiments set forth below taken in conjunction with the accompanying drawings.

DETAILED DESCRIPTION

In this disclosure illustrated are only a new apparatus and methods but not elements known in existing technologies and processes which are necessary and required in any drilling process like power providing systems, hoisting system, safety measure which includes casing, blow out preventer, etc.

Figure 1:
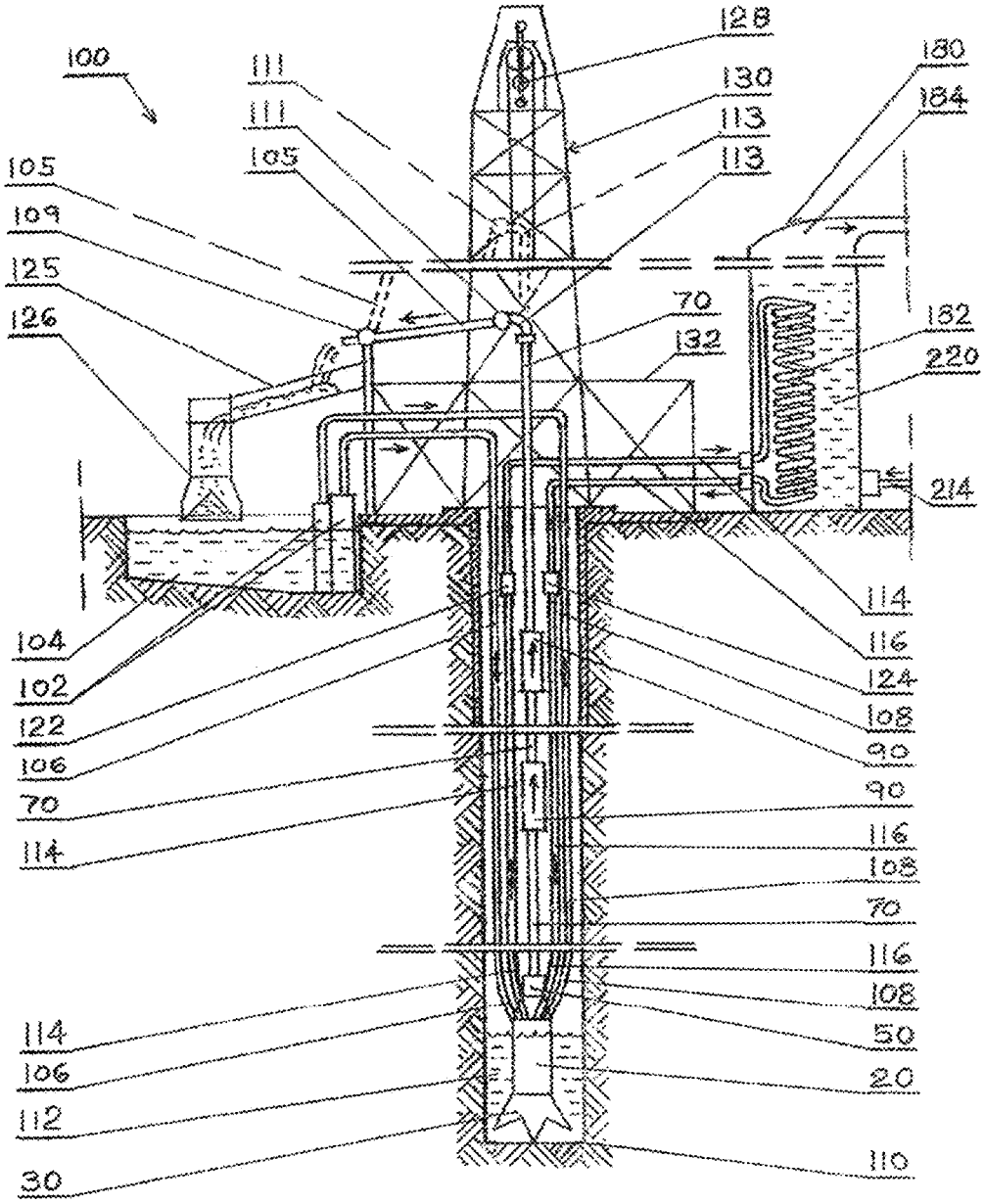
FIG. 1 is a schematic diagram and cross sectional view of an apparatus and method for drilling a well bore in accordance with one embodiment.
Figure 2:
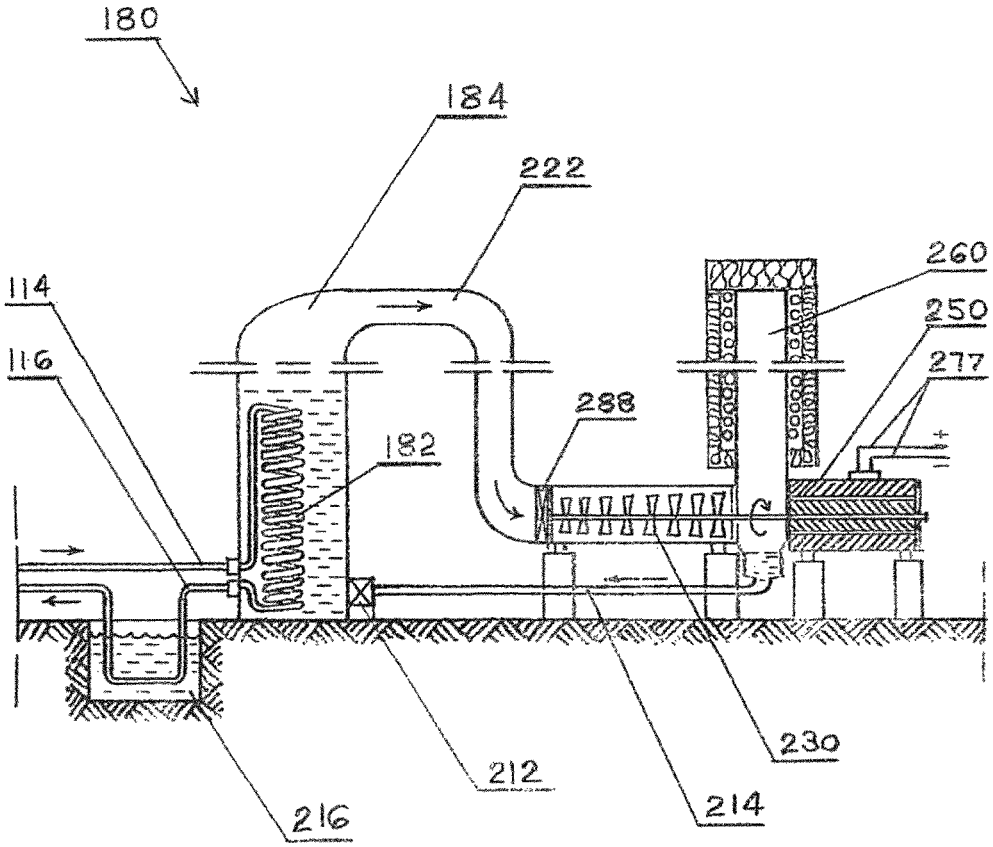
FIG. 2 is a schematic diagram and cross sectional view of a binary geothermal power plant on the ground surface in accordance with one embodiment.
Figure 3:
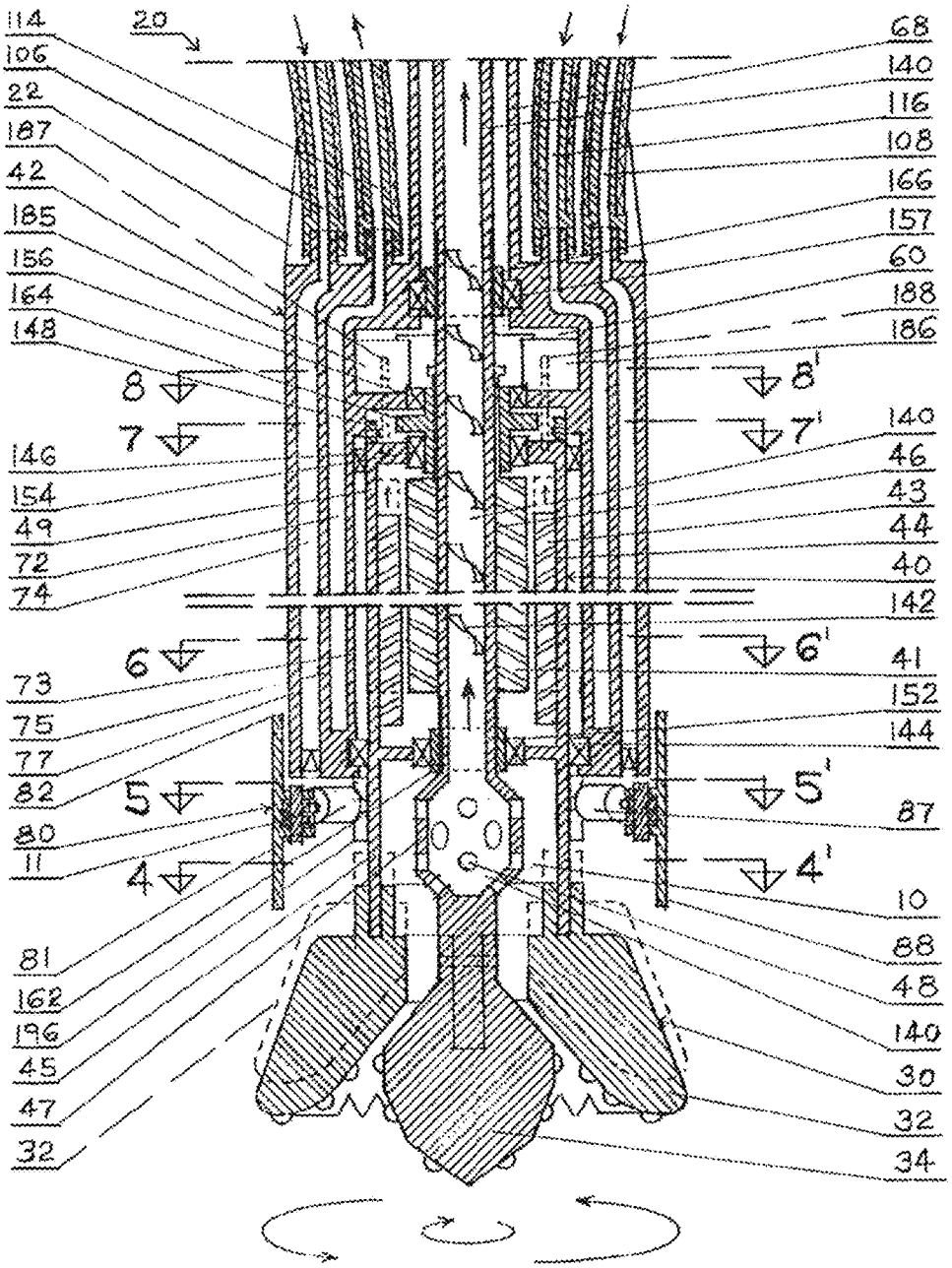
FIG. 3 is enlarged cross sectional view taken along line 3-3' of FIG. 8 of an in-ground motorized drill head in accordance with one embodiment.

Referring now to FIGS. 1, 2 and 3; here is illustrated schematic diagram and cross sectional view of an apparatus and a method 100 for drilling faster, deeper and wider well bore comprising the steps of:

Cutting and shredding bottom of the well bore 110 with motorized drill head 20;

Transporting mud and cuttings through a separate excavation line 70 up to the ground surface;

Delivering filtered fluid through a separate delivery line (tubes 106 and 108) to the bottom of the well bore; and Cooling the motorized drill head through a separate close loop cooling line (tubes 114 and 116) exchanging heat on the ground surface in a binary power unit 180 and in process producing electricity.

In-ground motorized drill head 20, connected to lowest section of the main excavation pipe 70, consist of electric motor 40 having central rotor 46 and peripheral rotors 44 for powering electromotor 40 and are securely engaged with a drill bit 30; a motor housing block 42 having inner chamber 72 and outer chamber 74 each connected to the separate close loop lines for cooling the motorized drill head 20; a drill bit 30 consist of two rotating elements, peripheral drill bit 32 and central drill bit 34 securely engaged with rotors 46 and 44 rotating in opposite directions, cutting and shredding bottom of the well bore to a small bits (cuttings); a hydraulic control mechanism (system) 50 providing vertical sliding motion of the peripheral rotor 44, adjusting distance between shredding surfaces of drill bits permitting selected sizes of shredded material to be sucked into collection chamber 10 for temporally storing before being scrapped and directed into hollow cylindrical shaft 140 for excavation up to the ground surface; a switches compartment 60 a mechanism for controlling (locking) rotation either peripheral drill bit 32 or central drill bit 34; a deviation control mechanism (system) 80 consisting of at least three sets of peripheral plates 82 pivotally engaged through hydraulics 81 to the motorized drill head housing 42; and cooling system inside motor housing block 42 having inner chamber 72 and outer chambers 74 each connected to the separate close loop lines for cooling the motorized drill head 20.

Excavation system consists of: motorized drill head 20 which consist of electric motor 40 which rotates peripheral drill bit 32 and central drill bit 34 in opposite directions, cuts and shreds bottom of the well bore to a small cuttings; a collection chamber 10 formed between extended wall 45 of the motor housing 42 and perforated section 47 of the central hollow shaft 140 for temporally storing mud and cuttings before is being scraped and directed through provided openings 48 into central hollow shaft 140; The cylindrical hollow shaft 140 of the of electro motor 40 is equipped with spiral blade 142 therein and configured to move mud and cuttings upward into main excavation pipe 70 functioning as a first in-line excavation pump. The excavation pipe string 70 consists of multiple connected segments of the main pipes. Before the excavation pipe is fully inserted into the well bore, another section of excavation pipe is added.

On the ground surface there is one pipe 105 with two adjustable joints 109 and 111 and one L-bow connection element 113 enabling additional section of the excavation pipe 70 to be added. Series of in-line excavation pumps 90 are periodically inserted along the excavation pipe 70 wherein each of the in-line excavation pumps 90 are electromotor comprising spiral blade 142 within a hollow central shaft of the rotor creating a force to move mud and cuttings upward to the next in-line excavation pump for pumping mud and cuttings up to the ground surface and out of the well bore, where mud and cuttings are passing through shale shaker 125 where cuttings are separated from mud and then through shale slide 126 convey to the reserve pit 104. Filtered and cooled fluid from mud pit 104 is reused.

Fluids delivery system consists of pumps 102 located in mud pit 104 on the ground surface; hose line 106 and 108 formed of plurality of hose sections which transports filtered fluids from mud pit 104 to the bottom of the well bore 110; The fluids circulates through outer peripheral chamber 74 of the motor block 42 of the drill head 20 and provide additional cooling of the motor block 42 before is dispersed into bottom of the well bore 110 where it forms fluids column 112 of only several yards around motorized drill head 20, cools drill head and provide fluids for drilling; The fluid column 112 can be full length to the surface, if needed, to control subsurface fluids and structural integrity of the well bore but not for removal of the rock chips (cuttings) as it is the case in conventional drilling technologies. Diameter of the excavation line and rate of flow of mud and cuttings through it and diameter of the fluid delivery line and rate of fluid flow through it are in balance requiring only limited fluid column at the bottom of the well bore.

Cooling system consists of: at least two heat exchangers, one representing motor block 42 of the motorized drill head 20 and second one a heat exchanger 184 of the binary power unit 180 at the ground surface; and a separate close loop cooling line 114 and 116 formed of plurality of hose segments extending from inner chamber 72 of the motorized drill head housing 42 to the heat exchanger 184 of the power unit 180. Illustrated here hose 114 circulates fluids on the way up and hose 116 circulates fluids on the way down. The heat is exchanged in the binary heat exchanger unite 180, electricity is produced, and cooled fluid returned to the inner chamber 72 of the motorized drill head housing 42 for farther heat exchange. The pumps 122 and 124 provide circulation of fluids through heat insulated hoses 114 and 116. The fluids circulates through drill head housing 42, absorbs and transport heat up to the ground surface where heat is exchanged through a heat exchanger 184 of the binary power unit 180 which cools fluid and in process produces electricity which then can be used as supplemental power for motorized drill head and in-line pumps or additional uses during drilling process.

Referring now to FIG. 2; here is illustrated a schematic diagram of cross sectional view of the binary geothermal power unit 180, in accordance with the invention partially illustrated in FIG. 1. Here are illustrated; the heat exchanger 184, the turbines 230, the condenser 260 and electric generator 250. Hot water from motor block 42 of the motorized drill head 20 from deep underground passes through close loop tube 72 into coil 182 inside heat exchanger 184 where its heat is transferred into a second (binary) liquid, such as isopentane, that boils at a lower temperature than water. When heated, the binary liquid flashes to vapor, which, like steam, expands across, passes through steam pipe 222 and control valve 288 and then spins the turbine 230. Exhausted vapor is then condensed to a liquid in the condenser 260 and then is pumped back into boiler 220 of the heat exchanger 184 through feed pipe 214 and boiler feed pump 212. In this closed loop cycle, vapor is reused repeatedly and there are no emissions to the air. The shaft of the turbines 230 is connected with shaft of the electric generator 250 which spins and produces electricity, which is then transported through electric cable 277 to transformer and grid line to the users. (Transformer and grid line are not illustrated). Additional cooling of the fluid passing through tube 116 on the way to drill head can be achieved if open pit 216 or alike is accessible.

Figure 8:
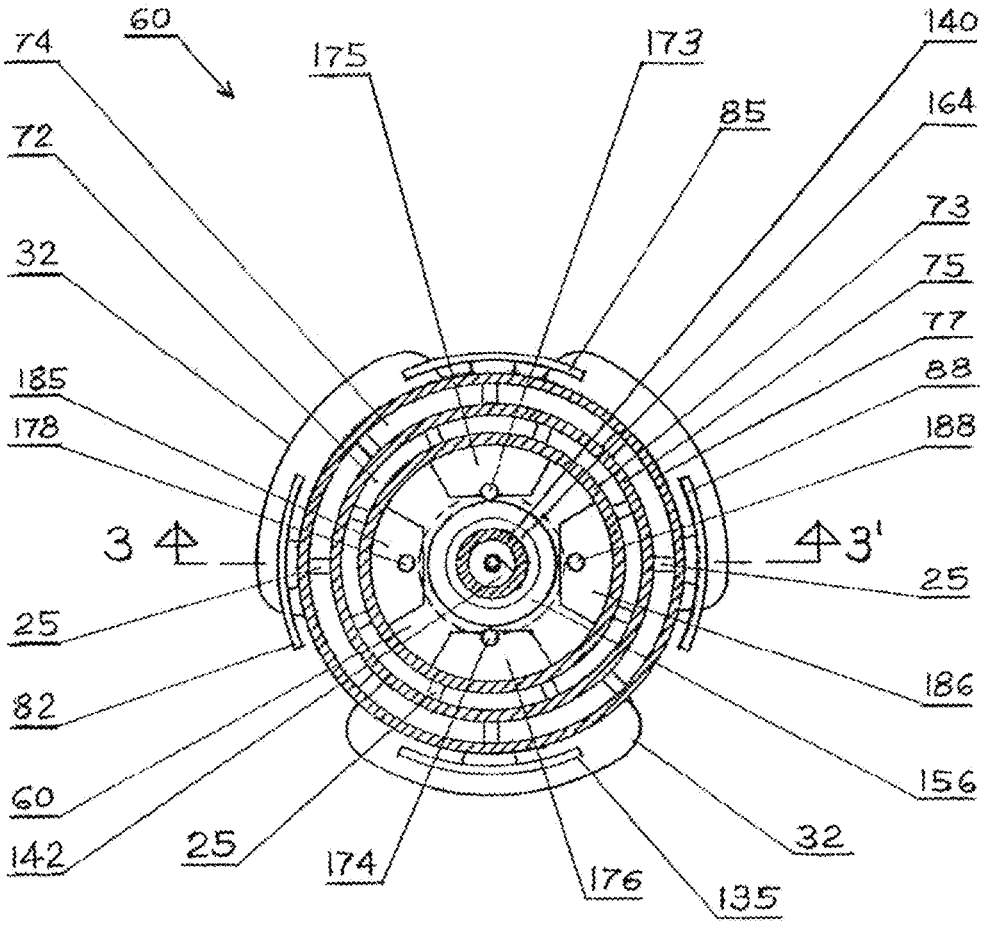
FIG. 8 is a cross sectional view taken along line 8-8' of FIG. 3 of an in-ground motorized drill head in accordance with one embodiment.

Referring now to FIG. 3; here is illustrated enlarged cross sectional view, taken along line 3-3' of FIG. 8, of the in-ground motorized drill head 20. Here are illustrated main parts and explained their function. The electric motor 40, motor housing 42 outer rotor 44 and inner rotor 46; drill bit 30, which consist of peripheral drill bit 32 and central drill bit 34; hydraulic control mechanism 50 (illustrated in FIFS. 9 and 10) which control vertical sliding motion of the peripheral rotor 44 and consequently peripheral drill bit 32 thus adjusting distance between shredding surfaces of drill bits permitting selected sizes of shredded material to be sucked into collecting chamber 10; rotation control section 60 which control rotation of drill bits 32 and 34 through outer rotor 44 and inner rotor 46 of the motor 40; deviation control mechanism (system) 80, consisting of four peripheral plates 82, 85, 88 and 135, pivotally engaged with four sets of hydraulic cylinders 81 and 83, 84 and 86, 87 and 89, 134 and 136 (illustrated in FIG. 5); cooling system which consist of inner peripheral chamber 72, outer peripheral chamber 74 formed in motor housing block 42 which surrounds electro motor 40. Two sets of heath insulated tubes 106, 108 which delivers cooled fluid (mud) trough motor block into bottom of the well bore and another sets of heath insulated tubes 114 and 116 which are part of closed loop system which circulate fluids through inner peripheral chamber 72 and exchange heat on ground surface trough binary power unit 180 (illustrated in FIGS. 1 and 2). The hollow shaft (pipe) 140 is central element of the inner rotor 46 and is attached to the central drill bit 34. The central hollow shaft 140 is equipped with spiral blade 142 therein and configured to move mud and cuttings upward into main excavation line 70 functioning as a first in-line excavation pump.

The motor housing block 42 consist of three peripheral cylinders 73, 75 and 77 which form two peripheral chambers 72 and 74 which surrounds inner rotor 46 and outer rotor 44 of the electric motor 40. Inner peripheral chamber 72 is connected with heat insulated tubes 114 and 116 which are part of close loop cooling system. Outer peripheral chamber 74 is connected with heat insulated tubes 106 and 108 which are part of fluid delivery system. The motor housing block 42 with its elements is also illustrated and described in FIGS. 6, 7 and 8.

Motor housing block 42 is stationary element and is engaged with rotary elements of the motor 40 trough several sets of boll bearings. There are two bearings 144 and 146 positioned between cylinder 49 of outer rotor 44 of the electric motor 40 and stationary motor housing block 42.

There are several bearings 148 positioned on the several pins which extend from the inner side of the wall of peripheral cylinder 73 of the motor housing 42 and are spread around cylinder and engaged with outer rotor 44 at its upper surface. Their purpose is to prevent vertical sliding motion between outer rotor 44 and stationary motor housing block 42. Also, there are two bearings 152 and 154 positioned between inner rotor 46 and outer rotor 44 of the electric motor 40.

Also, there are three bearings 156, 157 and 158 positioned between inner rotor 46 and stationary motor housing block 42.

Here are also illustrated four cuffs or sleeves 162, 164, 166 and 168 with grooves (races) secured on the central hollow shaft 140 with corresponding grooves on corresponding surface permitting, when activated, sliding vertical motion of the motor housing 42 and outer rotor 44 in respect to inner rotor 46 which is part of hollow central shaft 140, and engaged with rotating elements of the outer rotor 44 and stationary motor housing 42 with bearings 152, 154, 156, 157 and 158. Sliding vertical motion of the motor housing 42 and outer rotor 44, when needed, is activated from control center on the ground (not illustrated) and through hydraulic control section 50 (illustrated in FIG. 9). The cuff 164 has disc extension with two recesses 171 and 172 (illustrated in FIG. 7) for receiving pins 173 and 174 which can be activated through electrically controlled switches 175 and 176 located in switch compartment 60 (Illustrated in FIG. 8) in order to block rotation of the central drill bit 34.

The rotation control mechanism or switch compartment 60 also contain two additional switches 185 and 186 with pins 187 and 188 which when activated engages with corresponding cavities in upper portion of the outer rotor 44 in order to block rotation of the peripheral drill bit 32. The rotation control mechanism or switch compartment 60 provides an optional function. Electrically controlled switches with pins can stop rotations of either outer or inner rotor otherwise rotors rotate in opposite directions and are balanced.

Figure 9:
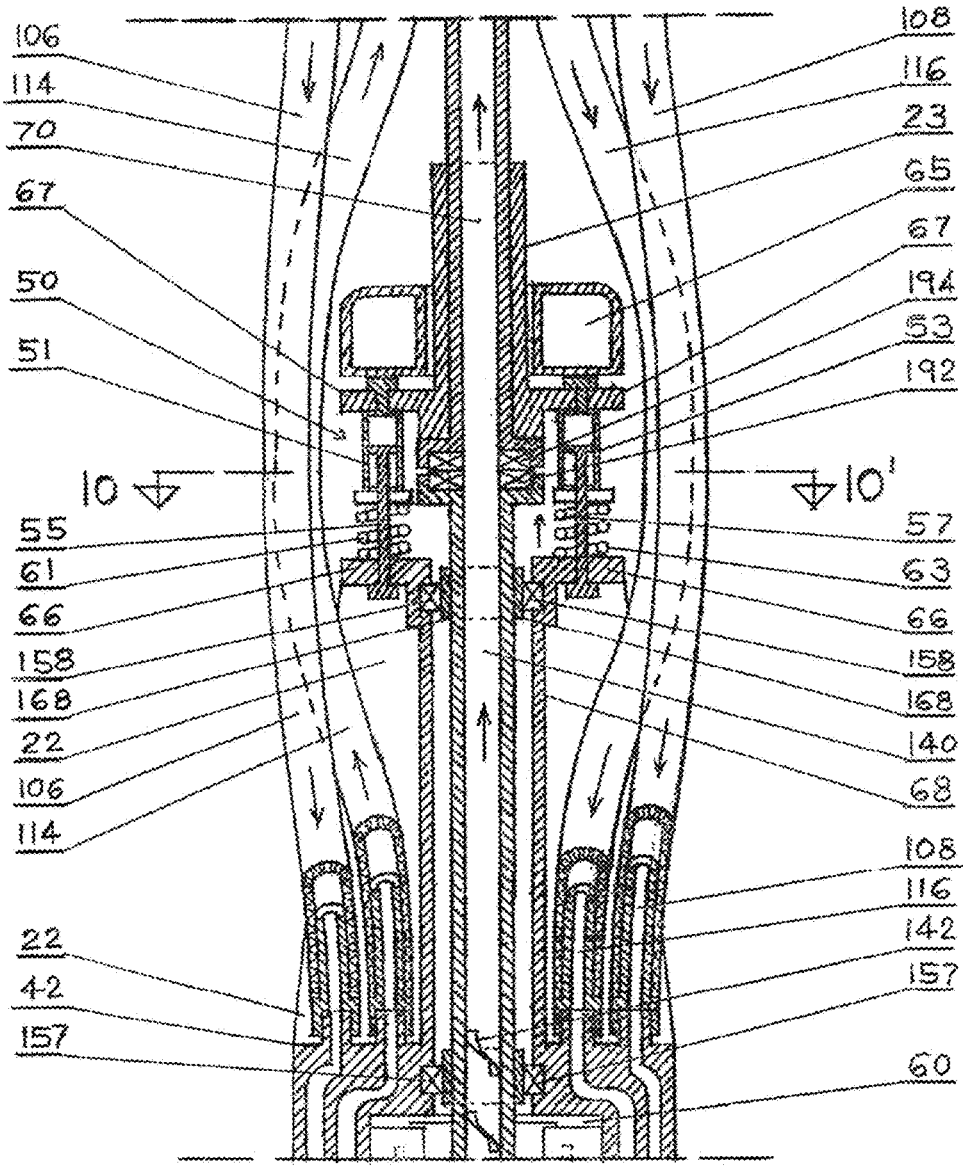
FIG. 9 is a cross sectional view taken along line 9-9' of FIG. 10 of a hydraulic mechanism that is part of an in-ground motorized drill head in accordance with one embodiment.

In-ground motorized drill head 20 further contain set of bearings 192 and 194 positioned between rotating hollow shaft 140 which is central element of the inner rotor 46 of the electric motor 40 and the lowest section of the stationary excavation pipe 70 (illustrated in FIG. 9).

Figure 10:
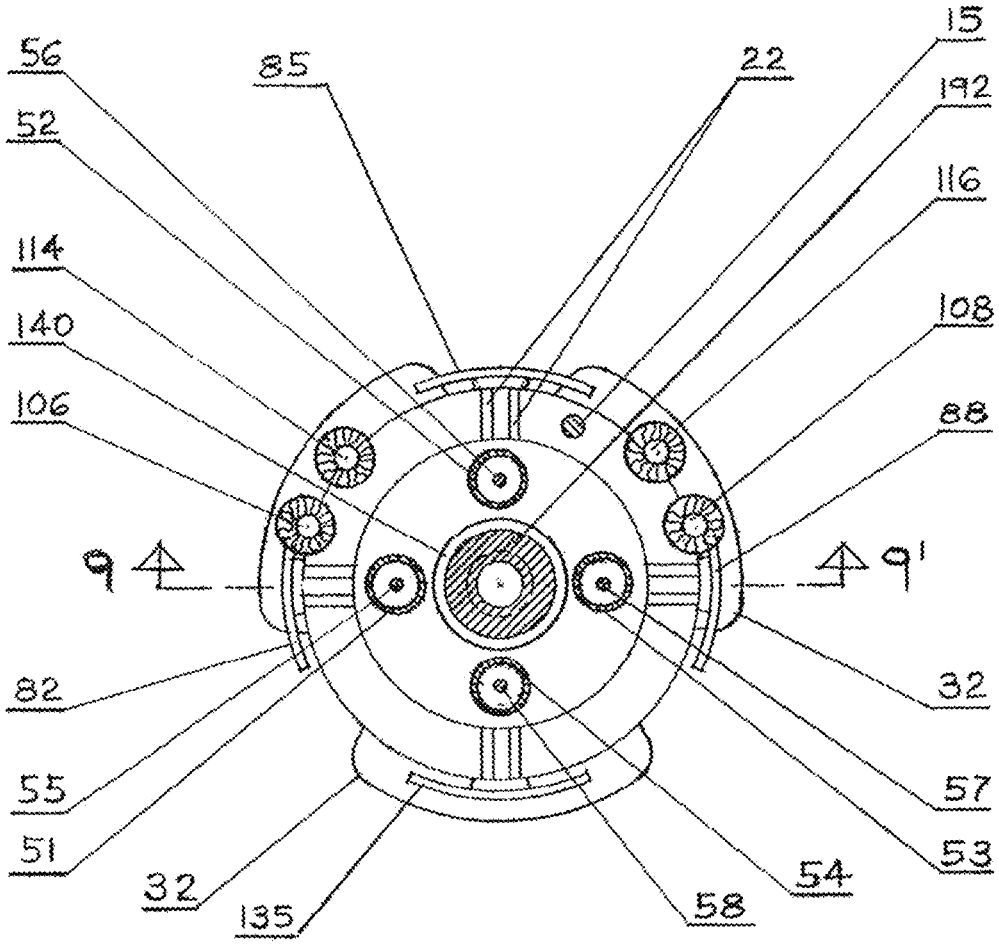
FIG. 10 is a cross sectional view taken along line 10-10' of FIG. 9 of a hydraulic mechanism that is part of an in-ground motorized drill head in accordance with one embodiment.

In-ground motorized drill head 20 also contain hydraulic control mechanism 50 positioned on the upper portion of the motor housing 42 (Illustrated in FIGS. 9 and 10). The purpose for hydraulic mechanism 50 is to pull up the stationary motor housing block 42 and outer rotor 44 which is engage with peripheral drill bit 32 in order to provide greater distance between shredding surfaces of the central drill bit 34 and peripheral drill bit 32. Distance between shedding surfaces of the central and peripheral drill bits 34 and 32 determine size of the cuttings. The peripheral drill bit 32 is illustrated with dash line in extended position.

In-ground motorized drill head 20 further contain deviation (or direction) control mechanism (system) 80 positioned at the lower section of the stationary motor housing block 42. Deviation control mechanism 80 consists of four peripheral plates each pivotally engaged with set of hydraulic arms (Illustrated in FIG. 5). When selected set of cylinders is activated and extends its pistons arms the peripheral plate which pivots them also extend and pushes against wall of the well bore providing movement of the whole drill head in opposite direction and forces drill head to gradually change direction.

Here is also illustrated a collection chamber 10 formed between extended wall (cylinder) 45 of the motor housing 42 and perforated section 47 of the central hollow shaft 140. Mud and cuttings is temporally stored into collection chamber 10 before is being scraped and directed through provided openings 48 into central hollow shaft 140. The shaft 140 at the bottom is solid and is mounted to the central drill bit 34.

Figure 4:
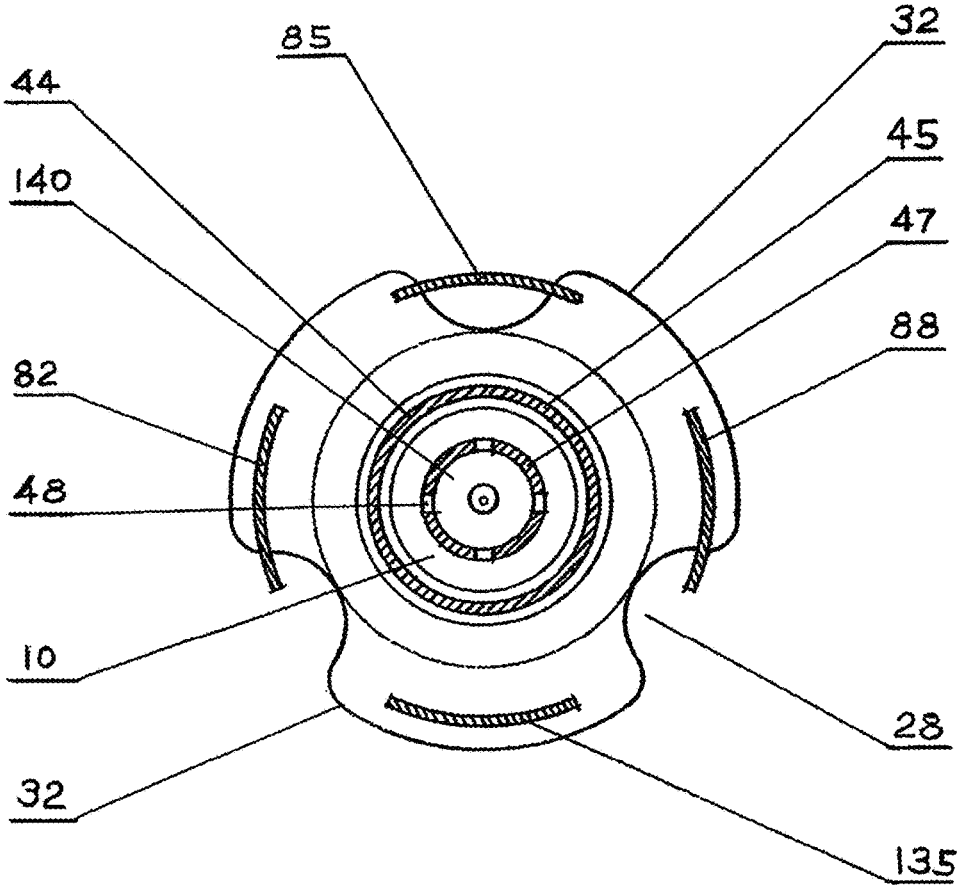
FIG. 4 is a cross sectional view taken along line 4-4' of FIG. 3 of an in-ground motorized drill head in accordance with one embodiment.

FIG. 4 is a cross sectional view taken along line 4-4' of FIG. 3 of an in-ground motorized drill head 20. Here in FIG. 4 is illustrated drill bit 32 with three recesses 28 which forms a three-teethed peripheral drill bit 32. Also, here are illustrated collecting chamber 10 formed between extended wall 45 of the cylinder 49 of the outer rotor 44 and enlarged diameter 47 of the hollow shaft 140 with openings 48 on it. Also, here are visible peripheral plates 82, 85, 88 and 135 of the deviation control mechanism.

Figure 5:
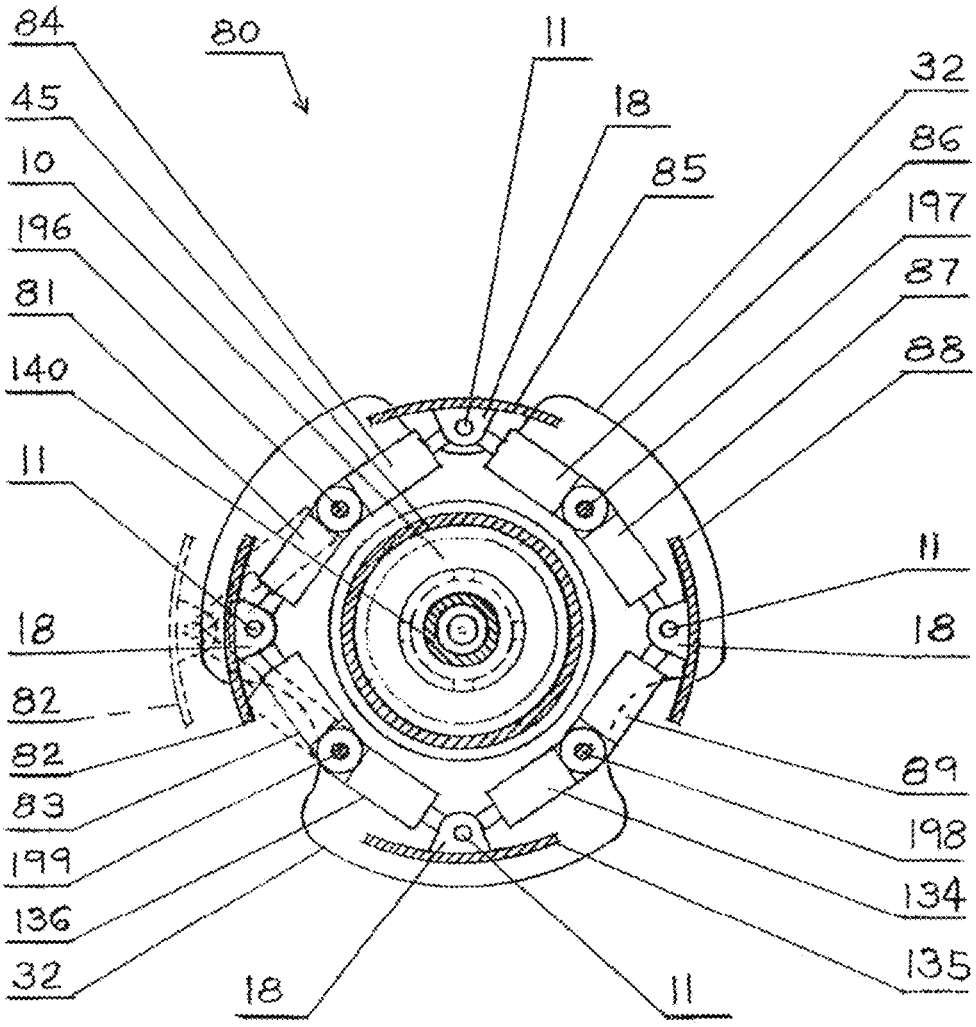
FIG. 5 is a cross sectional view taken along line 5-5' of FIG. 3 of an in-ground motorized drill head illustrating a hydraulic system for deviation control in accordance with one embodiment.

FIG. 5 is a cross sectional view taken along line 5-5' of FIG. 3 of an in-ground motorized drill head 20 through deviation control system 80. Here in FIG. 5 is illustrated hydraulic system 80 for deviation control already explained and partially illustrated in FIG. 3. Deviation control system 80 consists of four peripheral plates 82, 85, 88 and 135 with eye brackets 18 fixed on their inner sides. Four peripheral plates 82, 85, 88 and 135 are pivotally engaged with piston arms of four pairs of opposing hydraulic cylinders 81 and 83, 84 and 86, 87 and 89, 134 and 136 and secured with pivot pins 11. There are four bars 196, 197, 198 and 199 extending from the bottom of peripheral cylinder 75 of the housing of the motor block 42. Two hydraulic cylinders are pivotally secured to each extended bar. The bar 196 is engaged with cylinders 81 and 84. The bar 197 is engaged with cylinders 86 and 87. The bar 198 is engaged with cylinders 89 and 134. The bar 199 is engaged with cylinders 83 and 136. When selected set of cylinders is activated and extends its pistons arms the peripheral plate which pivots them also extend and pushes against wall of the well bore providing movement of the whole drill head in opposite direction and forces drill head to gradually change direction. Extended position of the peripheral plate 82 is illustrated with dash lines.

Figure 6:
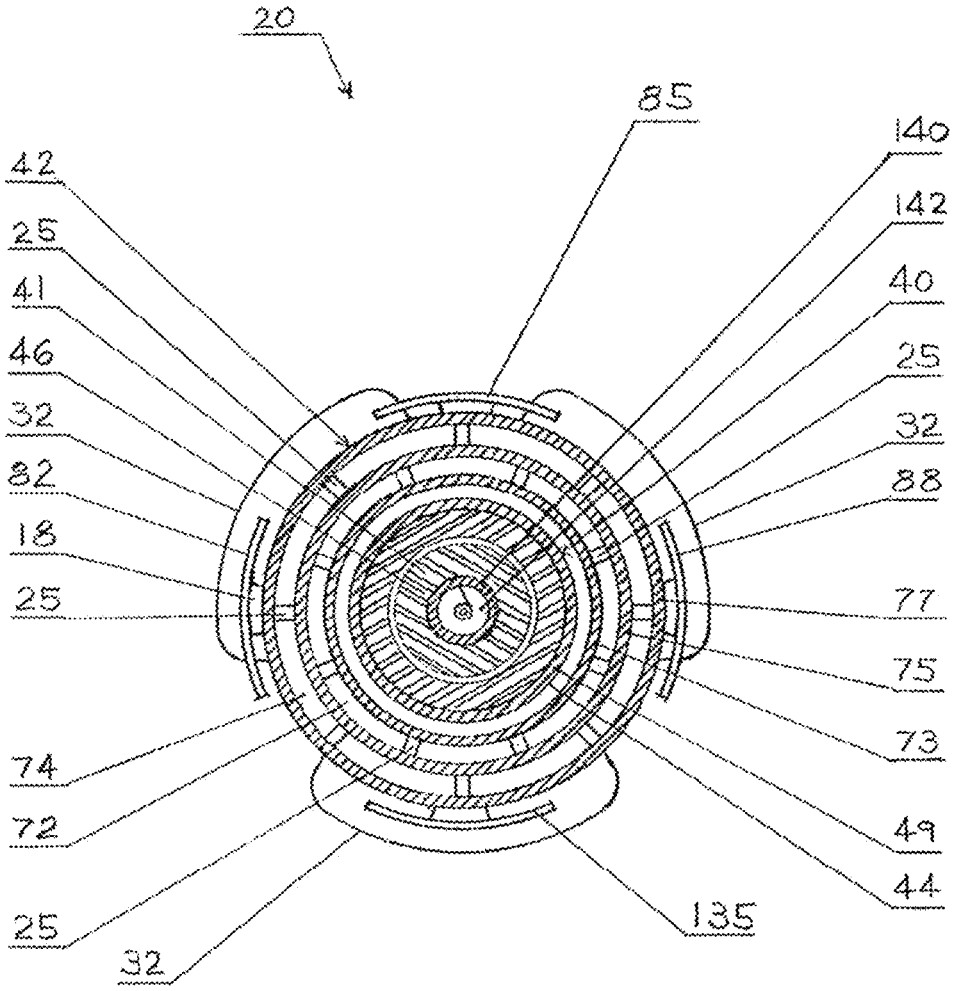
FIG. 6 is a cross sectional view taken along line 6-6' of FIG. 3 of an in-ground motorized drill head in accordance with one embodiment.

FIG. 6 is a cross sectional view taken along line 6-6' of FIG. 3 of an in-ground motorized drill head 20. Here in FIG. 6 are illustrated main elements already explained and partially illustrated in FIG. 3; The hollow shaft 140 with continues spiral blades 142 inside and electromagnetic coil 41 which is fix element of the inner rotor 46; electromagnetic coil 43 with cylinder 49 which is fix element of the outer rotor 44; motor housing block 42 which consist of three peripheral cylinders 73, 75 and 77 which form two peripheral chambers 72 and 74 which surrounds inner rotor 46 and outer rotor 44 of the electric motor 40. Peripheral cylinders 73, 75 and 77 are interconnected with discontinues structural ribs 25 which can be positioned strait vertical or spiraled to guide fluids through chambers in order to absorbs heat and cool motorized drill head 20 more effectively. Also, here are visible four peripheral plates 82, 85, 88 and 135, which are elements of the deviation control system 80 illustrated in more details in FIGS. 3 and 5). Also, visible here is peripheral drill bit 32.

Figure 7:
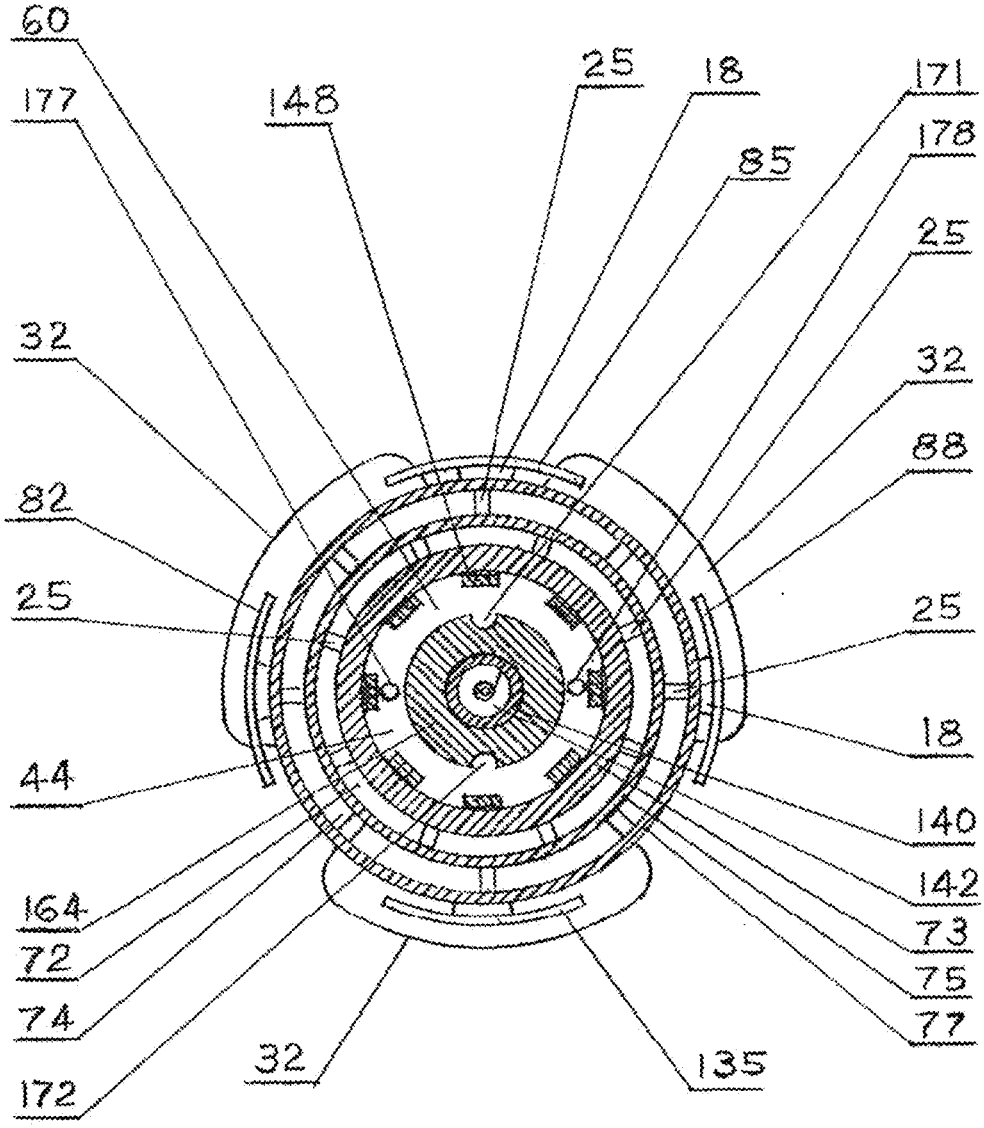
FIG. 7 is a cross sectional view taken along line 7-7' of FIG. 3 of an in-ground motorized driven drill head in accordance with one embodiment.

FIG. 7 is a cross sectional view taken along line 7-7' of FIG. 3 of an in-ground motorized drill head 20, through rotation control mechanism or switch compartment 60. Here in FIG. 7 are illustrated: hollow shaft 140 with continues spiral blade 142; disc extension of the cuff 164 with two recesses 171 and 172 for receiving pins 173 and 174 (illustrated in FIG. 8) which can be activated through electrically controlled switches 175 and 176 located in switch compartment 60 (illustrated in FIG. 8) in order to block rotation of the shaft 140 and consequently central drill bit 34.

The rotation control mechanism or switch compartment 60 also contain two additional switches 185 and 186 with pins 187 and 188 (illustrated in FIG. 8) which when activated engages with corresponding cavities 177 and 178 located in upper portion of the outer rotor 44 in order to block rotation of the outer rotor 44 and consequently peripheral drill bit 32. Also, here are illustrated several bearings 148 positioned on the several pins which extend from the inner side of the wall of peripheral cylinder 73 of the motor housing 42 and are spread around cylinder and engaged with outer rotor 44 at its upper surface. The purpose of bearings 148 is to prevent vertical sliding motion between outer rotor 44 and stationary motor housing block 42 (illustrated in FIG. 3). Also, illustrated here are three peripheral cylinders 73, 75 and 77 which form two peripheral chambers 72 and 74. Also, illustrated here are discontinue structural ribs 25, peripheral plates 82, 85, 88 and 135 and peripheral drill bit 32 which and are explained earlier.

FIG. 8 is a cross sectional view taken along line 8-8' of FIG. 3 of an in-ground motorized drill head 20, through rotation control mechanism or switch compartment 60. Here are illustrated hollow shaft 140 with continues spiral blade 142; cuff 164; bearing 156; electrically controlled switches 175 and 176 with their pins 173 and 174 which when activated engages with corresponding recesses 171 and 172 located on the cuff 164 (illustrated in FIG. 7) in order to block rotation of the inner rotor 46 and consequently central drill bit 34. Also, illustrated are electrically controlled switches 185 and 186 with their pins 187 and 188 (illustrated in FIG. 3) which when activated engages with corresponding cavities 177 and 178 (illustrated in FIG. 7) located in upper portion of the outer rotor 44 in order to block rotation of the outer rotor 44 and consequently peripheral drill bit 32. Also, illustrated are three peripheral cylinders 73, 75 and 77 which form two peripheral chambers 72 and 74; discontinue structural ribs 25; peripheral plates 82, 85, 88 and 135 and peripheral drill bit 32 which and are explained earlier.

The rotation control mechanism or switch compartment 60 provides an optional function. Electrically controlled switches with pins can block rotations of either outer or inner rotor otherwise rotors rotate in opposite directions and are balanced.

FIG. 9 is a cross sectional view taken along line 9-9' of FIG. 10 of a hydraulic mechanism 50 for adjustment of drill bits and selection of cuttings size.

Here is illustrated hydraulic control mechanism (system) 50 positioned on the upper portion of the motor housing 42. The hydraulic mechanism 50 contains four hydraulic cylinders 51, 52, 53, and 54 (Illustrated in FIG. 10) with their engaged piston arms 55, 56, 57 and 58, and springs 61, 62, 63 and 64 and container 65 for hydraulic fluid. One end of the pistons arm 55, 56, 57 and 58 is fixed to the platform 66 which through extended neck 68 is extended part of the motor housing block 42. The other end of the cylinders 51, 52, 53, and 54 are fixed to the platform 67 on which hydraulic fluid container 65 with necessary pumps and hoses (not illustrated) is located. The platform 67 has extended sleeve 23 which surrounds and is fixed to the lowest section of the stationary excavation pipe 70. The platform 66, extended shaft 68 and motor housing block 42 are supported with structural plates 22. The purpose for hydraulic system 50 is to pull up the stationary motor housing block 42 and outer rotor 44 which is engage with peripheral drill bit 32 in order to provide greater distance between shedding surfaces of the central drill bit 34 and peripheral drill bit 32. Distance between shedding surfaces of the central and peripheral drill bits determines size of the cuttings.

FIG. 10 is a cross sectional view taken along line 10-10' of FIG. 9 of a hydraulic compartment 50 for adjustment of drill bits and selection of cuttings size. Here are illustrated bearing 192 positioned between rotating hollow shaft 140 which is central element of the inner rotor 46 of the electric motor 40 and the lowest section of the stationary excavation pipe 70 (illustrated in FIG. 9); Also, here are illustrated four hydraulic cylinders 51, 52, 53, and 54 explained earlier in FIGS. 3 and 9. Also, illustrated are two sets of heath insulated tubes 106, 108 which delivers cooled fluid (mud) trough motor block into bottom of the well bore and another sets of heath insulated tubes 114 and 116 which are part of closed loop system which circulate fluids through inner peripheral chamber 72 and exchange heat on ground surface trough binary power unit 180 (illustrated in FIGS. 1, 2 and 9). Also, illustrated are structural plates 22 which support platform 66, extended shaft 68 and motor housing block 42. Here is also illustrated electric cable 15 for supplying electric power to the motor head 20 and various sensors (not illustrated). Also, illustrated are peripheral plates 82, 85, 88 and 135 and peripheral drill bit 32 which are explained earlier.

In FIGS. 9 and 10 a hydraulic system 50 is illustrated although as an alternative electro mechanical mechanism could be used as well.

Figure 11:
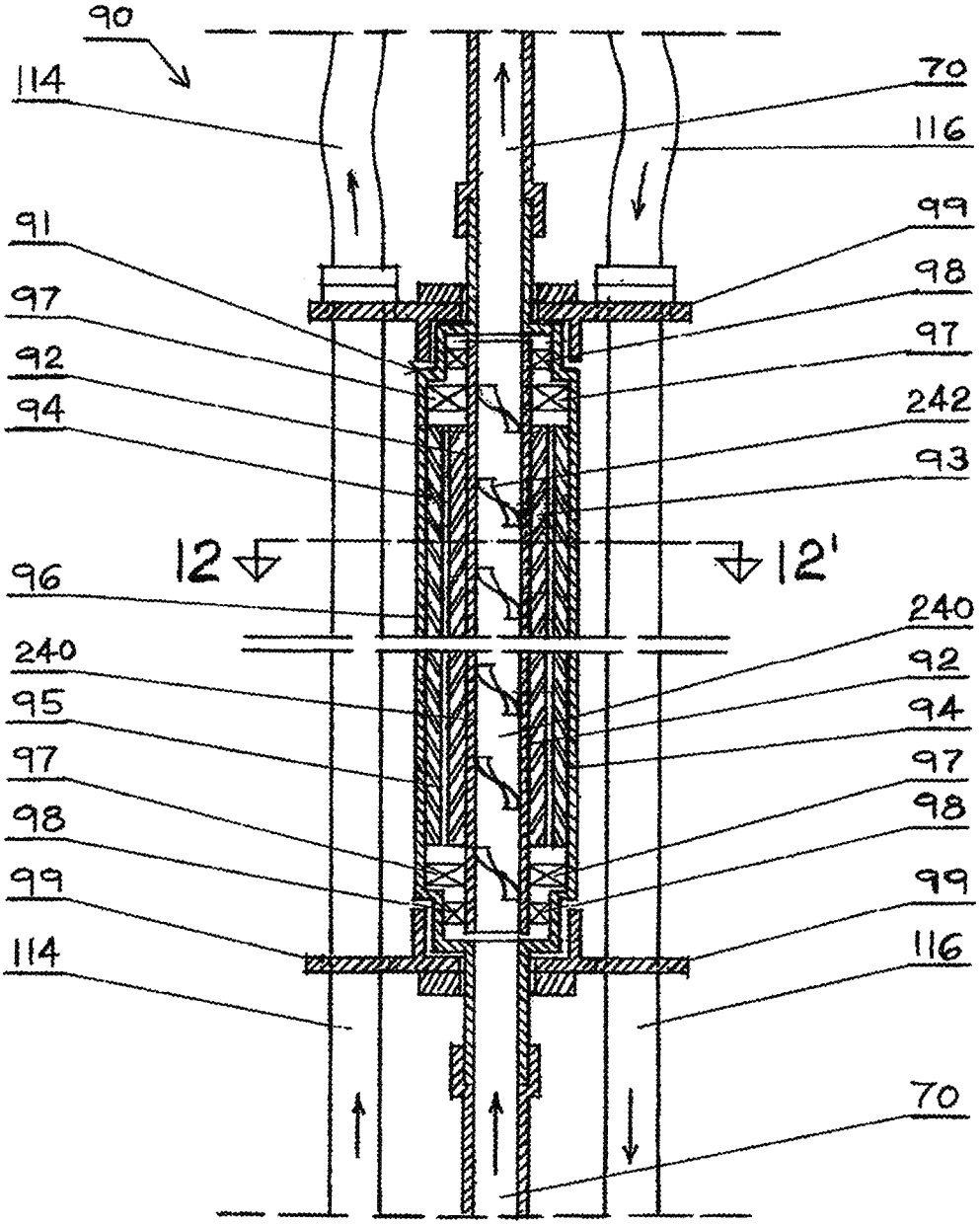
FIG. 11 is a cross sectional view taken along line 11-11' of FIG. 12 of an excavation pump in accordance with one embodiment.
Figure 12:
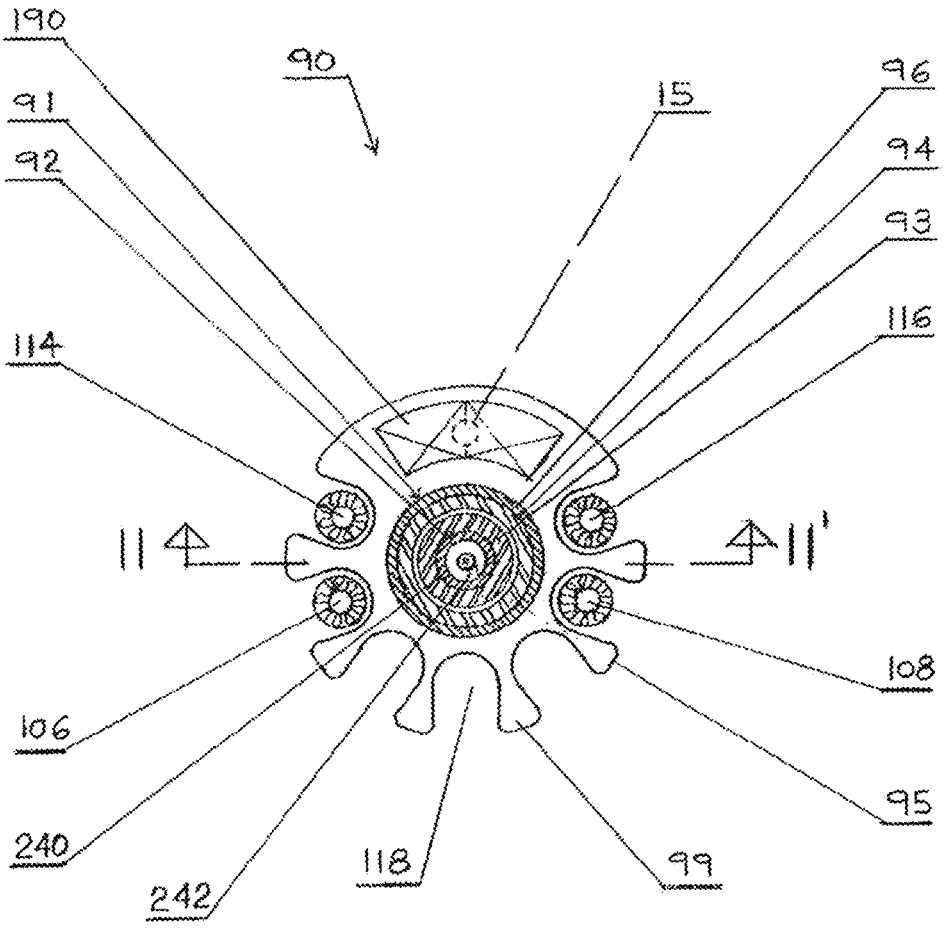
FIG. 12 is a cross sectional view taken along line 12-12' of FIG. 11 of an excavation pump in accordance with one embodiment.

FIG. 11 is a cross sectional view taken along line 11-11' of FIG. 12 of an in-line excavation pump 90 which is a segment of an apparatus for drilling faster, deeper and wider well bore, illustrated in FIG. 1. Excavation in-line pump 90 is a replaceable segment in excavation line 70. In-line excavation pump 90 is an electro motor 91 consisting of a rotor 92 and a stator 94. The rotor 92 consists of a hollow shaft 240 which is fixedly surrounded with an electromagnetic coil 93. The stator 94 consists of a cylinder 96 which is housing of the motor 91 and is fixedly engaged with electromagnetic coil 95. Stator 94 and rotor 92 are engaged through two sets of ball bearings 97 and additional set of sealant bearings 98. The cylinder 96 of the motor 91 has diameter reduction on each end and is aligned with the segments of the main excavation pipe 70. The hollow shaft 240 has continues spiral blades 242 formed on the inner side of the shaft. When electro motor 91 is activated the hollow shaft 240 which is central element of the rotor 92 rotates and provides suction force at the lower end and pushing force on the upper end of the excavation pump 90. The mud and cuttings are pumped up through excavation pipe (main pipe) 70 to the next in-line excavation pump for farther pumping. The excavation in-line pump segments 90 are repetitively installed as needed for mud and cuttings to reach ground surface and out of the well bore.

There are two brackets 99 secured on each side of the excavation pump 90 with recesses 118 provided for delivery fluid line tubes 106 and 108; and for cooling system line tubes 114 and 116 (also illustrated in FIG. 12). In-line pump 90 can be used for moving material (a substance) of different viscosity upward including mud, oil, water, etc. Alternatively, if used in deepwater oil extraction (production) as a segment of a raiser pipe an additional cylinder can be added surrounding stator cylinder 96 to provide a space which can be filled with oil or air to provide buoyancy to the in-line pump.

FIG. 12 is a cross sectional view taken along line 12-12' of FIG. 11 of an in-line excavation pump 90 which is a segment of an apparatus for drilling faster, deeper and wider well bore (illustrated and explained in FIGS. 1 and 11. The in-line excavation pump 90 is an electro motor 91. Here are illustrated all parts already explained in FIG. 11. Also, here is illustrated bracket 99 with recesses 118 provided for delivery fluid line tubes 106 and 108 and for cooling system line tubes 114 and 116. There are several extra recesses 118 for additional lines, if needed. Also here is illustrated transformer box 190 with electric cable line 15 for supplying electric power to the motor head 20, excavations pump 90 and various sensors, cameras, lights, etc. (not illustrated).

Figure 13:
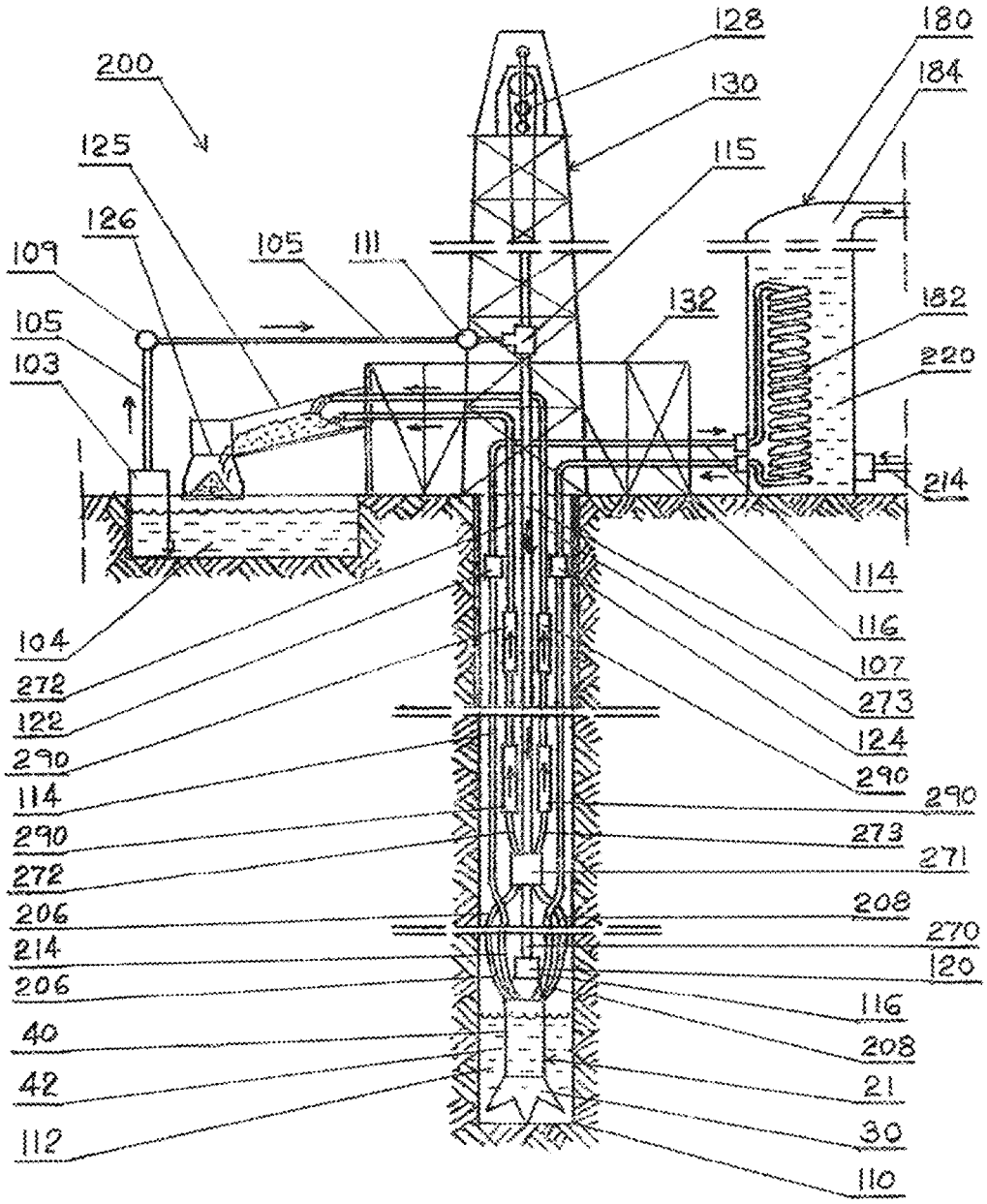
FIG. 13 is a schematic diagram of cross sectional view of an apparatus and method for drilling a well bore in accordance with another embodiment.

Referring now to FIG. 13; here is illustrated schematic diagram and cross sectional view of an alternative apparatus and method 200 for drilling faster, deeper and wider well bore. The embodiment 200 is similar to embodiment 100 explained earlier in FIGS. 1-12.

The apparatus and method 200 comprising the steps of:

Cutting and shredding bottom of the well bore 110 with motorized drill head 21;

Transporting mud and cuttings through a separate excavation line 270 up to the ground surface;

Delivering filtered fluid through a separate delivery line 107 and tubes 206 and 208 to the bottom of the well bore; and Cooling the motorized drill head 21 through a separate close loop cooling line (tubes 114 and 116) exchanging heat on the ground surface in a binary power unit 180 and in process producing electricity. Described herein are only differences.

The in-ground motorized drill head 21 consist of the same major elements explained earlier in motorized drill head 20 with exception deviation control system and a hydraulic control system for providing vertical sliding motion of the peripheral rotor 44 and peripheral drill bit 32. The deviation control system 120 for tilting drill head 21 is located at the top of motorized drill head 21 and is explained in FIG. 19.

Excavation system consists of: motorized drill head 21 which cut and shred bottom of the well bore (illustrated in FIG. 14); excavation pipe 270 which is connected at one end to the motorized drill head 21 and at other end to the crossing box 271. The crossing box 271 splits flow of pumped mud and cuttings on the way up into two lines (hoses) 272 and 273 (illustrated in FIGS. 21-23) to increase excavation capacity and to reduce load of single line; Two excavation hoses (tubes) 272 and 273 are main excavation line(s), are formed of plurality of hose segments, connects crossing box 271 and in-line excavation pumps 290 which then pump mud and cuttings to the next excavating pumps segment. The excavation pump sections 290 are repetitively installed, as needed, to for mud and cuttings to reach ground surface and out of the well bore, where mud and cuttings are passed through shale shaker 125 where rock cuttings are separated from mud and then through shale slide 126 conveys to the reserve pit. Then a filtered and cooled fluid from mud pit 104 is pumped back through pump 103 and pipe 105 into main pipe 107 and reused.

Fluids delivery system consists of: a pump 103 located in mud pit 104 on the ground surface; a pipe 105 with two adjustable joints 109 and 111 and one T-shape connection element 115 enabling additional segment of the main pipe 107 to be added. The main pipe 107 is formed of plurality of segments which transports filtered and cooled fluids from mud pit 104 to the crossing box 271. The crossing box 271 splits flow of filtered and cooled fluids into two lines (hoses) 206 and 208 (illustrated in FIGS. 21-23) which are connected to outer peripheral chamber 74 of the motor block 42 of the drill head 21 (illustrated in FIG. 14). Filtered and cooled fluids passes through motor block 42 and provide additional cooling of the motor block 42 and fluid for drilling as explain in embodiment in FIGS. 1 and 3.

Figure 14:
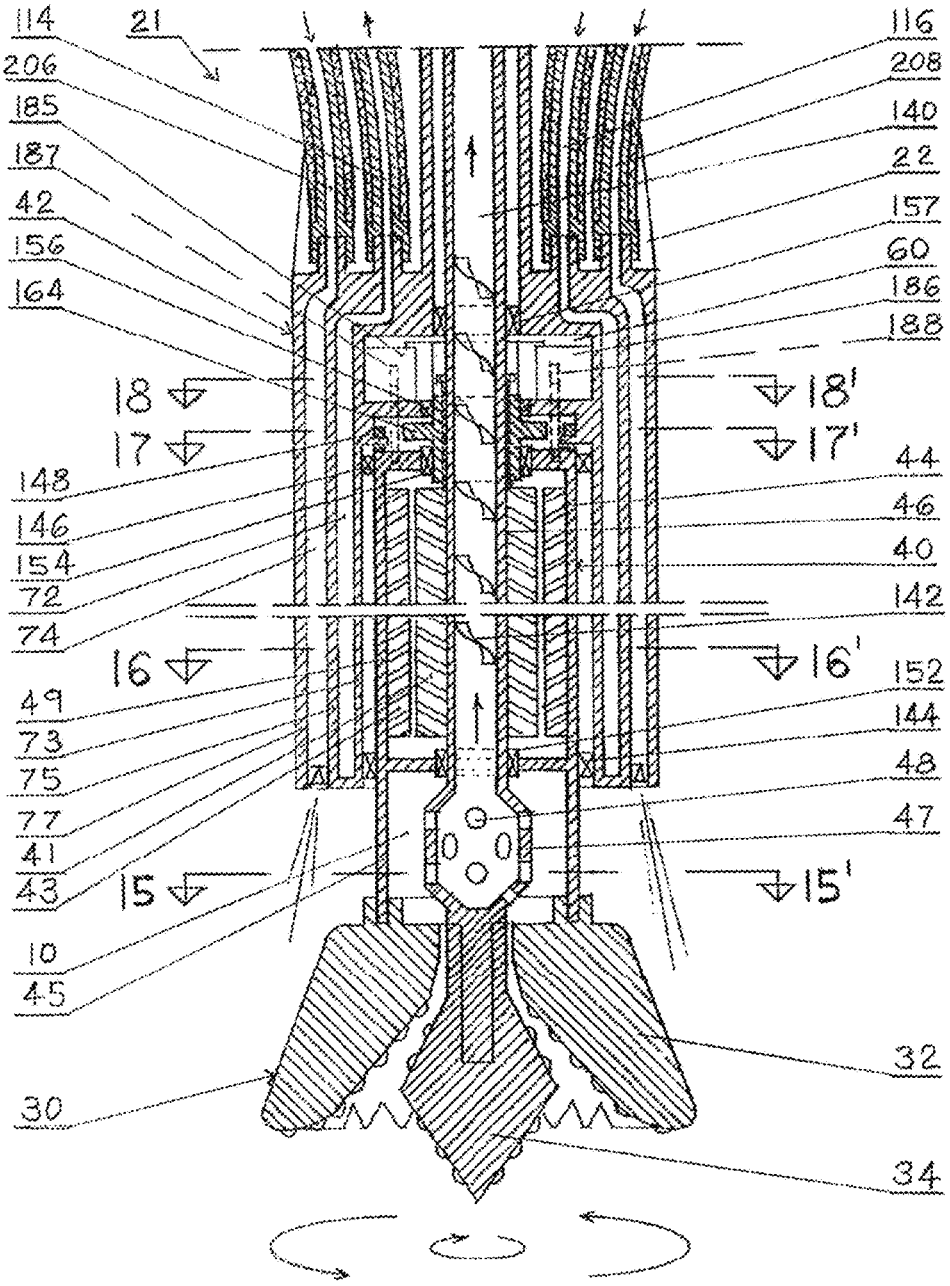
FIG. 14 illustrates an enlarged cross sectional view taken along line 14-14' of FIG. 18 of the in-ground motorized drill head shown in FIG. 13.
Figure 18:
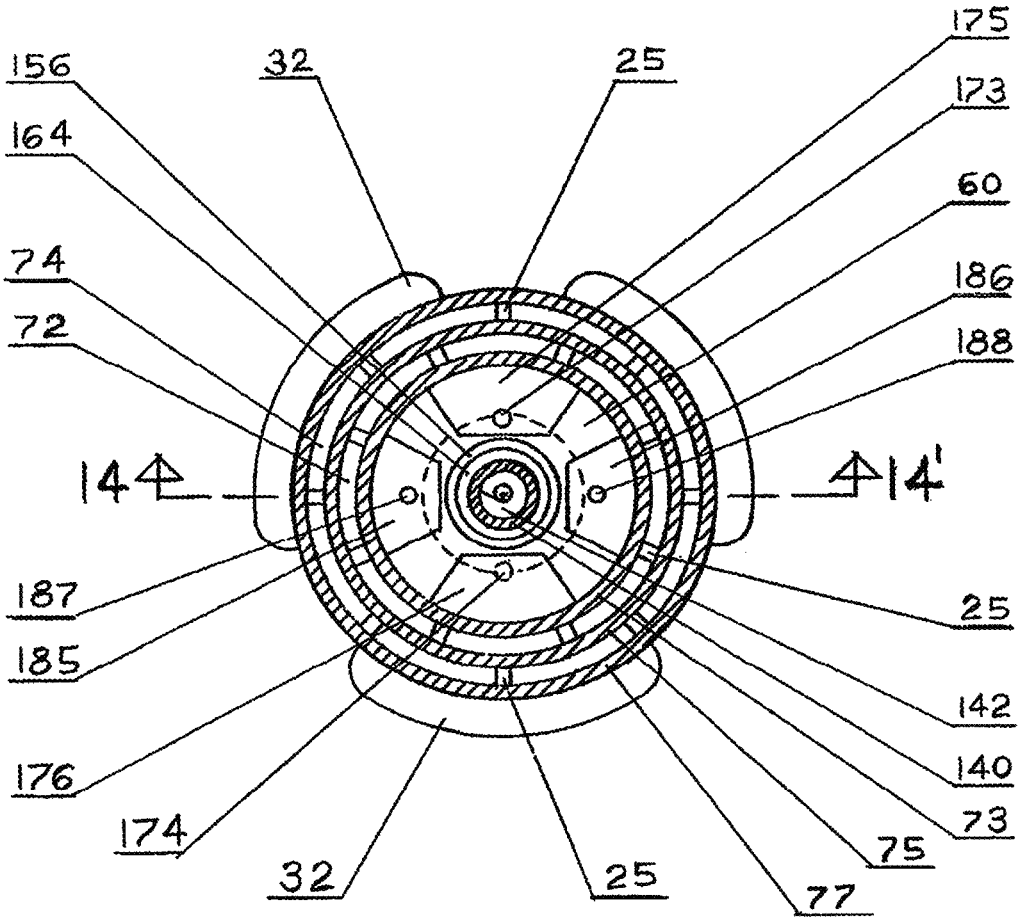
FIG. 18 is a cross sectional view taken along line 18-18' of FIG. 14 of an in-ground motorized drill head in accordance with one embodiment.

FIG. 14 illustrates an enlarged cross sectional view taken along line 14-14' of FIG. 18 of an in-ground motorized drill head 21 of an alternative embodiment 200 for drilling faster, deeper and wider well bore, explained in FIG. 13. The in-ground motorized drill head 21 consist of the same major elements explained earlier in motorized drill head 20. In this embodiment deviation control mechanism (system) 120 is located at the top of motorized drill head 21 (illustrated and explained in FIG. 19). In this embodiment there is no a hydraulic control mechanism for providing vertical sliding motion of the peripheral rotor 44 and peripheral drill bit 32.

Figure 15:
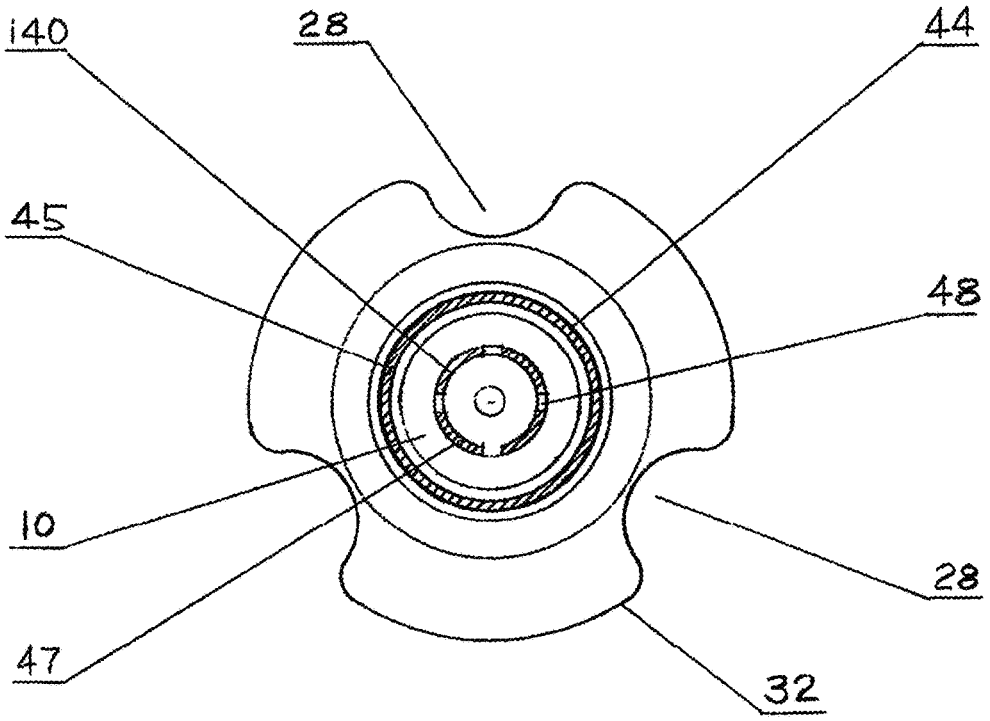
FIG. 15 is a cross sectional view taken along line 15-15' of FIG. 14 of an in-ground motorized drill head in accordance with one embodiment.

FIG. 15 is a cross sectional view taken along line 15-15' of FIG. 14 of an in-ground motorized drill head 21. Here in FIG. 15 is illustrated drill bit 32 with three recesses 28 which forms a three-teethed peripheral drill bit 32. Also, here are illustrated collecting chamber 10 formed between extended wall 45 of the cylinder 49 of the outer rotor 44 and enlarged diameter 47 of the hollow shaft 140 with openings 48 on it.

Figure 16:
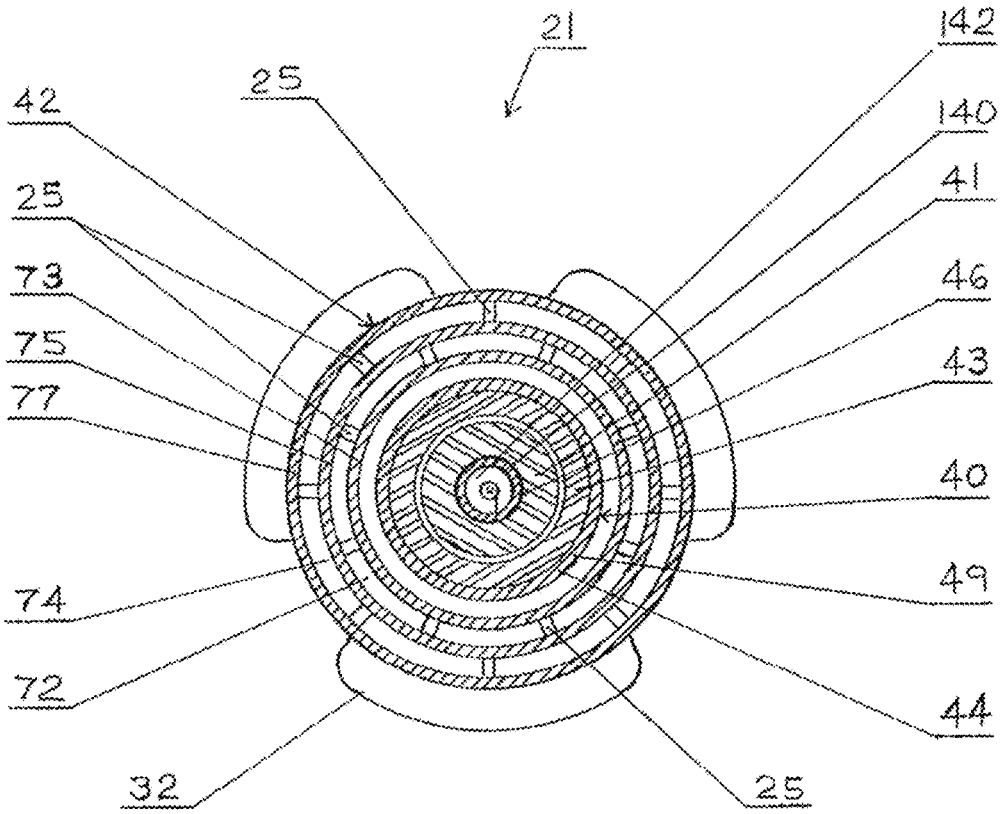
FIG. 16 is a cross sectional view taken along line 16-16' of FIG. 14 of an in-ground motorized drill head in accordance with one embodiment.

FIG. 16 is a cross sectional view taken along line 16-16' of FIG. 14 of an in-ground motorized drill head 21, in accordance with embodiment. Here in FIG. 16 are illustrated elements almost identical with elements explained and illustrated in FIG. 6.

Figure 17:
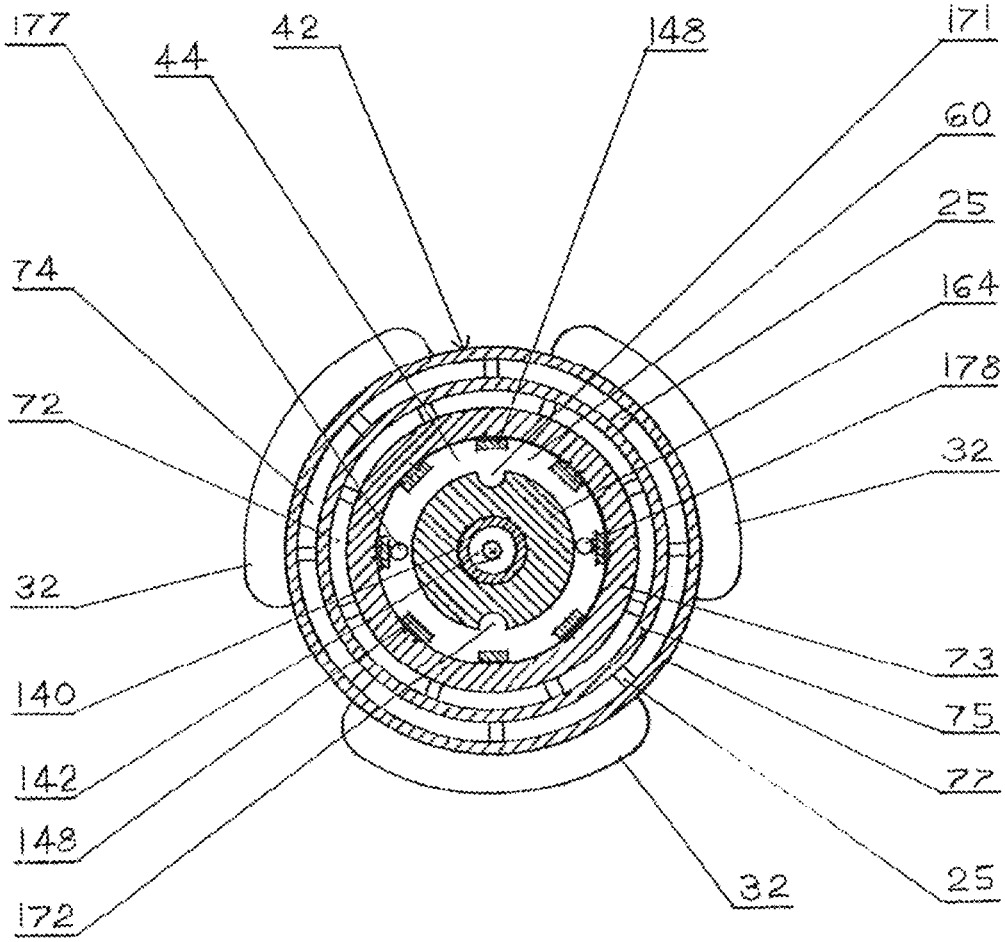
FIG. 17 is a cross sectional view taken along line 17-17' of FIG. 14 of an in-ground motorized drill head in accordance with one embodiment.

FIG. 17 is a cross sectional view taken along line 17-17' of FIG. 14 of an in-ground motorized drill head 21, through rotation control section or switch compartment 60. Here in FIG. 17 are illustrated elements almost identical with elements explained and illustrated in FIG. 7.

FIG. 18 is a cross sectional view taken along line 18-18' of FIG. 14 of an in-ground motorized drill head 21, through rotation control switch compartment 60. Here in FIG. 18 are illustrated elements almost identical with elements explained and illustrated in FIG. 8.

Figure 19:
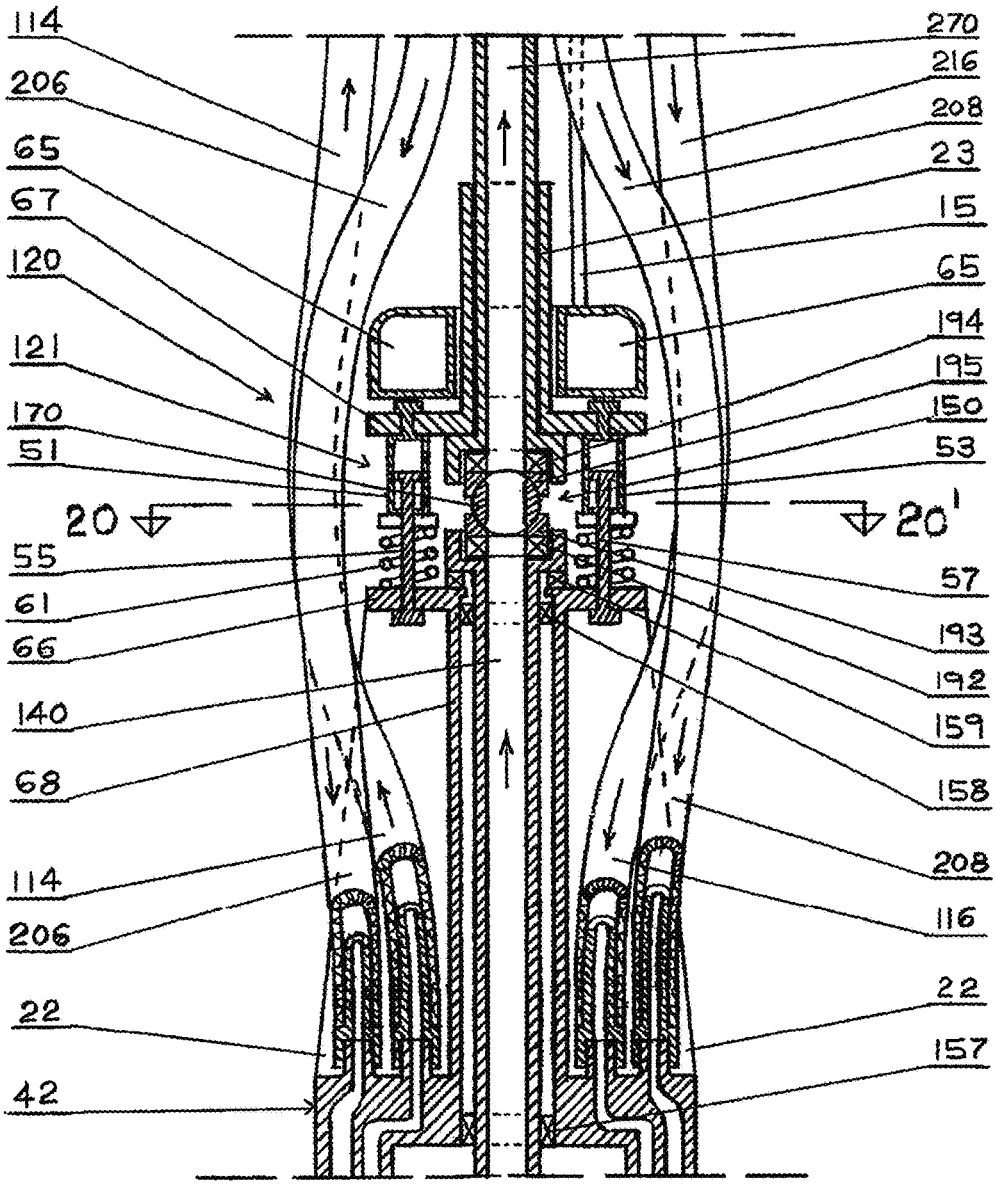
FIG. 19 is a cross sectional view taken along line 19-19' of FIG. 20 of a hydraulic deviation control mechanism in accordance with one embodiment.

FIG. 19 illustrates deviation control mechanism 120 positioned on the upper portion of the motorized drill head 21. Deviation control mechanism 120 consists of: a hydraulic system 121 for tilting drill head 21; and rotating joint junction 150.

Hydraulic system 121 contains four hydraulic cylinders 51, 52, 53, and 54 (illustrated in FIG. 20) with their engaged piston arms 55, 56, 57 and 58, and springs 61, 62, 63 and 64 and container 65 for hydraulic fluid. One end of the pistons arm 55, 56, 57 and 58 is fixed to the platform 66 which through extended neck 68 is extended part of the motor housing block 42. The other end of the cylinders 51, 52, 53, and 54 are fixed to the platform 67 on which hydraulic fluid container 65 with necessary pumps and hoses (not illustrated) is located. The platform 67 has extended sleeve 23 which surrounds and is fixed to the lowest section of the stationary excavation pipe 270. The platform 66, extended shaft 68 and motor housing block 42 are supported with structural plates 22. Hydraulic cylinders 121 are activated (contracted or extended individual or in pairs), when needed, to provide tilt of the drill head 21 in order to adjust direction of drilling.

Rotating joint junction 150 is a place where rotating hollow shaft 140, which is central element of the electric motor 40 joint stationary section of the main pipe 270. The rotating hollow shaft 140 and stationary section of the main pipe 270 are engaged through spherical shape channeled bushing 170, a set of spherical support pillows 193 and 195 and set of bearings 192 and 194.

Figure 20:
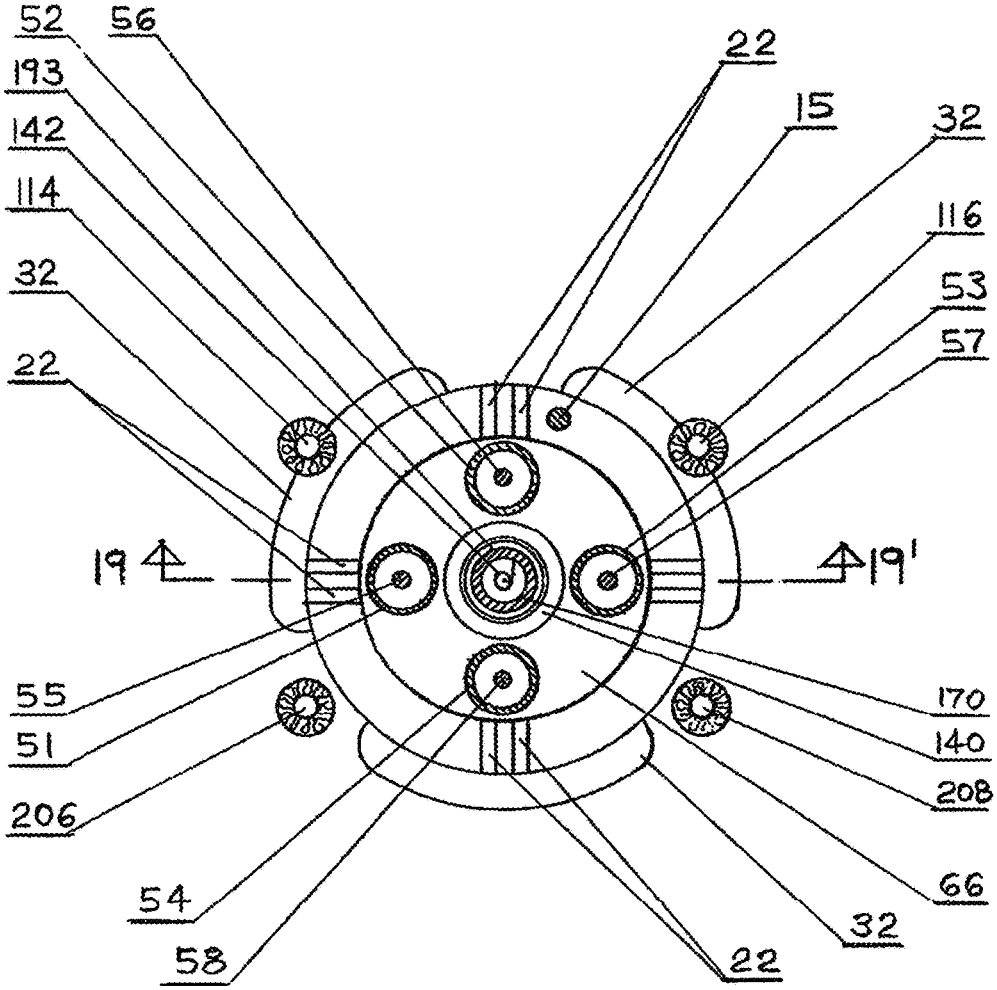
FIG. 20 is a cross sectional view taken along line 20-20' of FIG. 19 of a hydraulic deviation control mechanism in accordance with one embodiment.

FIG. 20 is a cross sectional view taken along line 20-20' of FIG. 19 of an deviation control mechanism 120 of an alternative embodiment 200 illustrated in FIG. 13, Here is illustrated flange of hollow shaft 140; spherical shape channeled bushing 170; spherical support (pillow) 193; four hydraulic cylinders 51, 52, 53, and 54 with their engaged piston arms 55, 56, 57 and 58. Also, here are illustrated platform 66; structural plates 22; peripheral drill bit 32; heat insulated tubes 114 and 116 which are part of closed loop system which circulate fluids through inner peripheral chamber 72 and exchange heat on ground surface trough binary power unit 180 and heath insulated tubes 106, 108 which delivers cooled fluid (mud) trough motor block into bottom of the well bore (illustrated in FIGS. 13, 14, 19). Also here is illustrated electric cable 15 for supplying electric power to the motor head 21 and various sensors (not illustrated).

In FIGS. 19 and 20, hydraulic mechanism 120 is illustrated although other mechanisms like electro mechanical mechanism with treaded rods could be used as well.

Figure 21:
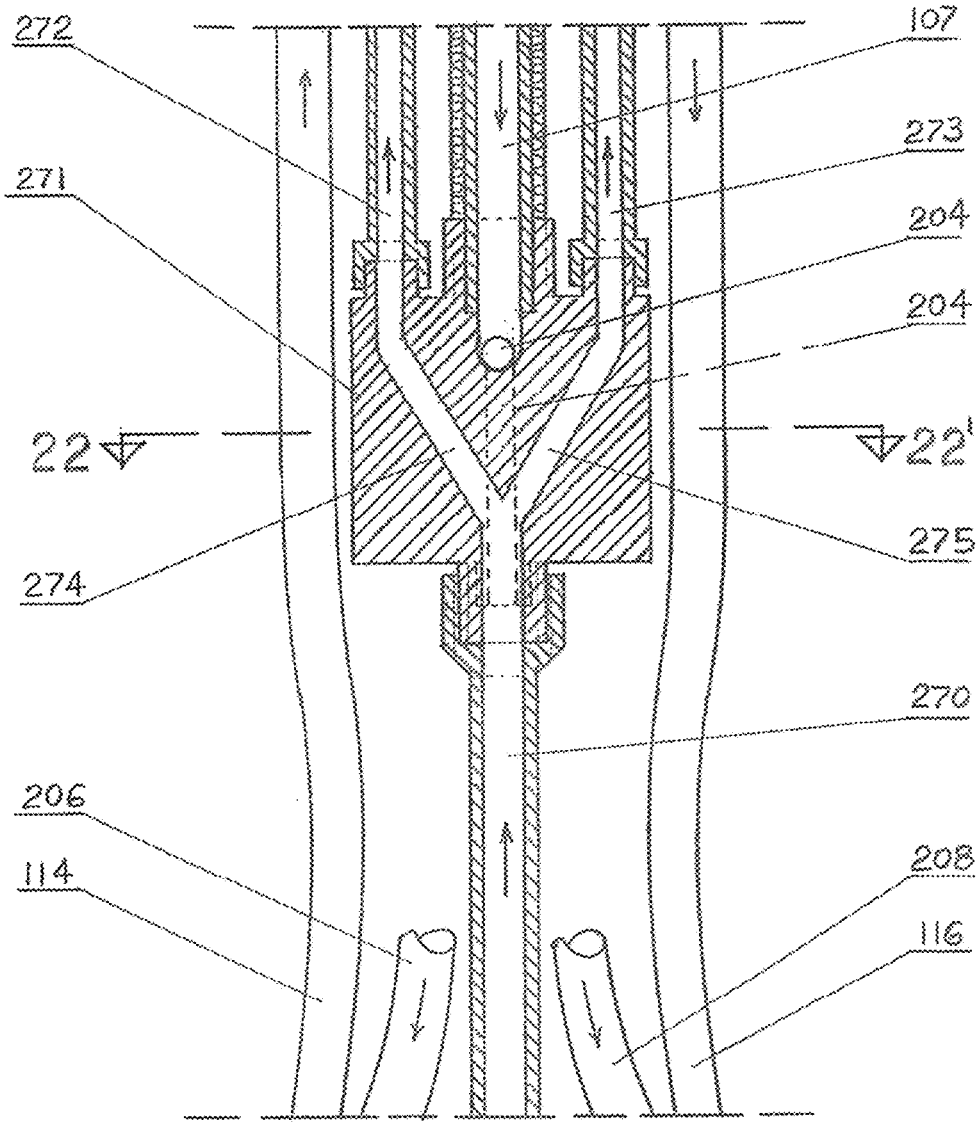
FIG. 21 is a cross sectional view taken along line 21-21' of FIG. 22 of a crossing box in accordance with one embodiment.
Figure 22:
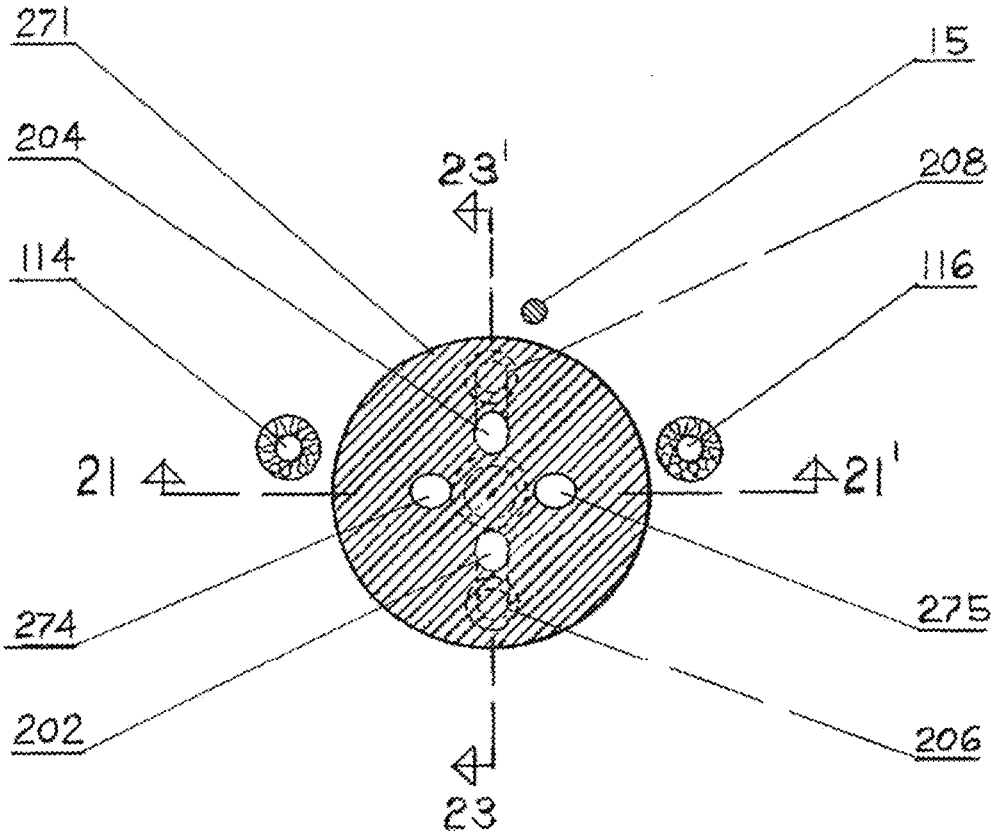
FIG. 22 is a cross sectional view taken along line 22-22' of FIG. 21 of a crossing box in accordance with one embodiment.
Figure 23:
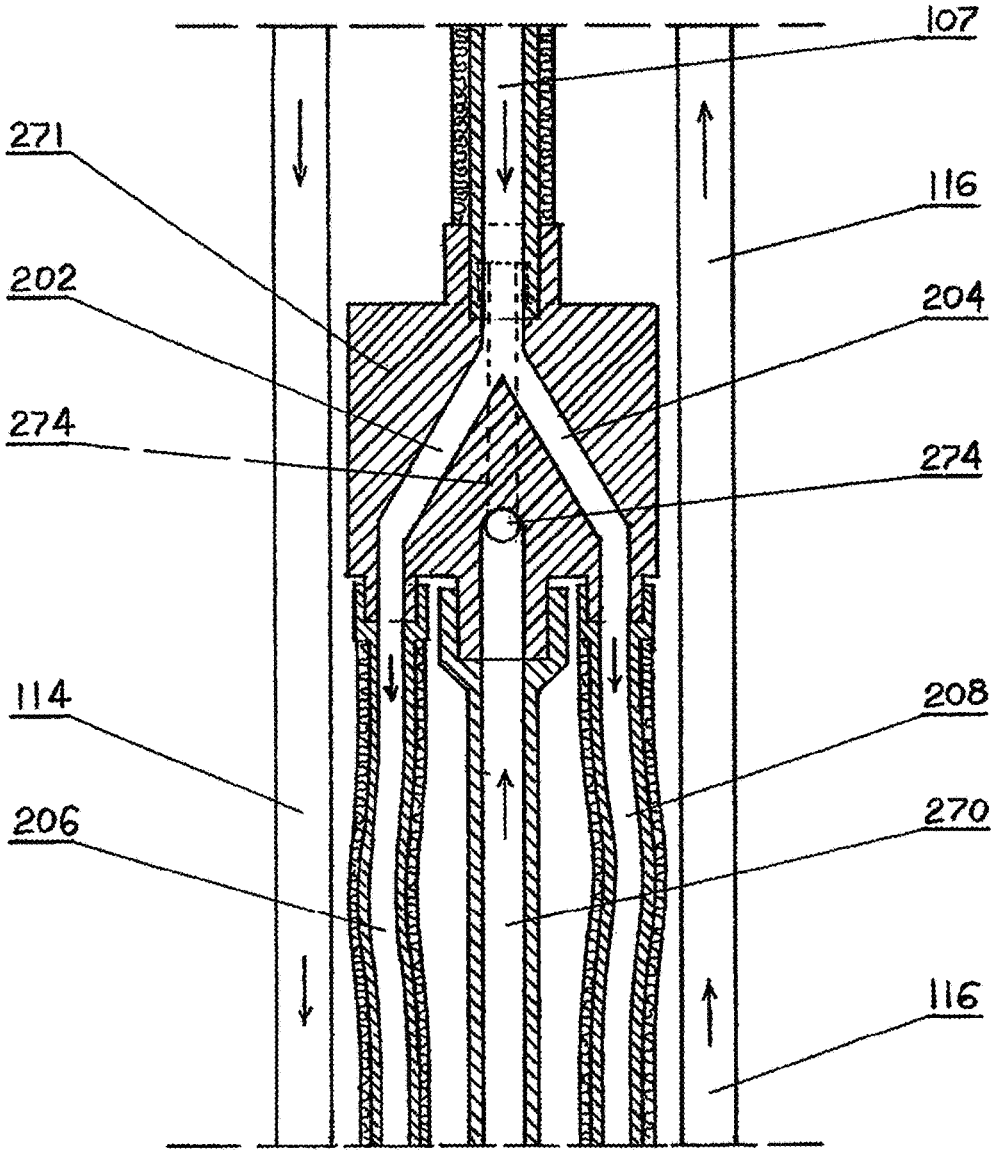
FIG. 23 is a cross sectional view taken along line 23-23' of FIG. 22 of a crossing box in accordance with one embodiment.

FIGS. 21-23 are cross sectional views of a crossing box 271 a segment of the embodiment 200 for drilling faster, deeper and wider well bore illustrated in FIG. 13.

FIG. 21 is a cross sectional view taken along line 21-21' of FIG. 22 of a crossing box 271 an element for directing fluids flow illustrated in FIG. 13, in accordance with the embodiment 200. The crossing box 271 is located between excavation pipe 270 and main pipe 107. The crossing box 271 (illustrated in FIGS. 13, 21-23) has two joining channels 274 and 275 which splits and directs flow of pumped mud and cuttings on the way up from excavation pipe 270 into two lines 272 and 273 which are main excavation line. Two excavation hoses (tubes) 272 and 273 are formed of plurality of hose segments and connect crossing box 271 and in-line excavation pumps 290 which then pump mud and cuttings to the next excavating pump segments. The crossing box 271 also has two additional joining channels 202 and 204 which splits and directs filtered fluid flow from main pipe 107 on the way down into two lines (hoses) 206 and 208 (illustrated in FIGS. 22 and 23) which are connected to outer peripheral chamber 74 of the motor block 42 of the drill head 21 (illustrated in FIG. 14) for providing additional cooling of the motor block 42 before is released into bottom of the well bore 110.

FIG. 22 is a cross sectional view taken along line 22-22' of FIG. 21 of a crossing box 271 explained in FIG. 21. Here are illustrated joining channels 274 and 275 which splits and directs flow of pumped mud and cuttings on the way up from excavation pipe 270 into two lines 272 and 273 (illustrated in FIG. 21) and also joining channels 202 and 204 which splits and directs filtered fluid flow from main pipe 107 on the way down into two lines (hoses) 206 and 208 (illustrated in FIG. 23). Here are also illustrated heat insulated tubes 114 and 116 which are part of closed loop system which circulate fluids through inner peripheral chamber 72 and exchange heat on ground surface trough binary power unit 180 (illustrated in FIG. 13). Also here is illustrated electric cable 15 for supplying electric power to the motor head 21 and various sensors (not illustrated).

FIG. 23 is a cross sectional view taken along line 23-23' of FIG. 22 of a crossing box 271 explained in FIG. 21. Here are illustrated joining channels 202 and 204 which splits and directs filtered fluid flow from main pipe 107 on the way down into two lines (hoses) 206 and 208 (also illustrated in FIG. 22) which are connected to outer peripheral chamber 74 of the motor block 42 of the drill head 21 (illustrated in FIG. 14).

Figure 24:
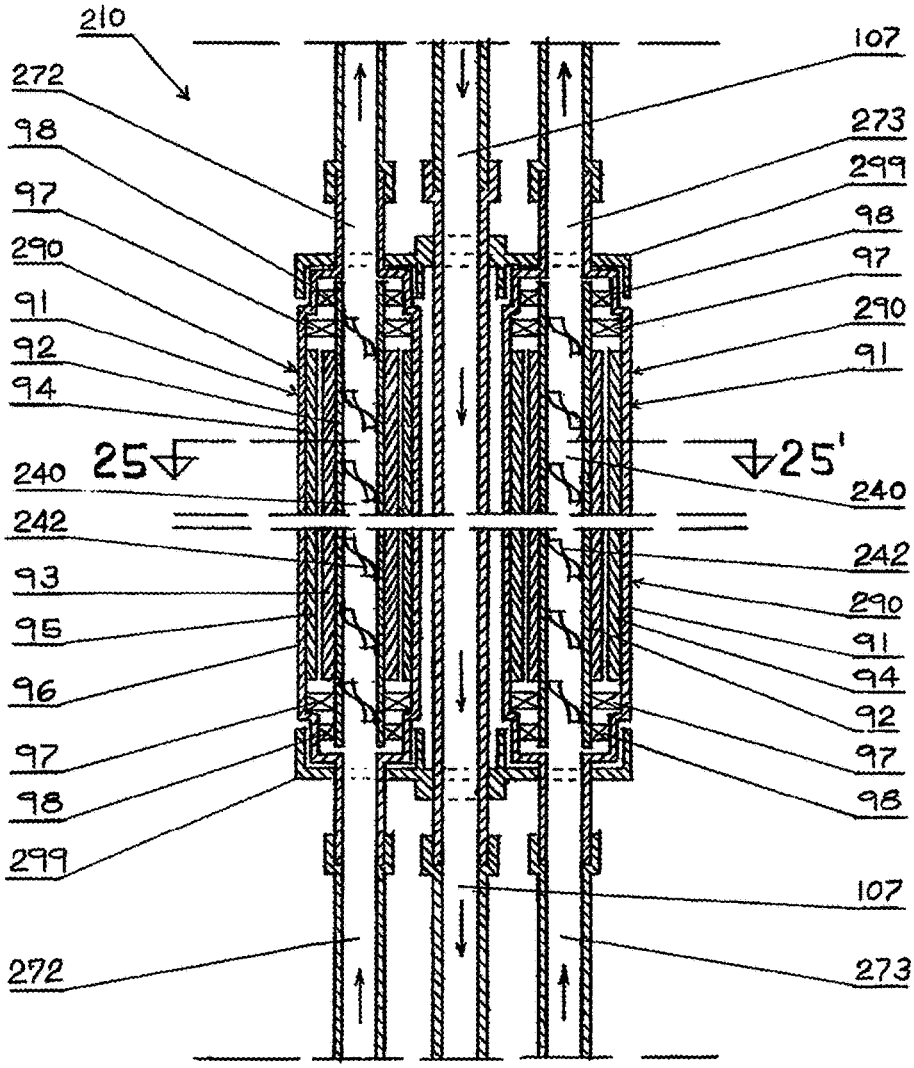
FIG. 24 is a cross sectional view taken along line 24-24' of FIG. 25 of a set of excavation pumps in accordance with one embodiment.
Figure 25:
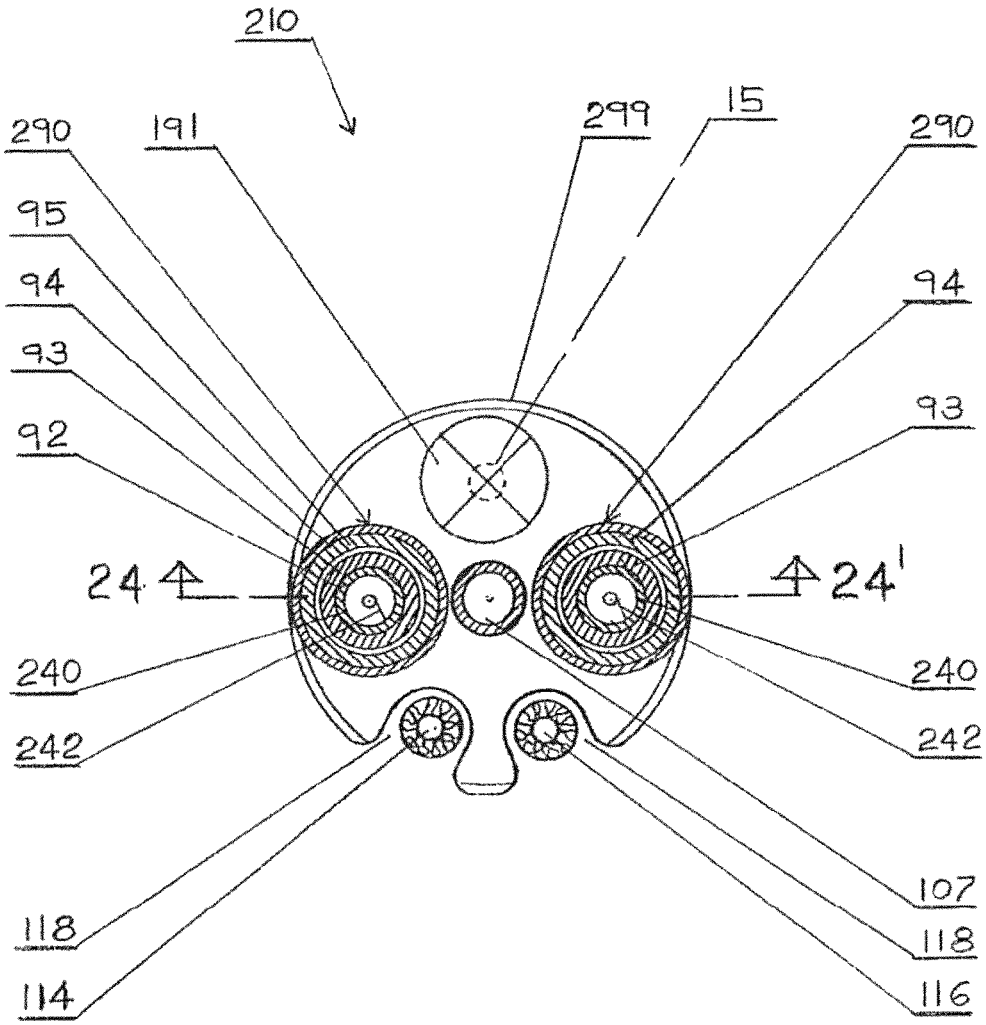
FIG. 25 is a cross sectional view taken along line 25-25' of FIG. 24 of the excavation pumps assembly shown in FIG. 24.

FIG. 24 is cross sectional views of an assembly 210 of two excavation pump 290 and main pipe 107 that represent one segment of the apparatus 200 taken along line 24-24' of FIG. 25. Assembly 210 is replaceable segment in apparatus 200. In-line excavation pump segments 290 (illustrated in FIGS. 13, 24 and 25) is repetitively installed in the excavation line 107 as needed for mud and cuttings to reach ground surface and out of the well bore. In-line excavation pump 290 is identical to the in-line excavation pump 90 already explained in FIGS. 12 and 12. The cylinder 96 of the motor 91 has diameter reduction on each end and is aligned with the segments of the main excavation hose (pipe) 272. Second identical excavations pump 290 of the assembly 210 is aligned with excavation hose 273 (also illustrated in FIG. 13). The mud and cuttings are pumped up through excavation hoses 272 and 273 to the next in-line excavation pump assembly 210 for farther pumping. The excavation in-line pump segments 210 are repetitively installed as needed for mud and cuttings to reach ground surface and out of the well bore. There are two brackets 299 secured on each side of the excavation pump assembly 210 which hold excavation pumps 290 securely.

FIG. 25 is a cross sectional view of the excavation pumps assembly 210 taken along line 25-25' of FIG. 24. Shown are the main pipe 107, two pumps 290 of the assembly 210 with their structural elements; hollow shaft 240 which has continues spiral blades 242 formed on the inner side of the shaft which is central element of the rotor 92 with its electromagnetic coils 93 and stator 94 with its electromagnetic coils 95. Here is also illustrated bracket 299 with recesses 118 provided for cooling system line tubes 114 and 116 which are part of closed loop system which circulate fluids through inner peripheral chamber 72 and exchange heat on ground surface trough binary power unit 180 (illustrated in FIGS. 13 and 14). Also, here is illustrated transformer box 191 with electric cable line 15 for supplying electric power to the motor head 21, excavations pump 290 and various sensors, cameras, lights, etc. (not illustrated).

Figure 26:
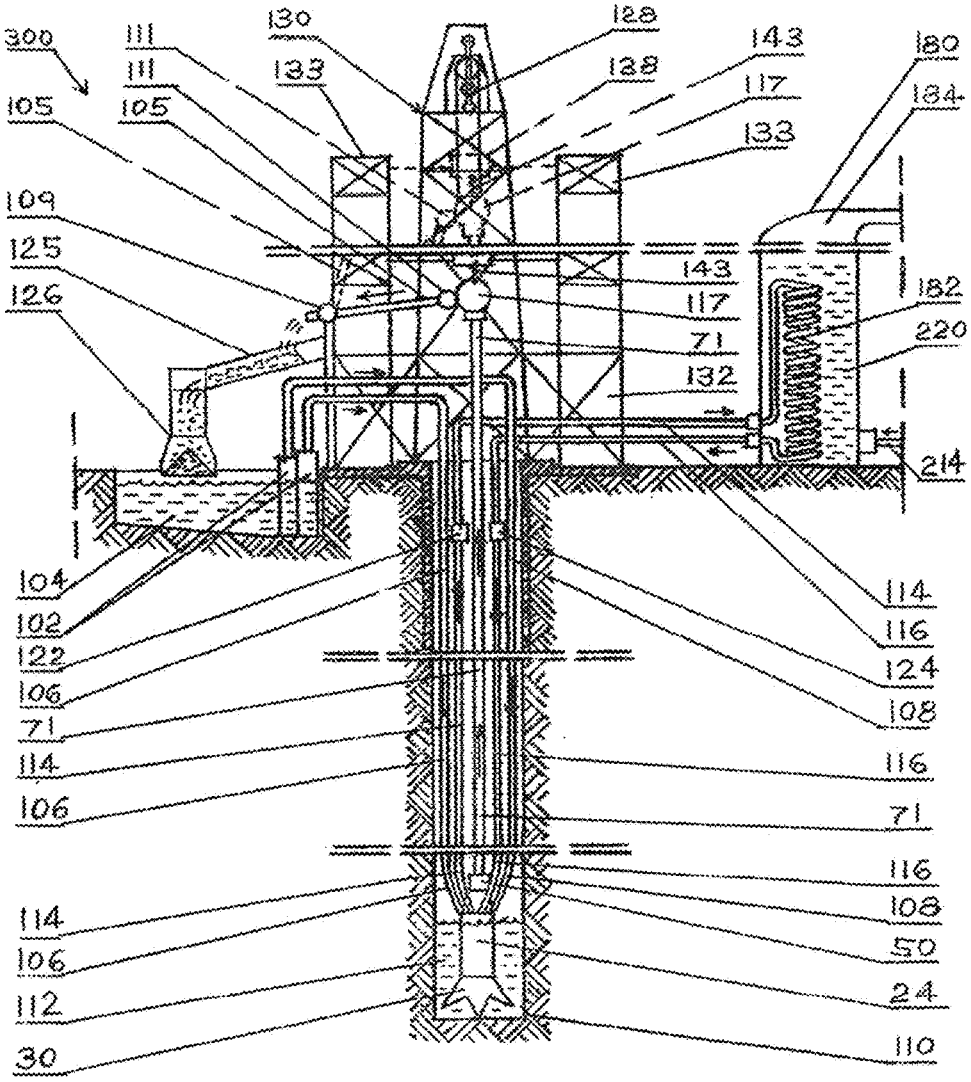
FIG. 26 is a schematic diagram and cross sectional view of an apparatus and method for drilling a well bore in accordance with another embodiment.

FIG. 26 is a schematic diagram of an alternative drilling apparatus and method 300 for drilling faster, deeper and wider well bore. The embodiment 300 is similar to embodiment 100 explained earlier in FIGS. 1-12, however, excavation system is different.

The apparatus and method 300 also comprising the steps of:

Cutting and shredding bottom of the well bore 110 with motorized drill head 24;

Transporting mud and cuttings through a separate excavation line 71 up to the ground surface;

Delivering filtered fluid through a separate delivery line (tubes 106 and 108) to the bottom of the well bore 110; and Cooling the motorized drill head 24 through a separate close loop cooling line (tubes 114 and 116) exchanging heat on the ground surface in a binary power unit 180 and in process producing electricity. Described herein are only differences.

The motorized drill head 24 is part of excavation system and consist of the same major parts explained earlier in motorized drill head 20, however, the continuous spiral blade 142 (FIG. 3) of the electric motor 40 is replaced with a continuous screw 143 which extend through whole length of the excavation pipe 71 to excavate mud and cuttings from the bottom of the well bore 110 up to the ground surface.

On the ground surface there is one pipe 105 with two adjustable joints 109 and 111 enabling additional section of the excavation pipe 71 to be added (illustrated in FIG. 26). The pipe 105 with adjustable joints 111 is connected to the mud releaser 117 which is connected to the top section of the excavation line 71. The continues screw 143 which is formed of plurality of connected sections is inserted into main excavation pipe through all length of the excavation line 71 and is rotated (powered) through turning mechanism 138 which is part of the power system which includes engines, extended platforms 133, turn table and transmission system which is similar to conventional systems used for turning drill pipe. The continues screw 143 excavates mud and cuttings up to the ground surface through excavation line 71 and out of the well bore where mud and cuttings are passing through shale shaker 125 where rock cuttings are separated from mud and then through shale slide 126 convey to the reserve pit. Then, a filtered and cooled fluid from mud pit 104 is pumped back through pumps 102 into fluid delivery line 106 and 108 and reused.

Figure 27:
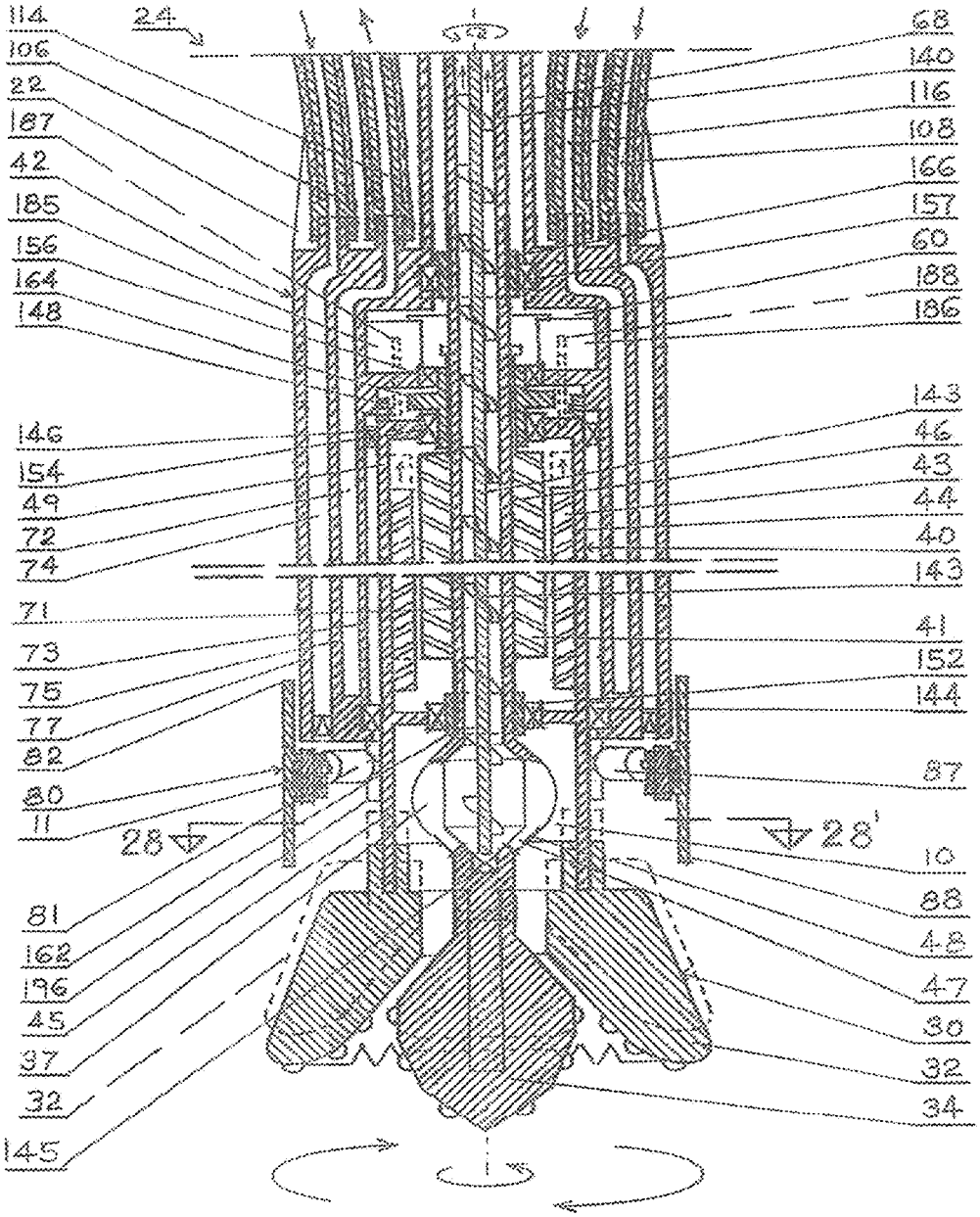
FIG. 27 illustrates an enlarged cross sectional view taken along line 27-27' of FIG. 28 of an in-ground motorized drill head in accordance with one embodiment.
Figure 28:
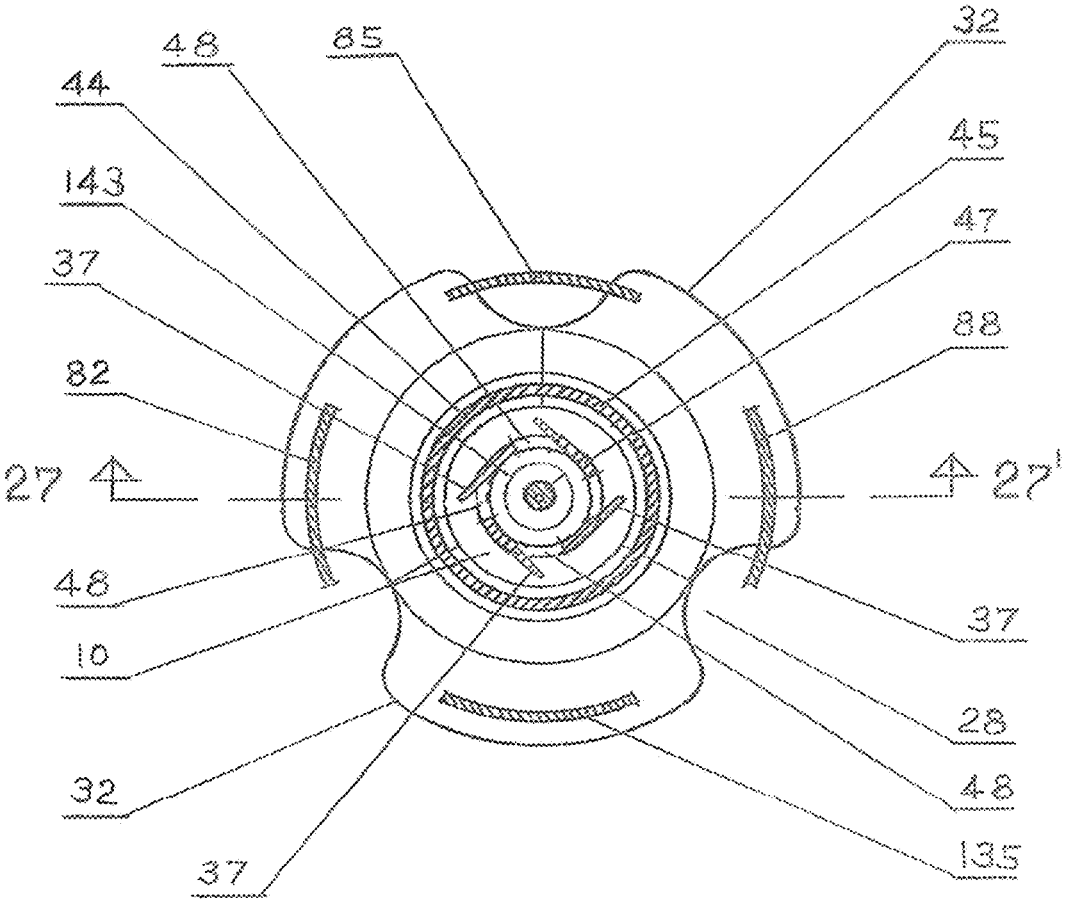
FIG. 28 is a cross sectional view taken along line 28-28' of FIG. 27 of an in-ground motorized drill head in accordance with one embodiment.

FIG. 27 is an enlarged cross sectional view of an in-ground motorized drill head 24 taken along line 27-27' of FIG. 28. The motorized drill head 24 is similar to the motorized drill head 20 shown in FIGS. 3-10, however, the continuous spiral blade 142 (FIG. 3) of the electric motor 40 is replaced with continuous screw 143 to excavate mud and cuttings from the bottom of the well bore 110 up to the ground surface.

As with the drill head 20 shown in FIG. 3, the in-ground motorized drill head 24 includes a collecting chamber 10 and a drill bit 30 to shred rock into small bits (cuttings). The hollow shaft 140 at this section of the collecting chamber 10 has an enlarged diameter and elongated openings 48 for mud and cuttings to pass to the excavation line.

The elongated openings 48 on one side have extended blades 37 tilted at an angle to scrape mud and cuttings from the collecting chamber 10 and direct them into the hollow shaft 140 through the openings 48 (also illustrated in FIG. 27) as well as providing additional sucking and pushing force.

The shaft 140 at the bottom is solid and provides recess for bearing 145 which is engaged with continues screw 143. Here is also illustrated opposite directions of rotation of the continuous screw 143 and the hollow shaft (pipe) 140 which is central part of the inner rotor 46 of the electric motor 40.

Mud and cuttings from the collecting chamber 10 pass through openings 48 into the hollow shaft 140 and are transported through the main excavation line 71 by the continuous screw 143 to the surface, separated, analyzed, and pumped back through the peripheral chamber of the motor block to provide cooling to the motor block before the fluid is released into the well bore where the fluid forms a fluid column of several yards high around motor block, cools drill bit, and provides fluid for drilling.

FIG. 28 is a cross sectional view of the in-ground motorized drill head 24 taken along line 28-28' of FIG. 27. Shown is drill bit 32 with recesses 28 that form a three-toothed peripheral drill bit 32. Also shown are the collecting chamber 10 formed between extended wall 45 of the cylinder 49 and the enlarged diameter 47 of the hollow shaft 140 having enlarged openings 48 having on one side blades 37 extending towards peripheral wall 45 of the collection chamber 10 for scraping and directing mud and cuttings from collection chamber 10 into hollow shaft 140 where continues screw 143 transport it up to the ground surface. Also shown are the peripheral plates 82, 85, 88, 135 of the deviation control mechanism explained and illustrated in FIG. 4.

Figure 29:
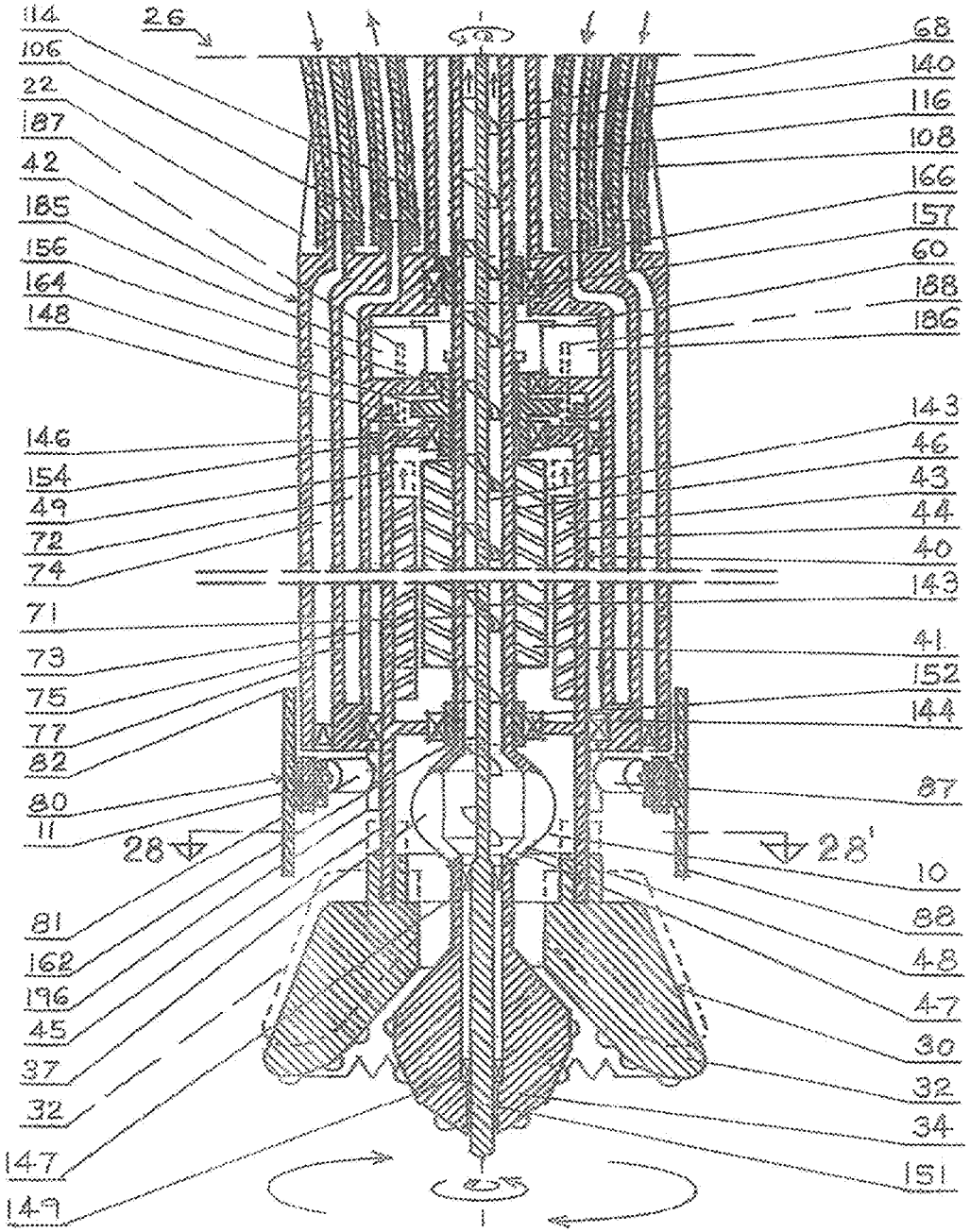
FIG. 29 illustrates an enlarged cross sectional view of an in-ground motorized drill head in accordance with one embodiment.

FIG. 29 is an enlarged cross sectional view of an alternative drilling apparatus and method for drilling a well bore in accordance with another embodiment. Shown is a motorized drill head 26, identical to the motorized drill head 24 shown in FIG. 27, except the continuous screw 143 extends through and is engaged with the central drill bit 34 through a set of bearings 147, 149 and function as additional drill bit 151 with is own pace powered from the ground surface. Here are also shown directions of rotations of the continuous screw 143 and drill head 151 in respect to central and peripheral drill bits 34 and 32 which are opposite to each other.

Figure 30:
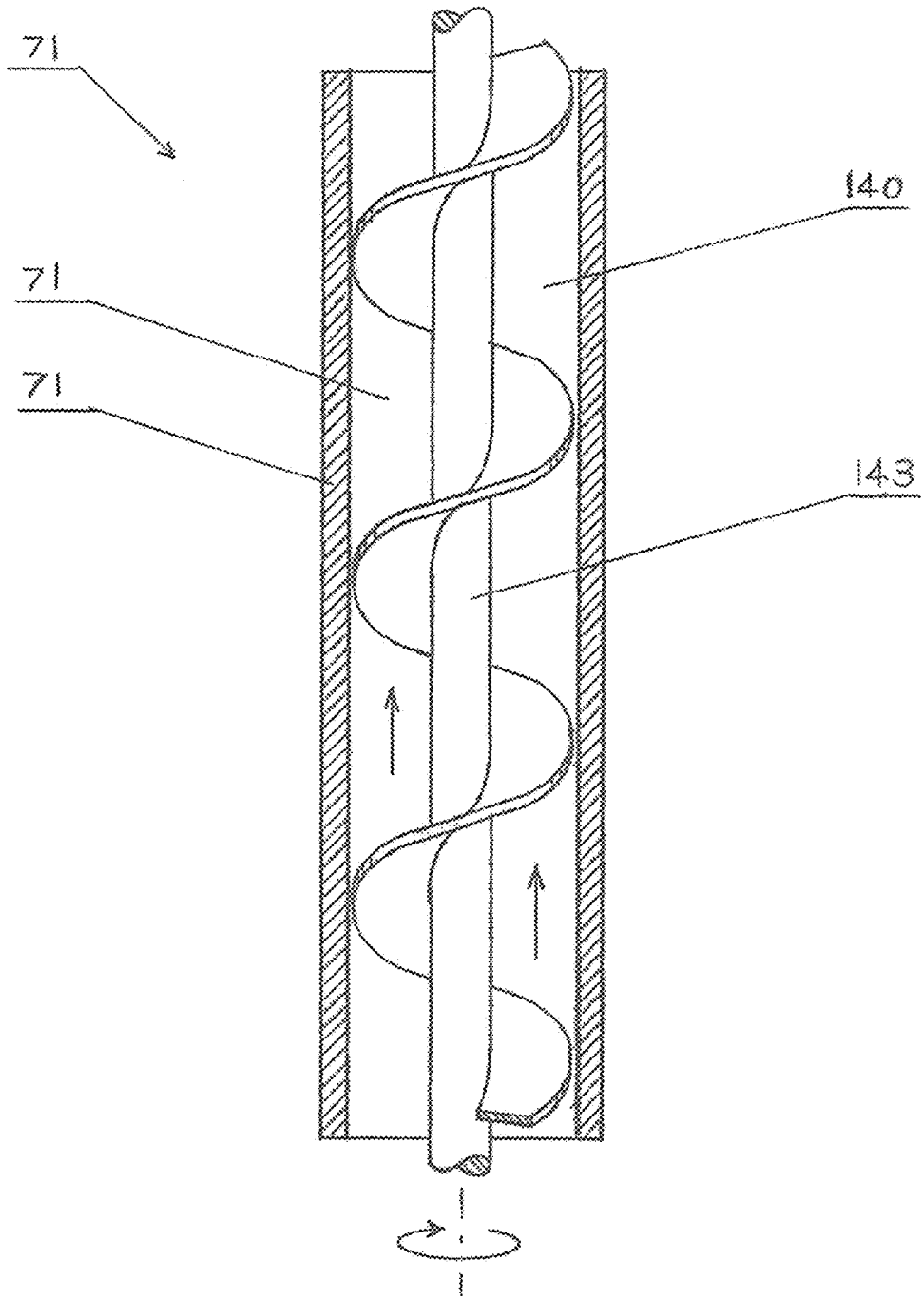
FIG. 30 is a cross sectional view of the main excavation line shown in FIG. 26.

FIG. 30 is a cross sectional view of the main excavation line 71 shown in FIG. 26. The excavation line 71 is formed of a plurality of connected sections of the main pipe and a plurality of connected sections of the continuous screw 143. The main pipe 71 does not rotate with the exception of the hollow shaft 140 at the motorized drill head. Also shown is the direction of rotation of the continuous screw 143.

Figure 31:
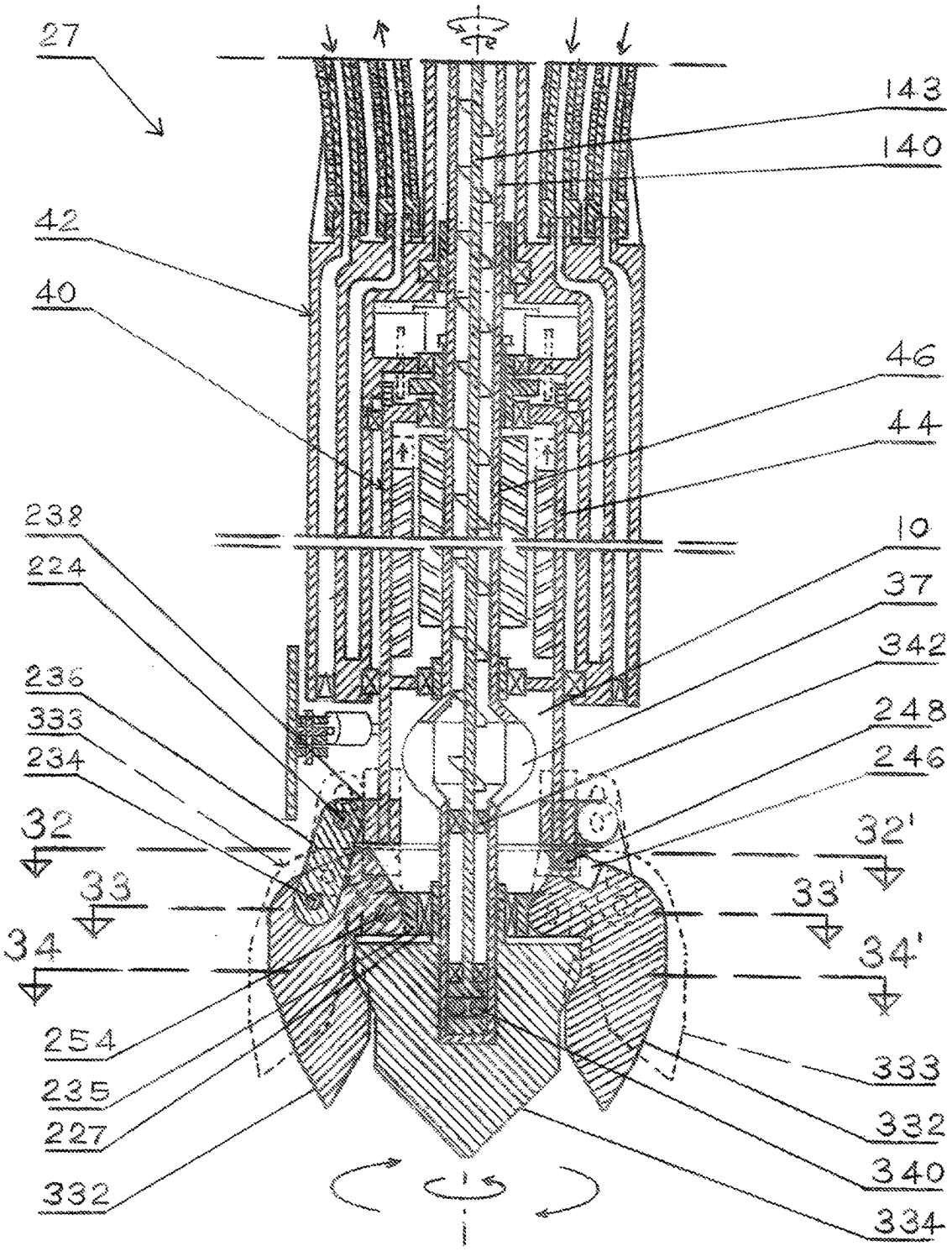
FIG. 31 illustrates an enlarged cross sectional view taken along line 31-31' of FIG. 32 of an in-ground motorized drill head in accordance with one embodiment.

Referring now to FIGS. 31, 32, 33 and 34; FIG. 31 illustrates an enlarged cross sectional view of an in-ground motorized drill head 27 taken along line 31-31' of FIG. 32.

The motorized drill head 27 is similar to the motorized drill head 24 shown in FIGS. 26-27, and the motorized drill head 26 shown in FIG. 29 however, the drill bit 30 is replaced with drill bit 330 which has retractable bits and can increase and decrease its diameter to pull out of wellbore after casing process is finished. As with in-ground motorized drill head 24 and 26 shown in FIGS. 27 and 29, the in-ground motorized drill head 27 includes a collecting chamber 10 and a drill bit 330 to shred rock into small bits (cuttings). The hollow shaft 140 at this section of the collecting chamber 10 has an enlarged diameter and elongated openings 48 for mud and cuttings to pass to the excavation line.

The elongated openings 48 on one side have extended blades 37 tilted at an angle to scrape mud and cuttings from the collecting chamber 10 and direct them into the hollow shaft 140 through the openings 48 (also illustrated in FIG. 27) as well as providing additional sucking and pushing force. There is also continuous screw 143 to excavate mud and cuttings from the bottom of the well bore 110 up to the ground surface. Here is also illustrated motor housing 42 which is engaged with hydraulic control system 50 which can rise and lower motor housing 42 (illustrated in FIG. 9). The drill bit 330 consists of peripheral drill bit 332 and central drill bit 334. The peripheral drill bit 332 consists of three equal parts pivotally engaged with central drill bit 334 and motor housing 42. The central drill bit 334 is engaged with ring 225 through bearing 227. The ring 225 has three sets of eye brackets 228 which are pivotally engaged with each of peripheral drill bits 332 through protruded plate 232 and corresponding pin 254. The peripheral drill bits 332 are also pivotally engaged with lower section of motor housing 42 through arms 236. The arms 236 on upper end are engaged with motor housing 42 through eye brackets 238 and corresponding pin 224 and on the lower end with peripheral drill bit 332 through corresponding pin 234. When motor housing 42 is pulled up with hydraulic control system 50 the peripheral drill bits 332 extends outward and increase its diameter. The hollow shaft 140 is engaged with central drill bit 334. The continuous screw 143 which is powered from the ground surface and spins at different speed sits on bearing 340 and is secured with bearing 342. The space between bearings 340 and 342 is sealed and filled with lubricant. When motor housing 42 is lowered with hydraulic control system 50 the peripheral drill bits 332 collapses inward and decreases its diameter.

Contemporary drilling technology is based on drilling subsequent sections with slightly smaller diameter because each preceding section will have casing added. In order to produce well bore with constant diameter ability to increase and decrease diameter of the drill bit is of great importance.

Here in FIG. 31 the cross sectional view (right side) is slightly of the center in order to illustrates recesses 246 on the peripheral drill bits 332 which engage with pins 248 of the motor housing 42 to secure peripheral drill bits 332 when in extended position. Dash lines 333 represent the peripheral drill bits 332 in extended position.

Figure 32:
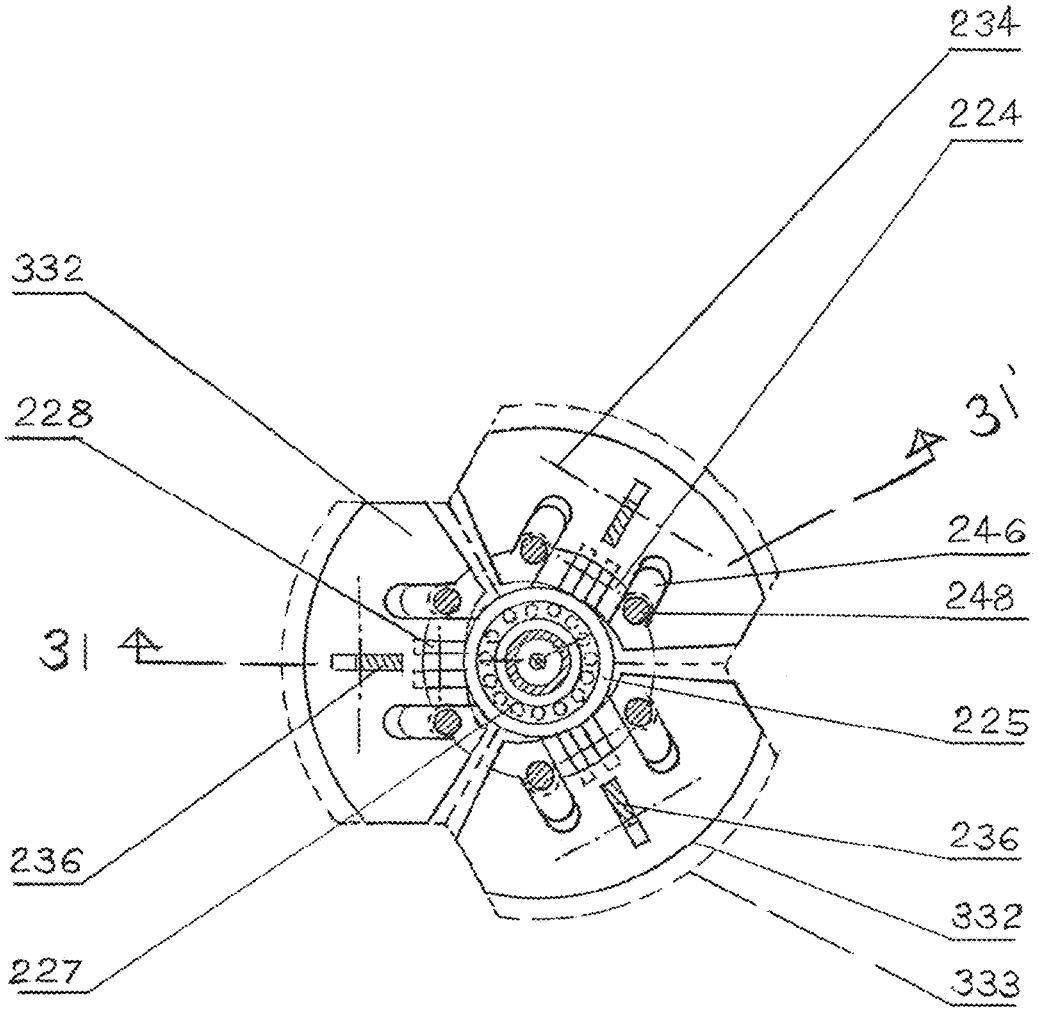
FIG. 32 is a cross sectional view taken along line 32-32' of FIG. 31 of an in-ground motorized drill head in accordance with one embodiment.

FIG. 32 is a cross sectional view taken along line 32-32' of FIG. 31. Here is illustrated drill bit 330 including three peripheral drill bits 332 bearing 227, ring 225 with eye brackets 228, arms 236, recesses 246 and pins 248 of the motor housing 42 with their function already explained in FIG. 31.

Figure 33:
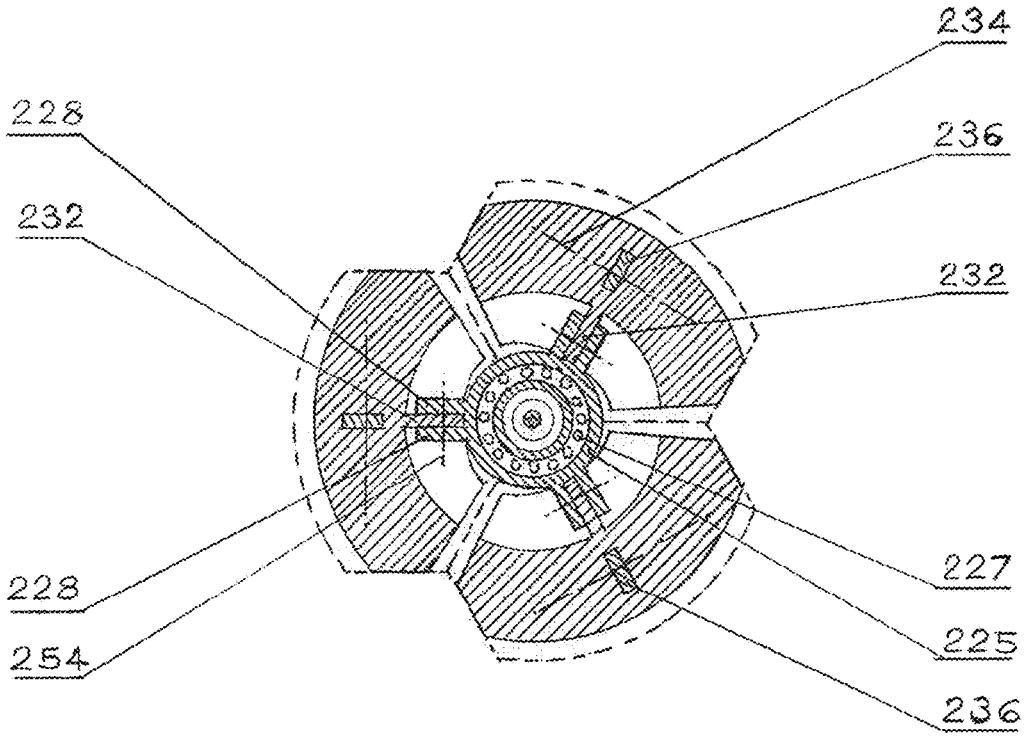
FIG. 33 is a cross sectional view taken along line 33-33' of FIG. 31 of an in-ground motorized drill head in accordance with one embodiment.

FIG. 33 is a cross sectional view taken along line 33-33' of FIG. 31. Here is illustrated drill bit 330 including three peripheral drill bits 332 bearing 227, ring 225 with eye brackets 228, arms 236 with their function already explained in FIG. 31.

Figure 34:
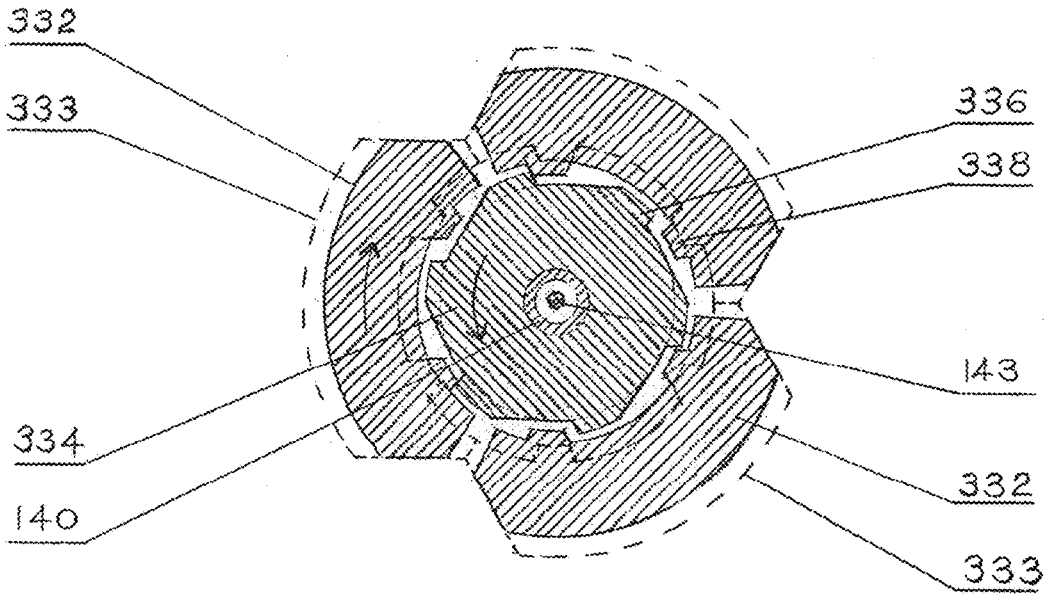
FIG. 34 is a cross sectional view taken along line 34-34' of FIG. 31 of an in-ground motorized drill head in accordance with one embodiment.

FIG. 34 is a cross sectional view taken along line 34-34' of FIG. 31. Here is illustrated drill bit 330 including three peripheral drill bits 332 and central drill bit 334. Here are also illustrated teeth 336 on the central drill bit 334 and teeth 338 on the peripheral drill bits 332. The peripheral drill bits 332 has to be in extended position (dash line) to grind rocks to the size of distance between teeth of peripheral drill bit 332 and central drill bit 334.

Figure 35:
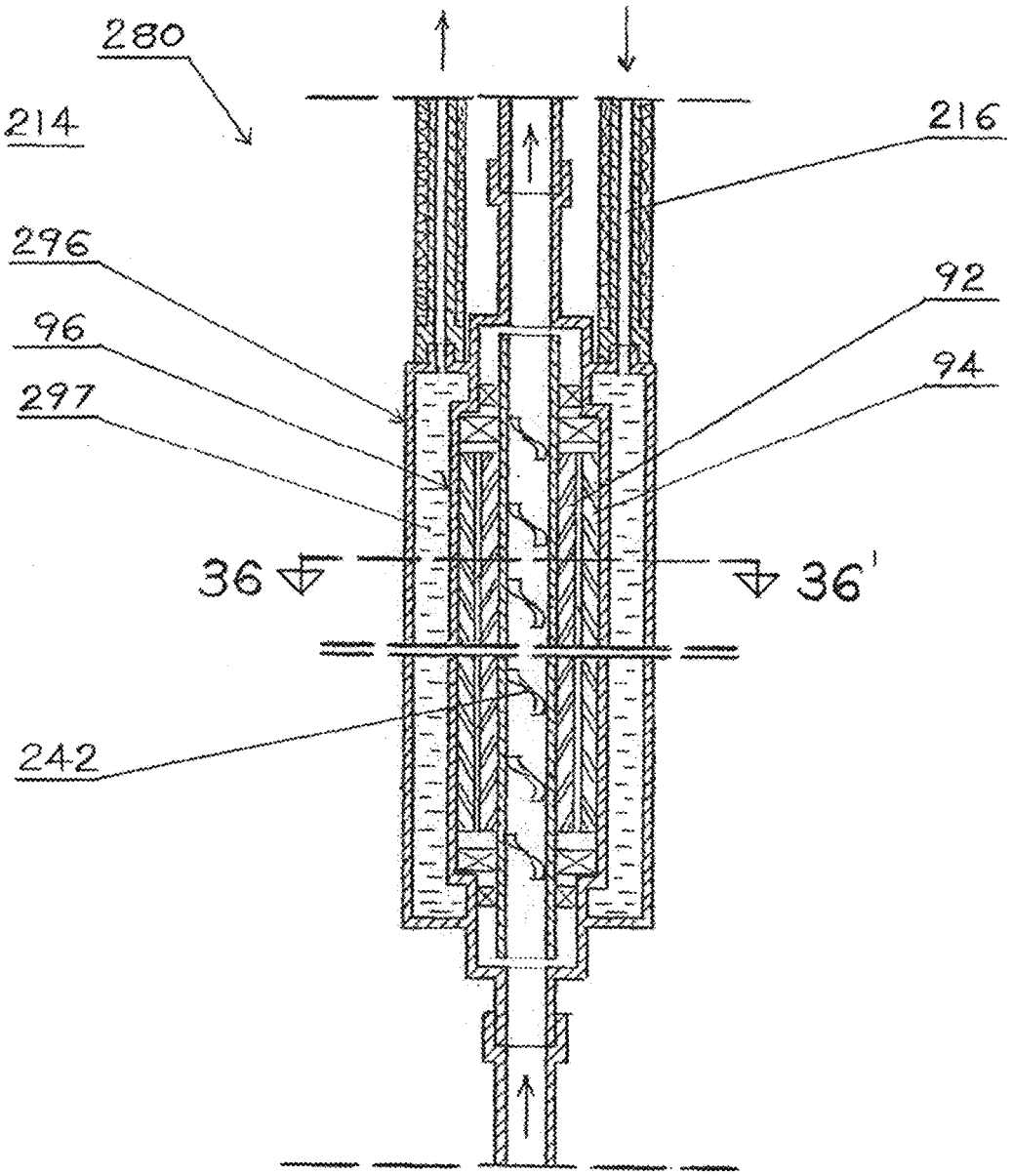
FIG. 35 is a cross sectional view taken along line 35-35' of FIG. 36 of an in-line pump in accordance with one embodiment.
Figure 36:
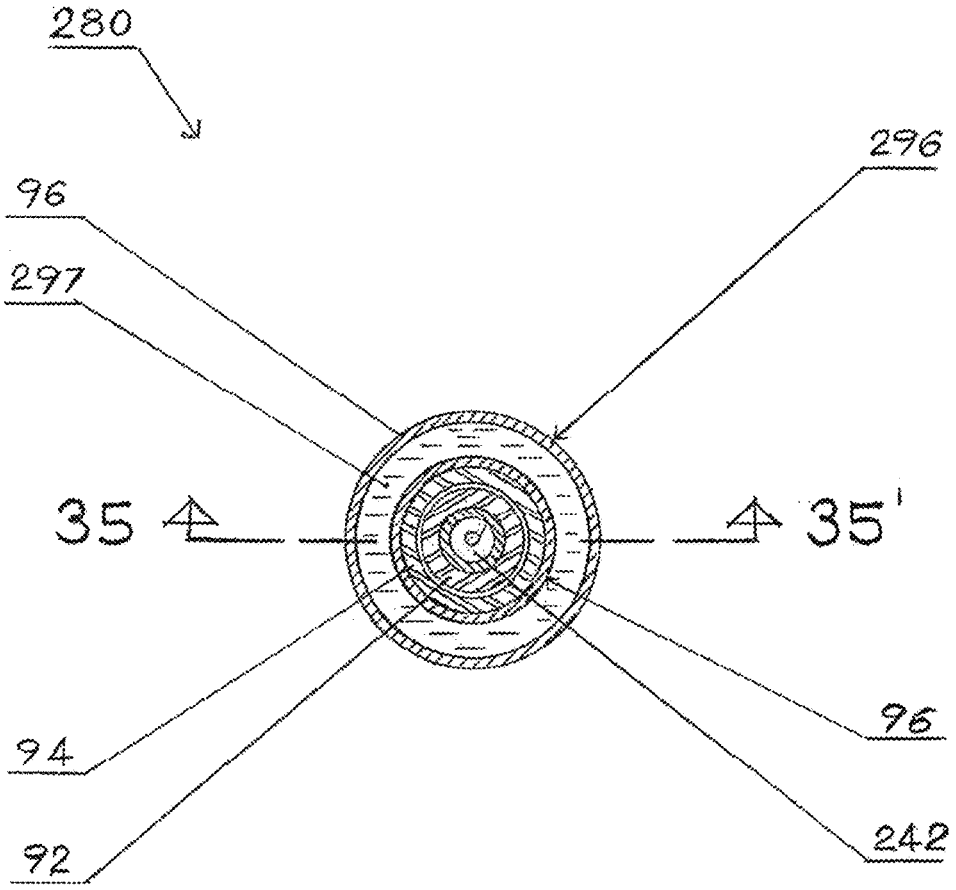
FIG. 36 is a cross sectional view taken along line 36-36' of FIG. 35 of the in-line pump assembly shown in FIG. 35.

FIG. 35 is a cross sectional view of an in-line pump 280 taken along line 35-35' of FIG. 36. The in-line pump 280 is similar to the in-line excavation pump 90 illustrated and explained in FIGS. 11 and 24 however, assembly 280 has a cooling system similar to cooling system used in cooling motorized drill head 20, 21, 24 and 26 illustrated and explained in FIGS. 3, 14, 27 and 29. The cooling system can prevent from overheating and also enable in-line pump to function in hot environment such is in well bore for geothermal applications. The in-line pump 280 can be used in many different applications including as excavation pump and/or inline pump for circulating fluid substance. The in-line pump 280 has an additional cylinder 296 which forms additional compartment 297 between motor cylinder 96 and cylinder 296. The compartment 297 is filled with fluid which circulates in closed loop system absorbing heat generated from motor and hot rocks and transporting it up to the ground surface through thermally insulated pipe system. The hot fluid line 114 on the way up can be connected with other hot fluid lines or can be individually coupled to the heat exchanger in the binary power unit where heat can be used for production of electricity.

If in-line pump 280 is used in vertical position two brackets 99 (illustrated in FIGS. 11 and 12) with recesses 118 can be provided and used for securing different lines including electric, sensors, cameras, lubrication system line, etc. In-line pump 280 can be used for moving material (a substance) of different viscosity upward including mud, oil, water, etc. Alternatively, if used in deepwater oil extraction (production) as a segment of a raiser pipe the compartment 297 be filled with oil or air to provide buoyancy to the in-line pump 280.

FIG. 36 is a cross sectional view of the in-line pump 280 taken along line 36-36' of FIG. 35. Here is illustrated hollow shaft of 240 with continues spiral blade 242, rotor 92, stator 94 cylinder of the motor 96 and peripheral cylinder 296, the housing of the in-line pump 280 and compartment 297 filled with cooling fluid which function is explained in FIG. 35.

Figure 37:
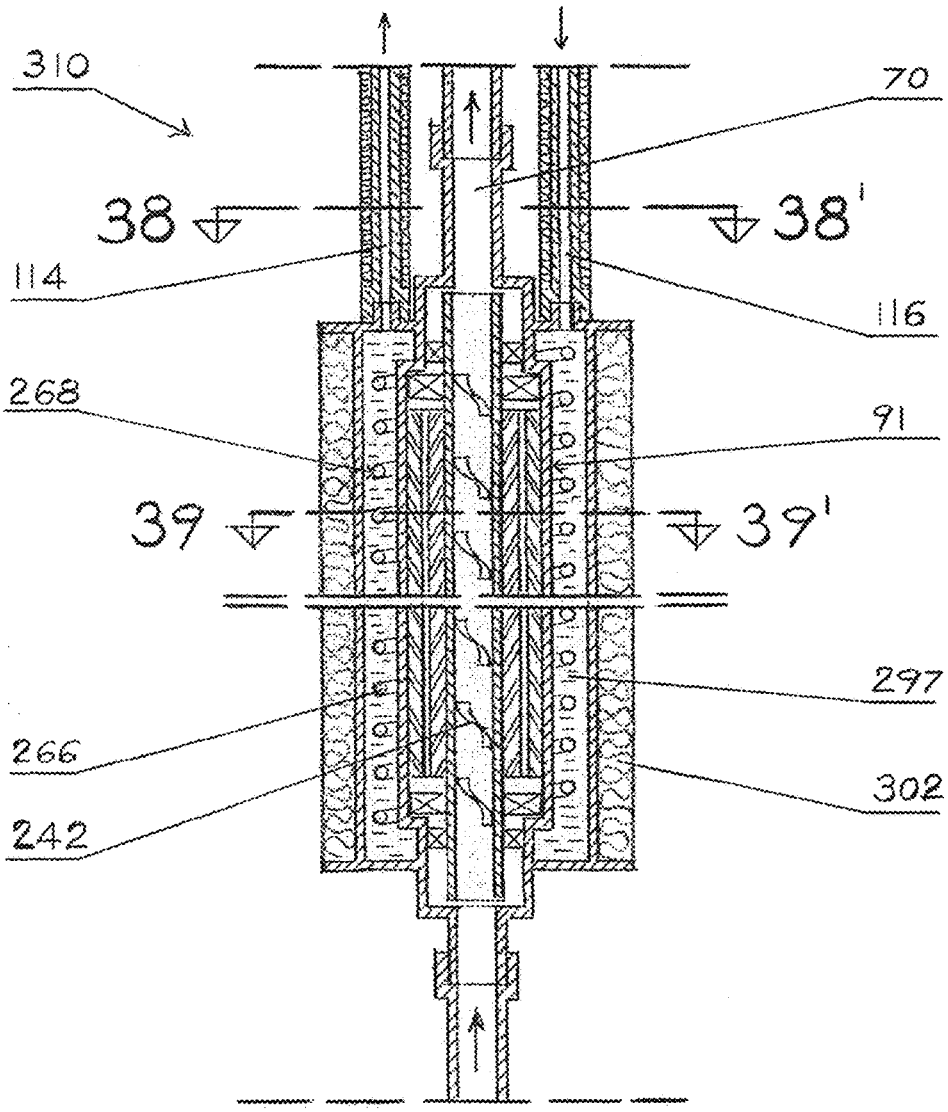
FIG. 37 is a cross sectional view taken along line 37-37' of FIG. 39 of an in-line pump in accordance with one embodiment.
Figure 38:
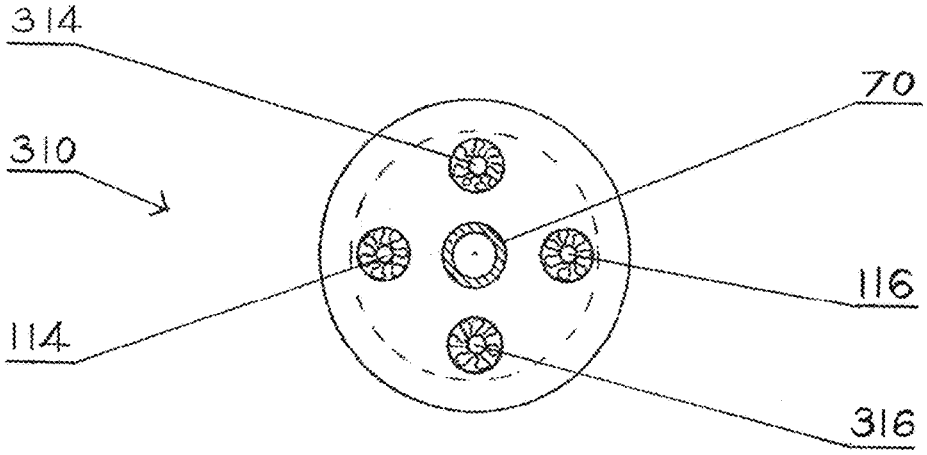
FIG. 38 is a cross sectional view taken along line 38-38' of FIG. 37 of an in-line pump in accordance with one embodiment.
Figure 39:
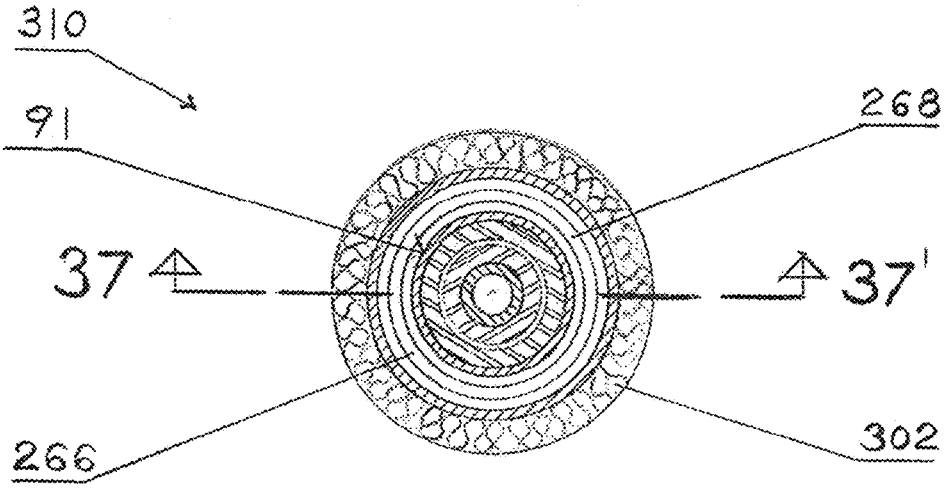
FIG. 39 is a cross sectional view taken along line 39-39' of FIG. 37 of an in-line pump in accordance with one embodiment.

FIG. 37 is a cross sectional view of an alternative in-line pump 310 taken along line 37-37' of FIG. 39. The in-line pump 310 is similar to the in-line pump 280 illustrated and explained in FIGS. 35 and 36 however, assembly 310 has an additional closed loop cooling system consisting of additional heat exchange 268 formed of coiled tube 266 placed inside compartment 297. The heat exchanger 268 is connected with additional heat exchanger on the ground surface (not shown in this illustration) through thermally insulated closed loop line consisting of hot line 314 and cool line 316 (illustrated in FIG. 38). Advantages of the assembly 310 is to provide more effective cooling of the electro motor and at same time providing adjustable buoyancy of the in-line pump if submerged in water. Here is also illustrated thermal insulator 302 to protect in-line pump 310 from external heat.

FIG. 38 is a cross sectional view of the in-line pump 310 taken along line 38-38' of FIG. 37. Here are illustrated main line 70 and two sets of thermally insolated pipes of two separate heat exchange systems explained in FIG. 37. One set is hot line 114 and cool line 116 (also illustrated in FIG. 37) which circulate fluid through compartment 297. The second set is hot line 314 and cool line 316 (not shown in FIG. 37) which are part of heat exchanger 268 and coiled pipe 266. Additional heat is absorbed and transported through hot line 314 to the heat exchanger on the ground surface (not shown in this illustration) and cooled fluid returned through cool line 316 returned to heat exchanger 268.

FIG. 39 is a cross sectional view of the in-line pump 310 taken along line 39-39' of FIG. 37. Here are shown elements illustrated and explained in FIGS. 37 and 38.

Figure 40:
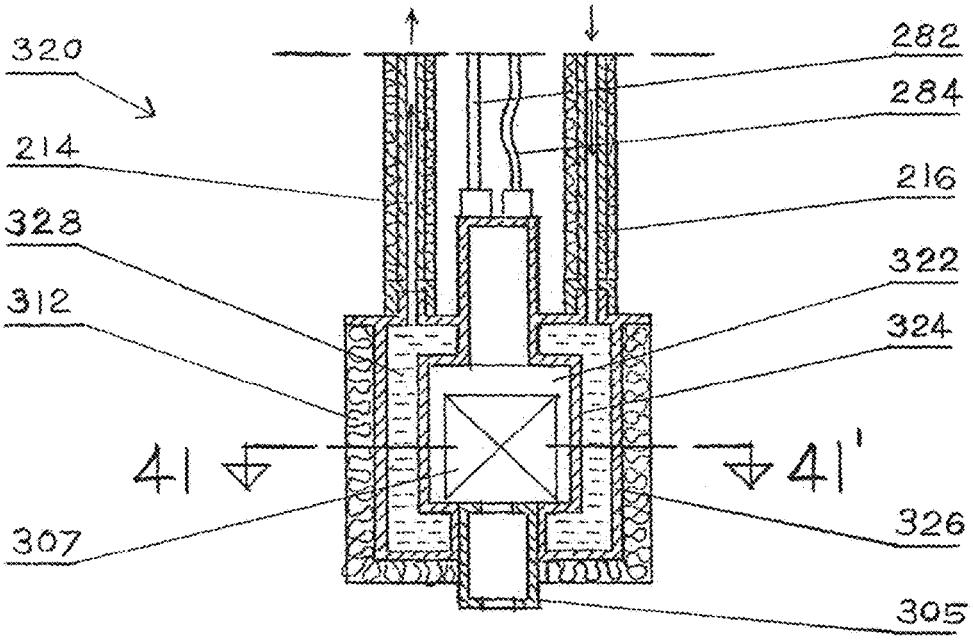
FIG. 40 is a cross sectional view taken along line 40-40' of FIG. 41 of an heat resistant container in accordance with one embodiment.

FIG. 40 is a cross sectional view taken along line 41-41' of FIG. 40 of a heat resistant container 320 used for housing different equipment such as sensors, cameras gauges, etc. which are necessary for exploration and maintenance of the presented invention. The container 320 consists of a cavity 322 formed inside inner cylinder 324; an outer cylinder 326; and compartment 328 formed between inner and outer cylinders. The compartment 328 is filed with fluid and is part of closed loop system which circulates fluid through compartment 328, absorbs heat and transports it through thermally insulated pipe 214 up to the ground surface where heat is exchanged in binary power unit (not shown in this illustration) and cooled fluid returned through pipe 216 into compartment 328. The container 320 has port 305 for inserting particular equipment 307 into cavity 322. Here is also illustrated thermal insulator layer 312, hoisting cable 282 and electric cable 284.

Figure 41:
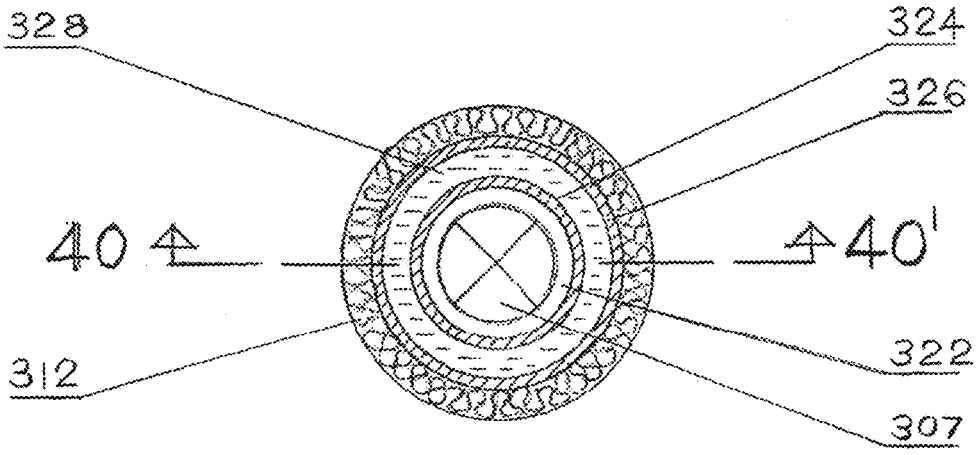
FIG. 41 is a cross sectional view taken along line 41-41' of FIG. 40 of an heat resistant container in accordance with one embodiment.
Figure 42:
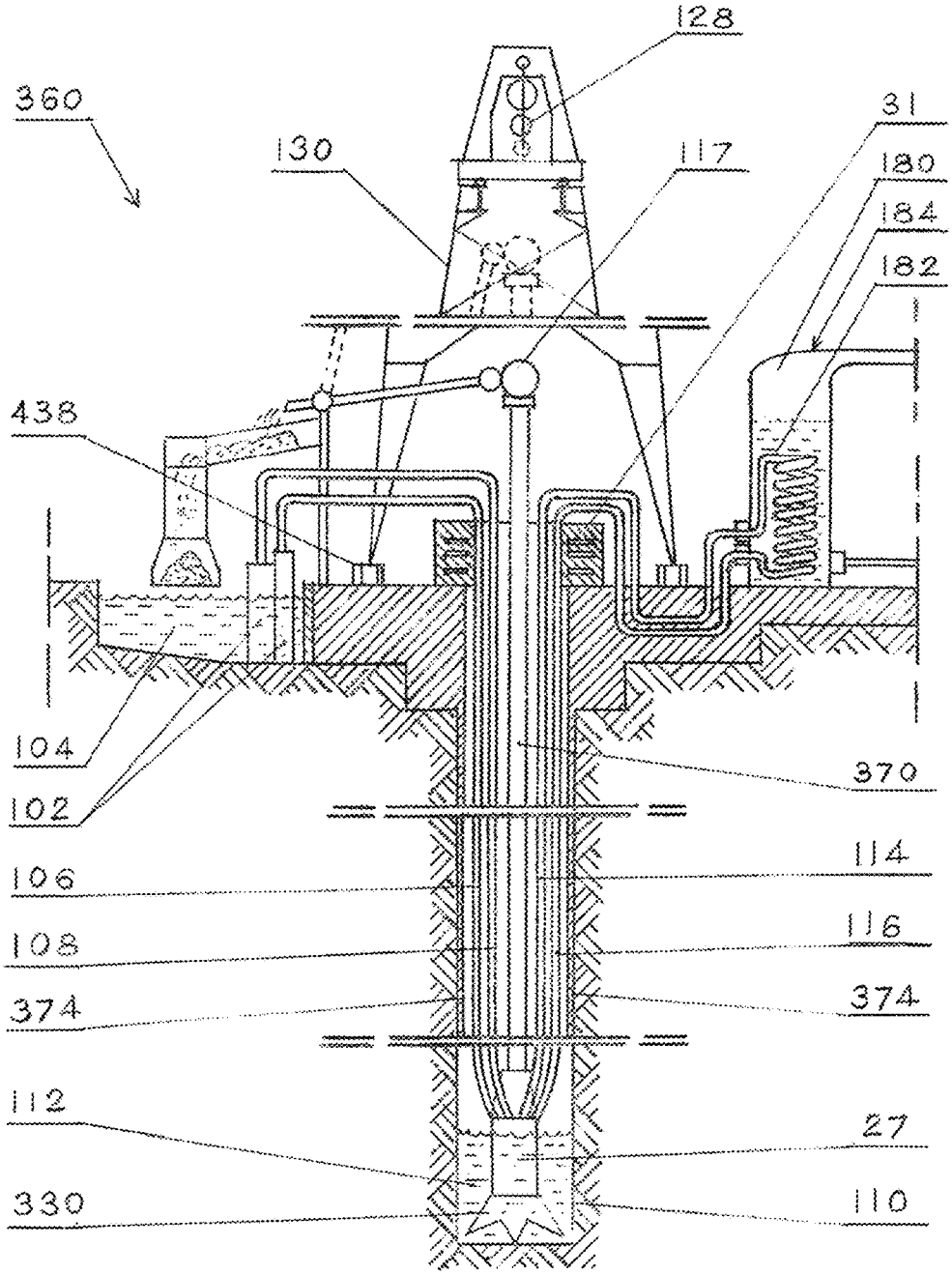
FIG. 42 is a schematic diagram and cross sectional view of an apparatus and method for drilling a well bore in accordance with one embodiment of the invention.

FIG. 41 is a cross sectional view taken along line 40-40' of FIG. 41 of an heat resistant container 320 explained in FIG. 40 [in accordance with one embodiment];

FIG. 42 is a schematic diagram and cross sectional view of an apparatus and method for drilling a well bore in accordance with one embodiment of the invention. In this assembly 360 is illustrated motorized drill head 27 similar to drill head described in FIG. 31 with retractable bits 332 and 334 for cutting and shredding ground material having openings at lower section of the central hollow shaft with extended blades 37 on one side of openings for scrapping and slightly bended for directing muddy material from collecting chamber 10 into hollow shaft 140 to be moved into excavation pipe 70 consisting of a repetitive segments of In-Line-Pumps 90 for transport up to the ground surface (described in FIGS. 1, 11 and 14) combined with excavation line 370 which is explained in more details in FIGS. 43-47. Optionally, if needed, excavation line 370, specifically In-Line-Pump 90, can be equipped with a rod (shaft) inserted between and surrounded with continues spiral blade 242 to provide sheer effect. In this schematic illustration are also shown a separate fluid delivery line 106 and 108 which delivers filtered fluid from mud pit 104 to the bottom of the wellbore 110. Also, here is shown a separate close loop engine cooling line 114 and 116 and a boiler 180 of the binary power unit 184 which uses heat of the motorized drill head 27 to produces electric power which can be used to supplement power needed for powering the motorized drill head 27.

Figure 43:
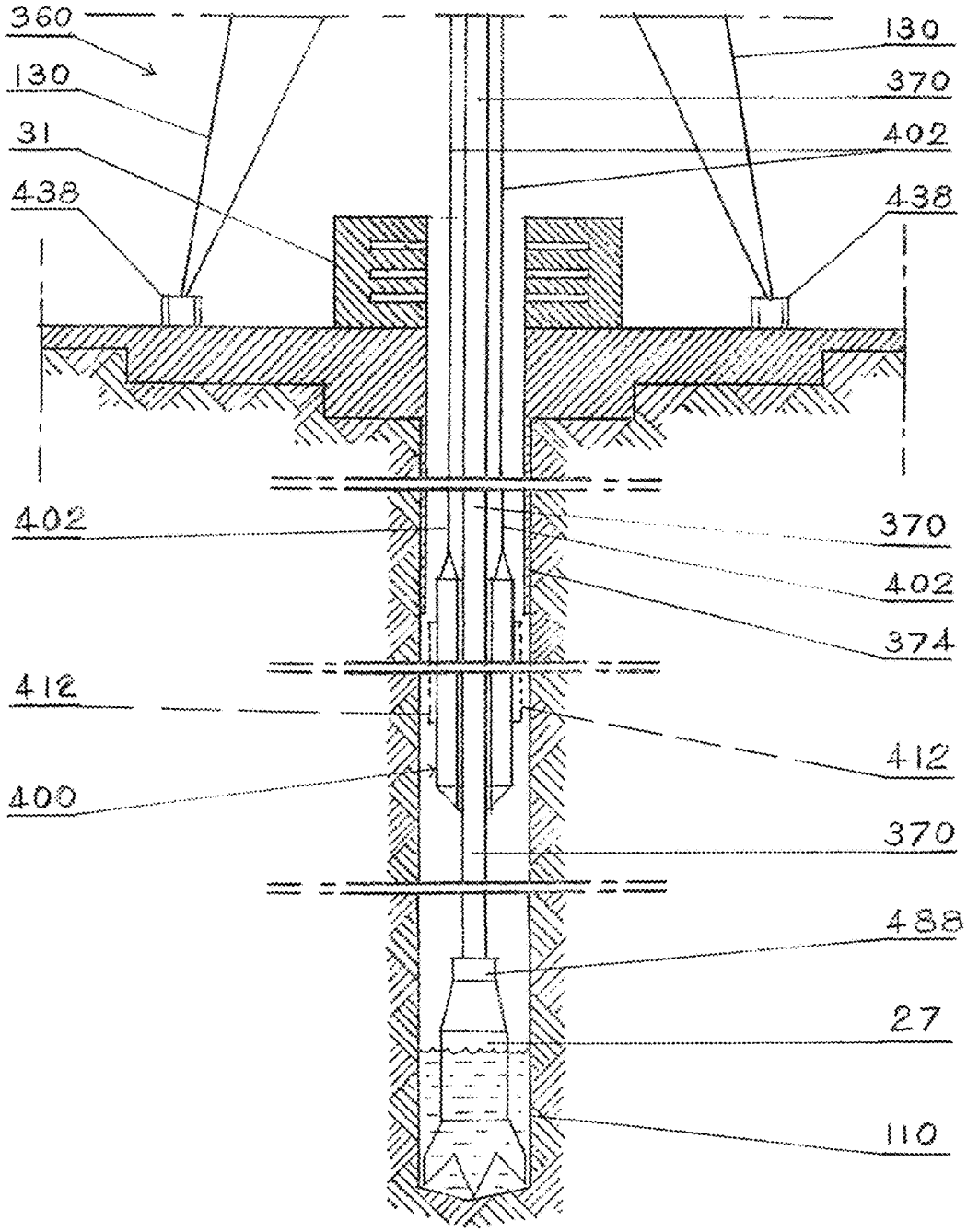
FIG. 43 is a schematic diagram and cross sectional view of one embodiment which includes a circular cage (elevator) used for building casing of the wellbore and for disassembly of the drilling apparatus after drilling process is completed.

FIG. 43 is a schematic diagram and cross sectional view of embodiment 360 which include a circular cage (elevator) 400 used for building casing of the wellbore explained in FIG. 42 and also used for disassembly of the drilling apparatus after drilling process is completed. Here is shown excavation line 370 as a compact assembly which incorporates In-line-Pump 90, fluid delivery line 106 and 108 and close loop engine cooling line 114 and 116. Here is also shown an additional element of this invention a motorized circular cage (elevator) 400 with an expendable section 412 for delivering and installing metal sheets and concrete for casing of the wellbore during drilling process. Also, shown here is a Blow Out Preventer 31. Also, show is a hoisting line composed of wound steel cable 402 spooled over a revolving reel. More details about this system will be explained in following illustrations. Here is also shown box with electronics and sensors 488 attached to motorized drill head 27. Here is also shown derrick 130 with dollies 438 for drilling and servicing multiple wellbores of a power plant to accommodate designs of multi power plants with multi well bores presented in patent application with Title: SELF-CONTAINED IN-GROUND GEOTHERMAL GENERATOR AND HEAT EXCHANGER WITH IN-LINE PUMP AND SEVERAL ALTERNATIVE APPLICATIONS; U.S. Ser. No. 14/581,670; Filing date: Dec. 23, 2014.

Figure 44:
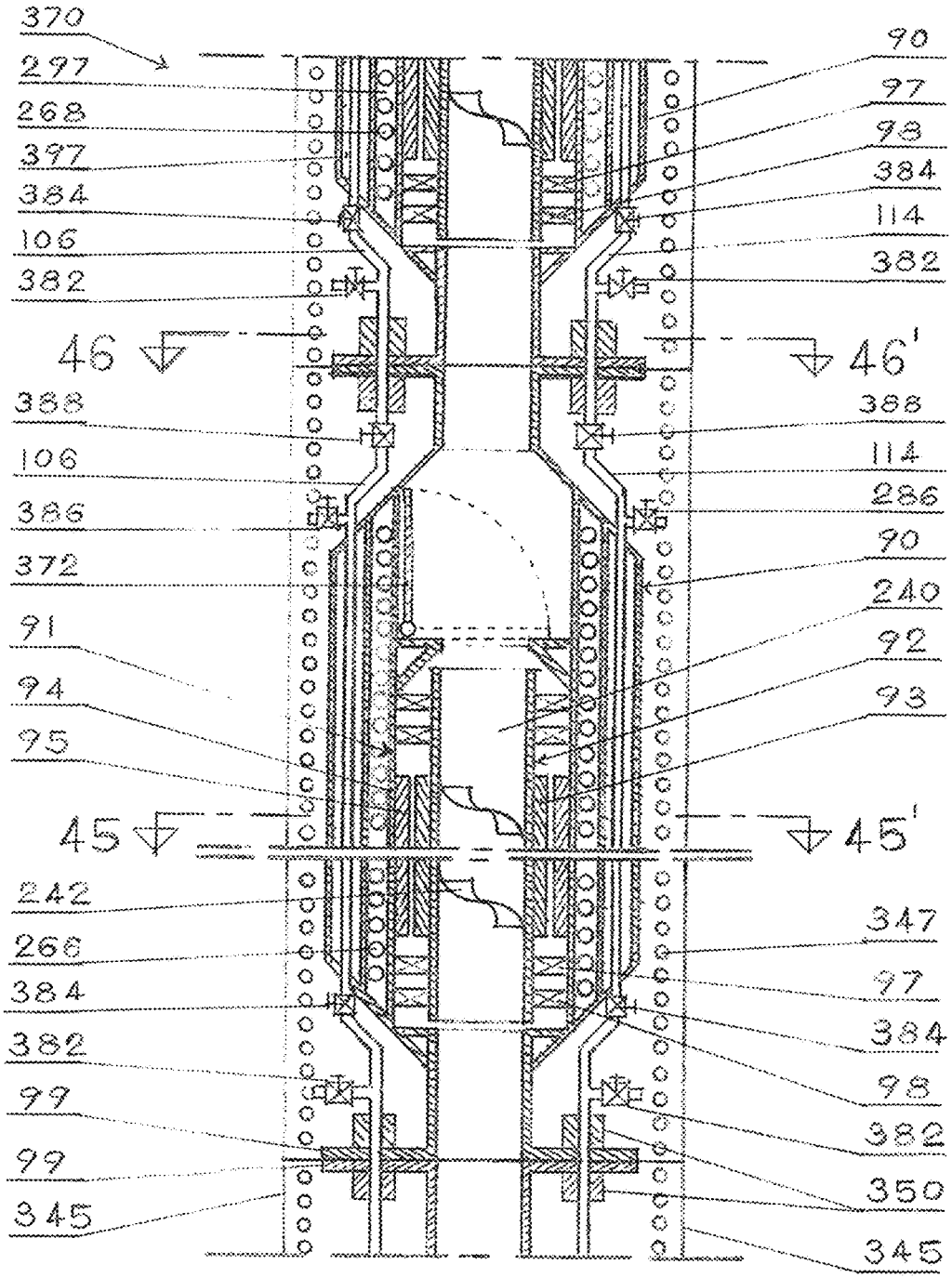
FIG. 44 is a cross sectional view of a repetitive segment of the excavation line taken along line 44-44" of FIG. 45
Figure 45:
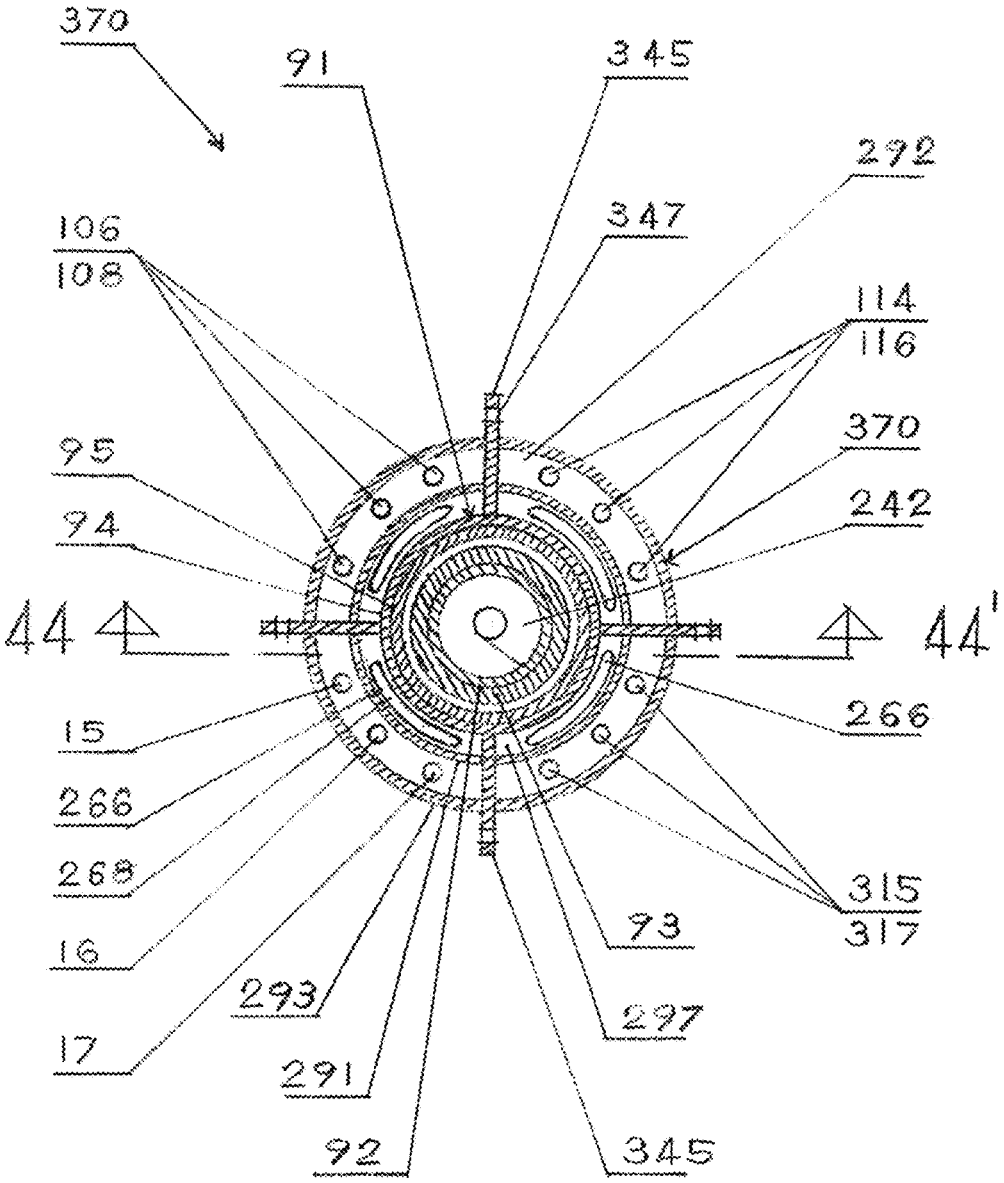
FIG. 45 is a cross sectional view of a segment of the excavation line 370 taken along line 45-45" of FIG. 44.

FIG. 44 is a cross sectional view of a repetitive segment of the excavation line 370 taken along line 44-44" of FIG. 45. Here is shown excavation line 370 as a compact assembly which incorporates In-line-Pump 90, fluid delivery line 106 and 108 and close loop engine cooling line 114 and 116. The main In-Line Pump 90 is a repetitive segment of the vertical excavation line 370. Optionally, the In-Line Pump 90 can be installed periodically. As is explained in FIGS. 11 and 24, it consists of electromotor 91 consisting of a stator 94 with electromagnetic coil 95 and rotor 92 with electromagnetic coil 93, having continues spiral blade 242 within a central hollow shaft 240 of the rotor 92 creating a force to move mud and cuttings upward to the next in-line excavation pump from the bottom of the wellbore to the ground surface. Optionally, if needed, In-Line-Pump 90, can be equipped with a rod (shaft) inserted between and surrounded with continues spiral blade 242 to provide sheer effect. Here are also shown ball bearings 97 between stator and rotor providing spinning of the rotor and seal bearings 98 for preventing fluids and mud entering armature of the motor. Also, here is shown compartment 297 containing heat exchanger 268 formed of coiled tube 266 placed inside compartment 297 (also shown in FIG. 37). The heat exchanger 268 is connected with additional heat exchanger 182 in binary power unit 184 on the ground surface (shown in FIG. 42) through thermally insulated closed loop line consisting of hot line 114 and cool line 116. One of the advantages of the assembly 370 is to provide more effective cooling of the electro motor. Also, here is shown additional compartment 397 containing array of cooling, electric and maintenance lines. In this illustration, for clarity reason, are shown only two typical fluid lines 106 and 114 with control valves 382, 384, 386 and 388 for controlling fluid flow during installation of an additional segment of the excavation line 370. Here is also shown flange 99 with special nuts and bolts 350 (explained in FIG. 60) for connecting two joining segments of the excavation line 370. Here is also shown a flap 372 (closing position is in dash line) to close excavation line when inline pump is turn off and when back flow is occurring to prevent all cuttings and mud from excavation line to slide back and overload bottom pump. If optional rod (shaft) mentioned earlier is used inside In-Line-Pump 91 for providing sheer effect, than flap 372 can be modified to have two corresponding halves with recess to accept rod. The housing 94 of the In-Line-Pump 91 has 4 sides extending ribs 345 for guiding circular cage 400 up and down for delivering metal sheets and concrete for building casing of the wellbore during drilling process. The four ribs 345 have teeth on their edges (not illustrated) to engage with corresponding teeth of four gears 472 slightly extending from the gear box 470.

FIG. 45 is a cross sectional view of a segment of the excavation line 370 taken along line 45-45" of FIG. 44. In this illustration is shown electromotor 91 consisting of a stator 94 with electromagnetic coil 95 and rotor 92 with electromagnetic coil 93, having continues spiral blade 242 within a central hollow shaft 240 of the rotor 92 creating a force to move mud and cuttings upward to the next in-line excavation pump. Also, here is shown heat exchanger 268 with its coiled tube 266. Also, here is shown fluid delivery line 106 and 108 and close loop engine cooling line 114 and 116 surrounded with thermo insulated material and encapsulated between two walls, medium 291 and peripheral 293, forming compartment 292 of the excavation assembly pipeline 370. In this illustration, in compartment 292, are also shown close loop In-line-Pump cooling line 315 and 317. Also, here is shown electric cable line 15. Also, here are shown additional lines 16 and 17 to be used for powering mechanical devices, sensors, service, etc. and, if needed, for any new purpose. Also, here are shown four extended ribs 345 for guiding circular cage 400 (circular cage is illustrated and explained in FIGS. 48-55). Here are also shown openings 347 on the ribs 345 used for brakes engagement of the circular cage and for pulling drilling apparatus out of wellbore after wellbore is completed. The brakes have pins to engage with corresponding openings 347 on the ribs 345. Pulling out drilling apparatus is done by filling wellbore with water and then sliding circular cage 400 over the excavation line 370 and submerge it into water until buoyancy is achieved and then applied brakes 480 of the circular cage 400 which engages openings 347 on the ribs 345. This process is repeated until all segments of the drilling apparatus are pulled out and disassembled. Buoyancy of the circular cage 400 is controlled by adding air into containers 440, 460 and partially into inflatable bladders 426. If needed, additional segments with containers 440 can be attached to the circular cage 400 to achieve more buoyancy.

Figure 46:
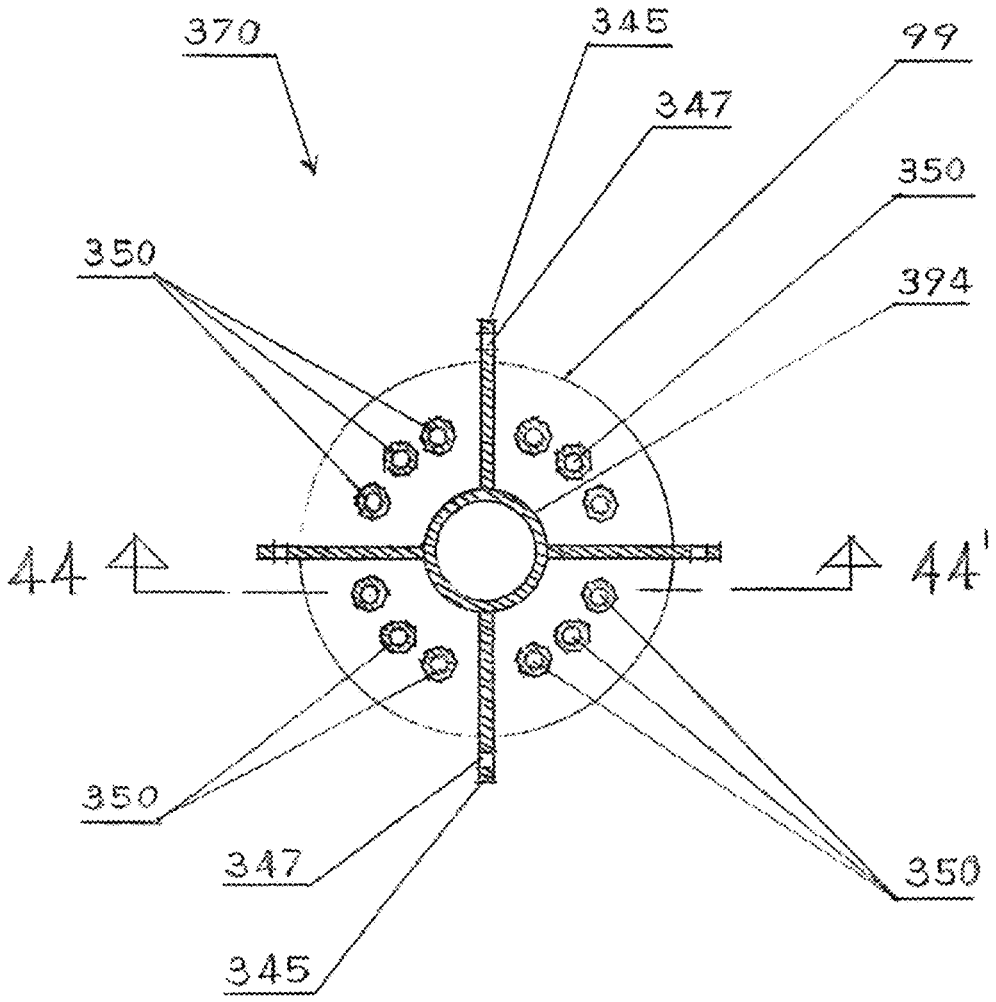
FIG. 46 is a cross sectional view of a segment of the excavation line taken along line 46-46' of FIG. 44.

FIG. 46 is a cross sectional view of a segment of the excavation line 370 taken along line 46-46' of FIG. 44. In this illustration is shown a connection of two joining segments of the excavation line 370. Here is shown a pipe 394, which is reduced extension of the stator 94. Here is also shown flange 99 with special nuts and bolts 350 (explained in FIG. 60) for connecting two joining segments of the excavation line 370 to provide structurally connection between two segments and at the same time to provide fluid flow between them at limited space. Also, it can provide passage for electric cables.

Figure 47:
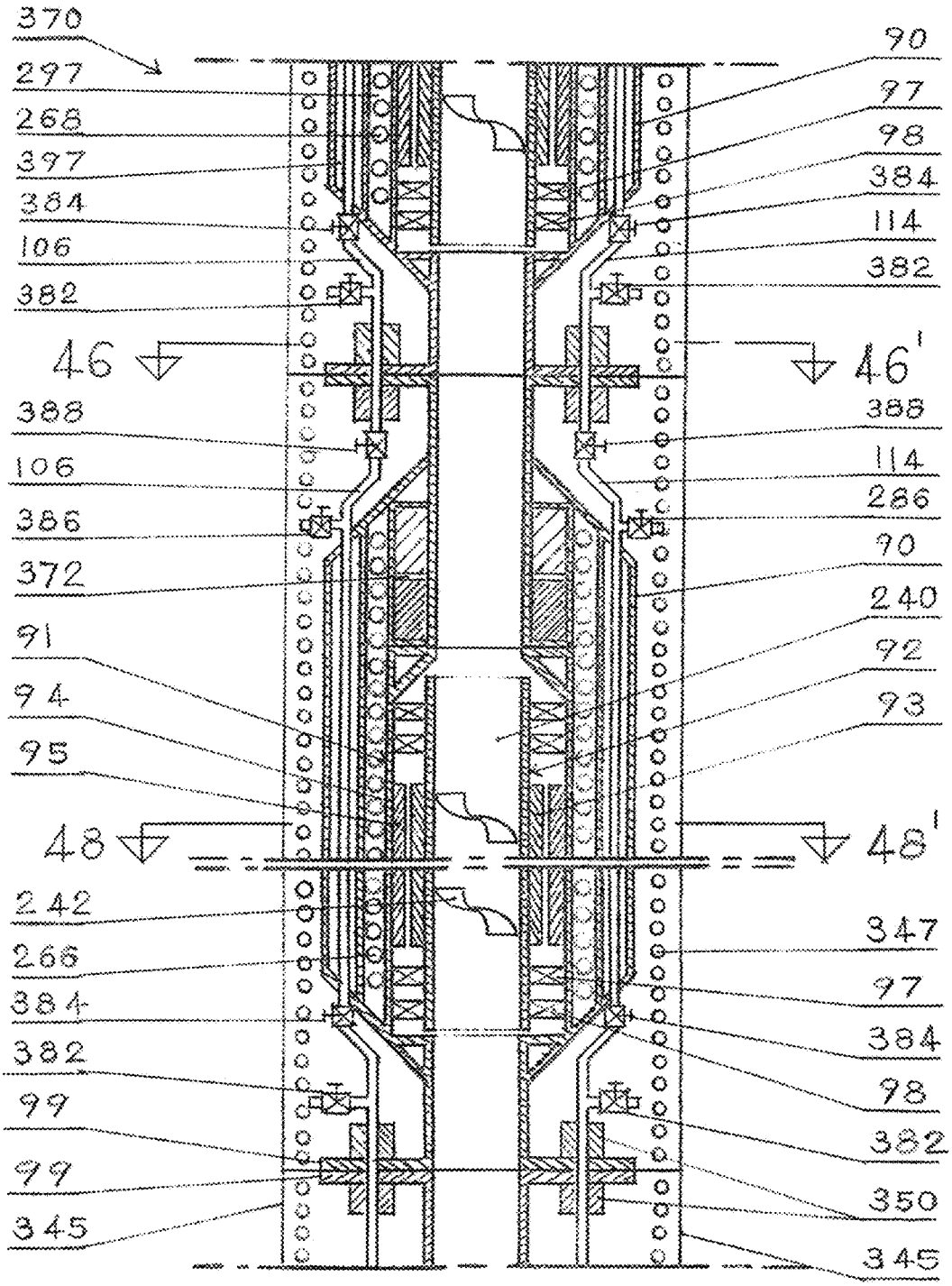
FIG. 47 is a cross sectional view of a segment of the excavation line taken along line 47-47" of FIG. 45.

FIG. 47 is a cross sectional view of a segment of the excavation line 370 taken along line 47-47" of FIG. 45. This illustration is almost identical with the illustration shown in FIG. 44 with exception that in space provided for the flap 372 for preventing backflow of the mud and cuttings here is inserted a transformer 375 which is necessary for transfer of electricity on long distance. Each of those two embodiments illustrated in FIGS. 44 and 47 can be inserted periodically into excavation line as needed.

Figure 48:
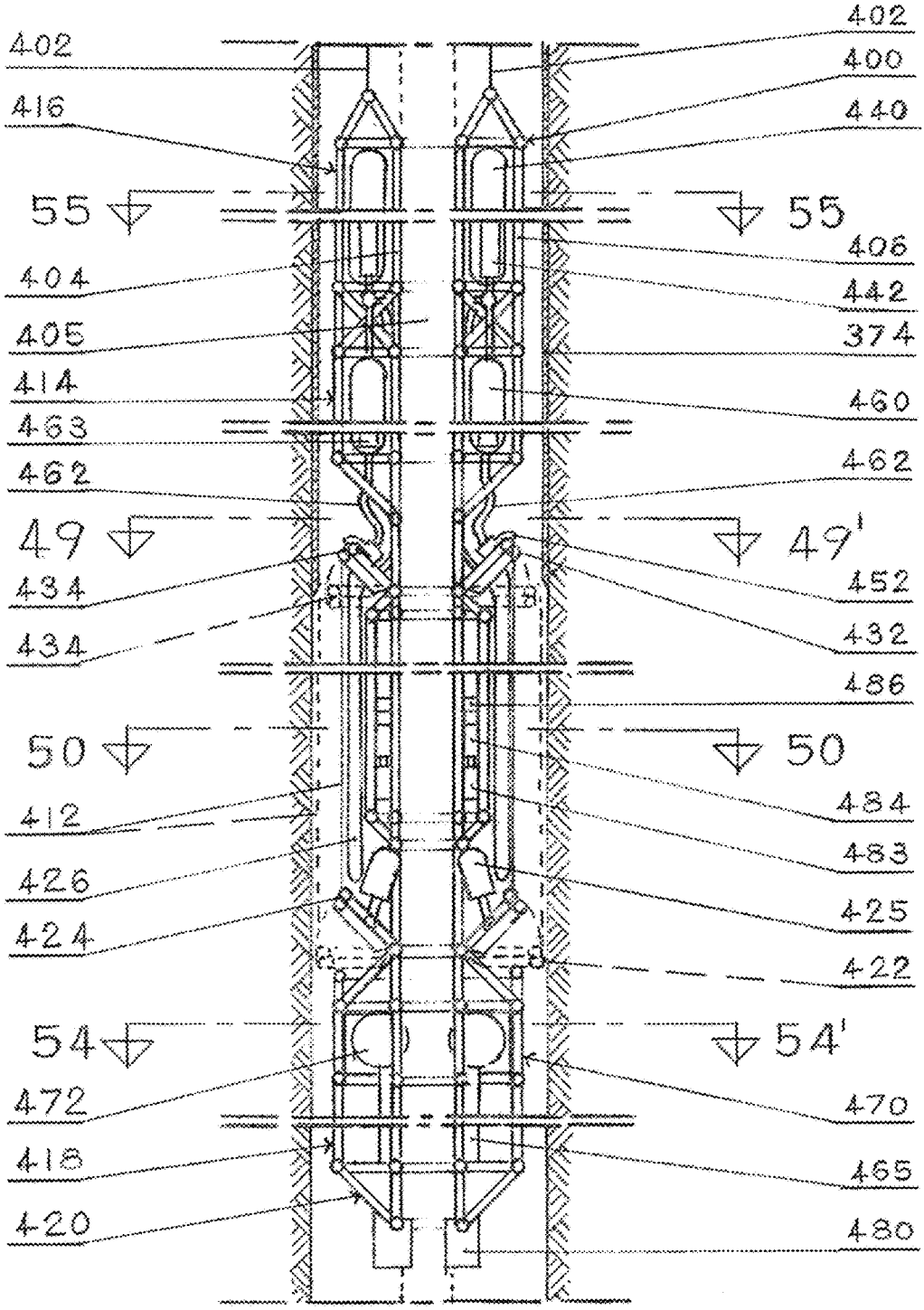
FIG. 48 is a cross sectional view of a circular cage (elevator) for building casing in the wellbore during drilling process.

FIG. 48 is a cross sectional view of a circular cage (elevator) 400 for building casing in the wellbore during drilling process. The circular cage 400 has inner wall (ring) 404 and outer wall (ring) 406 providing an opening 405 in middle of the cage 400 so that it can slide over excavation line 370 up and down as needed for delivering and installing metal sheets 410 and concrete for casing 374. The cage 400 has several compartments (sections): a compartment that is expendable 412; a compartment for containers carrying concrete 414; a compartment for containers carrying air 416; a compartment with motors and gears 418; and a compartment with brakes and sensors 420. Here is shown outer wall (ring) 406 and inner wall (ring) 404. The cage 400 is assembled by array of tubes 408 arranged so to provide strength and integrity of the cage. A compartment 412 is an expendable section of the circular cage 400. At the bottom of the compartment 412 there are 4 lower flaps 421, 422, 423 and 424 comprising hydraulic mechanism 425 which control retracting and expending motion of the lower flaps 421, 422, 423 and 424 and consequently upper flaps 431, 432, 433 and 434 of the compartment 412 which are hinged to the inner ring 404. Between each of the lower and upper flaps of the compartment 412 are installed four inflatable bladders 426. The lower flaps are slightly bigger than upper flaps to completely close, in extended position, gaps between metal sheet 410 and wall of the wellbore 110. After right elevation of the cage 400 with loaded metal sheet 410 is determined with sensors, then lower and upper flaps are extended and bladders 426 are inflated and metal sheet 410 is spread to its predetermined diameter. Extended flaps and inflated bladders 426 support metal sheet 410 during dispersement of the concrete and during curing period. The air for the inflation of the bladders 426 is supply from containers 440 through valves 427 located on upper flaps. On the upper flaps are also installed hydraulic two axes motion control mechanism 450 to control two motions of the nuzzle 452. The purpose of the nuzzle 452 is to disperse liquid concrete from container 460 through hose 462 between metal sheet 410 and side of the wellbore 110 and soon after to retract and to rotate on a side and to dispose leftover concrete into disposal container 454 which is connected to disposal pipe 456 (see FIG. 53). For this cleaning purpose a limited amount of water can be stored into container 440 to be released trough valve (not illustrated) to clean leftover of concrete from container 460, hose 462, nuzzle 452 and disposal line 456. A container 440 contains pump, compressor and valve assembly 442 for compressing and releasing air. A container 460 contains a pump-mixer assembly 463 for mixing concrete during transport from the ground surface and disposing it through hose 462 and nuzzles 452.

In this illustration a compartment with motors and gear box 418 and a compartment with brakes and sensors 420 are positioned at bottom of the cage 400 although different arrangements are possible. Four vertically positioned electric motors 465 are engaged with gears and shafts in gearbox 470 and spin four main gears 472 that are engaged with four extended ribs 345 of the excavation line assembly 370 for providing motion to the circular cage 400 up and down as needed synchronized with hoisting line 402. A gear box 470 is illustrated in more details in FIG. 54. Pulling out drilling apparatus is done by filling wellbore with water and then sliding circular cage 400 over the excavation line 370 and submerging it into wellbore filled with water until buoyancy is achieved and then applied brakes 480 of the circular cage 400 which engages openings 347 on the ribs 345. This process is repeated until all sanctions of the drilling apparatus are pulled out and disassembled. Buoyancy of the circular cage 400 is controlled by adding air into containers 440, 460 and partially into inflatable bladders 426. If needed, additional segments with containers 440 can be attached to the circular cage 400 to achieve more buoyancy.

Here are also shown electric pumps 483 and oil container 484 for hydraulic mechanism 425 for providing motion of the flaps. Here is also shown box 486 with electronics and sensors for controlling motion and operation of the cage 400.

Figure 49:
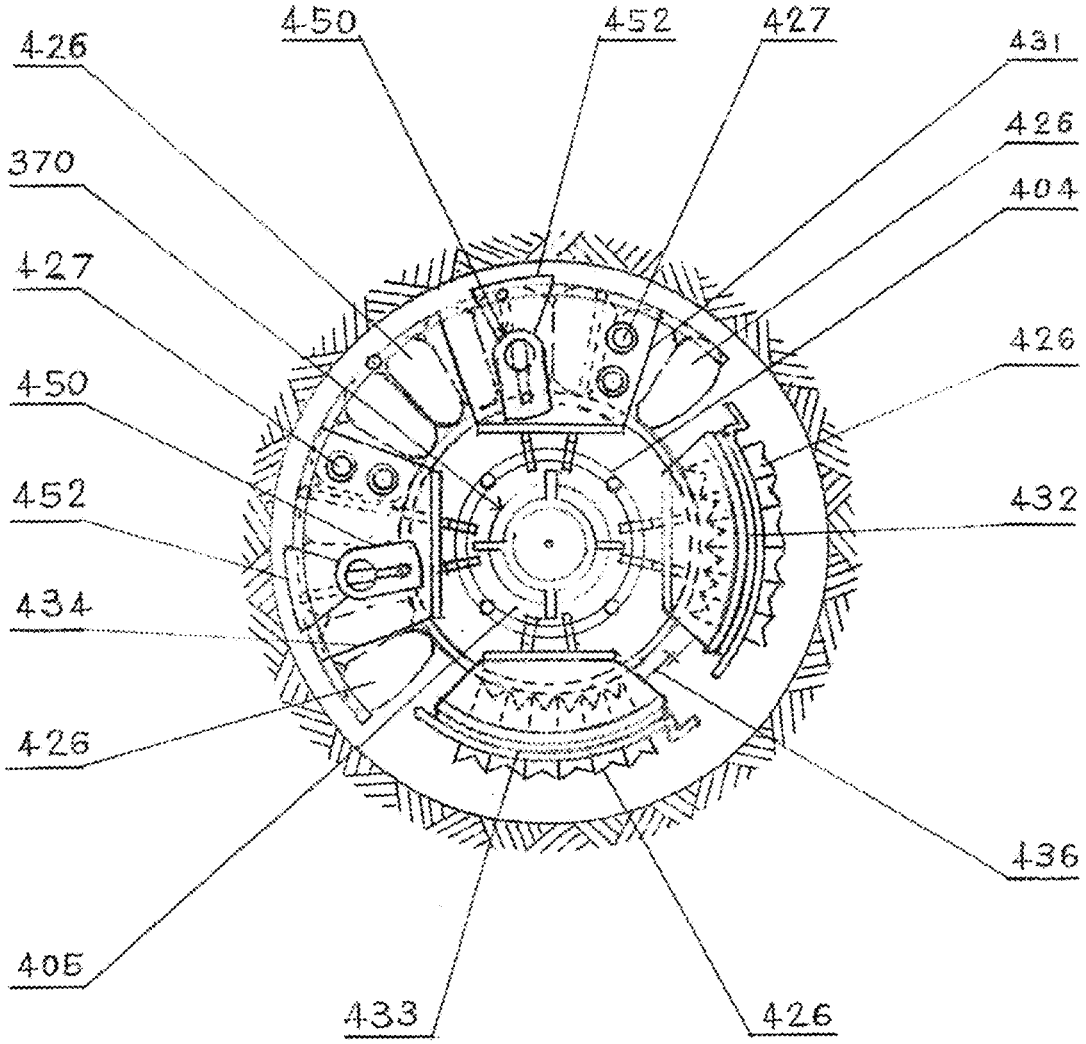
FIG. 49 is a cross-sectional view of a circular cage elevator, taken along line 49-49" of FIG. 48.

FIG. 49 is a cross-sectional view of a circular cage elevator 400 taken along line 49-49" of FIG. 48. In this illustration, for better understanding, are shown upper flaps 434 and 431 in extended positions and flaps 432 and 433 in retracted positions although preferably all four flaps have to perform the same motion. Here are also shown two inflated bladders under flaps 434 and 431 and two deflated bladders under flaps 432 and 433. Here are also shown hydraulic mechanism 450 with nuzzle 452 and inflatable bladders 426. Bladders under flaps 434 and 431 in extended positions are shown as inflated and bladders under flaps 432 and 433 in retracted positions are shown as deflated. Here is also illustrated a scissors joint connection 436 between joining flaps to secure flaps and to allow expending and retracting motion.

Figure 50:
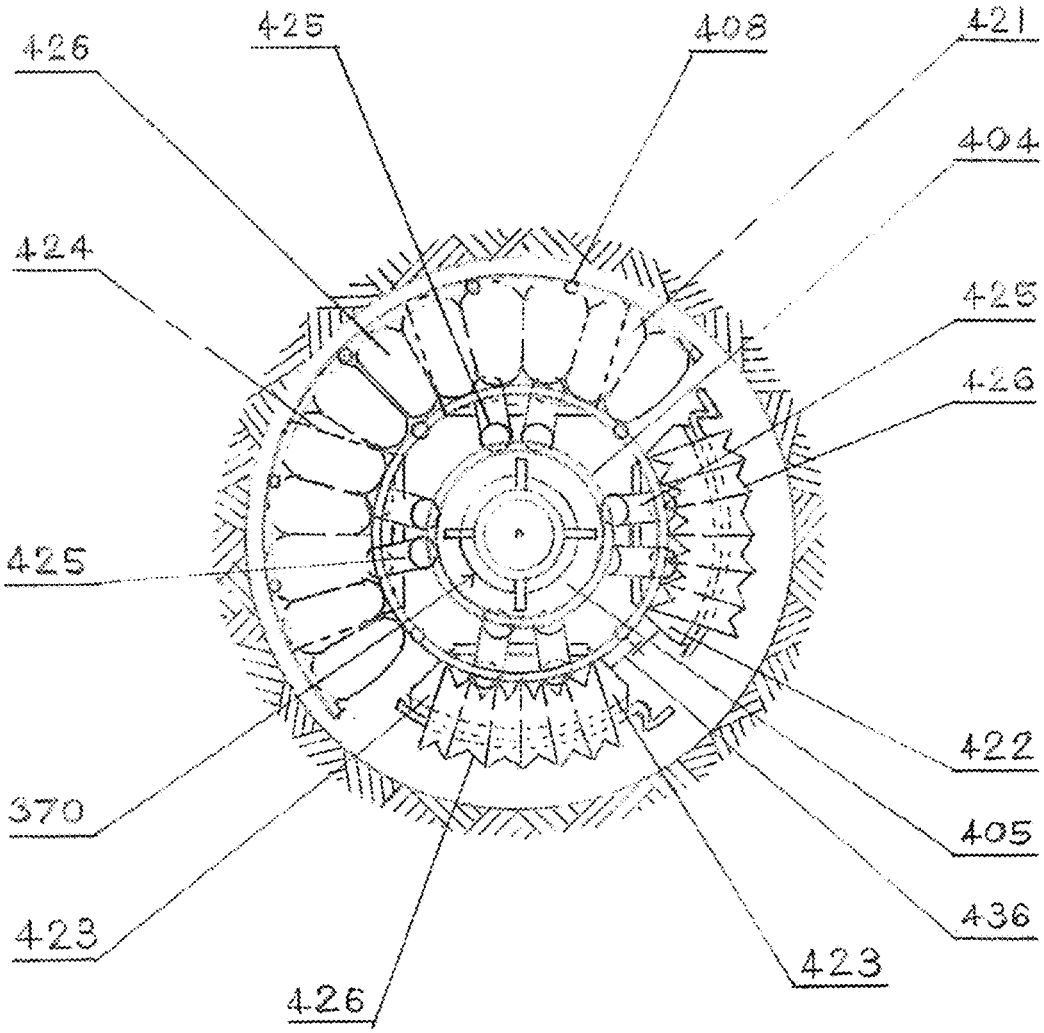
FIG. 50 is a cross-sectional view of a circular cage elevator, taken along line 50-50" of FIG. 48.

FIG. 50 is a cross-sectional view of a circular cage elevator 400 taken along line 50-50" of FIG. 48. In this illustration, as in previous illustration FIG. 49 are shown lower flaps 424 and 421 in extended positions and flaps 422 and 423 in retracted positions although all eight flaps have to perform the same synchronized motion. Here are also shown two inflated bladders above flaps 424 and 421 and two deflated bladders above flaps 422 and 423. Here is also illustrated a scissors joint connection 436 between joining flaps to secure flaps and to allow their expending and retracting motions. Also, here are shown four sets of hydraulic mechanism 425 for providing expending and retracting motions of the flaps.

Figure 51:
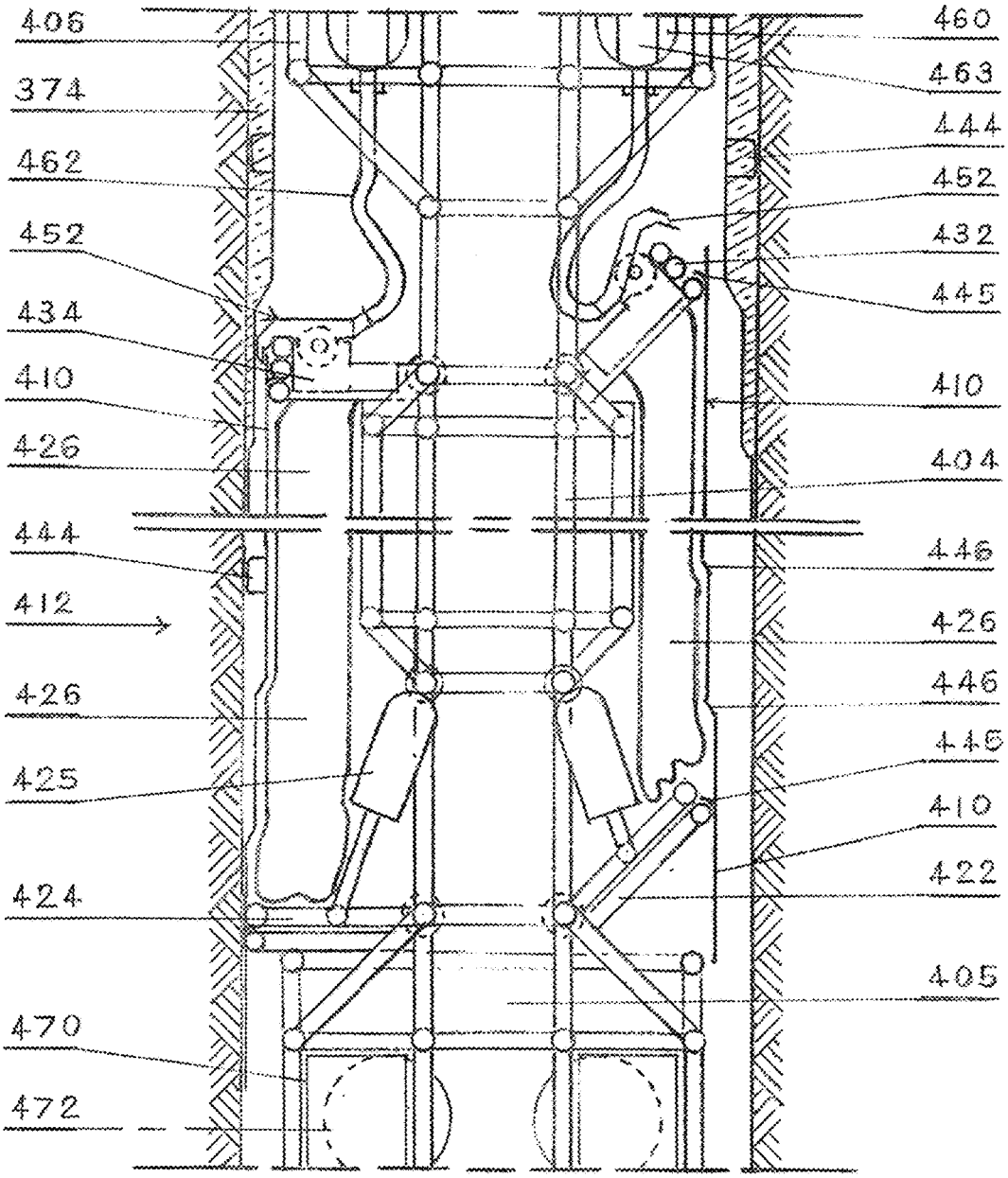
FIG. 51 is enlarged a cross sectional view of an expendable section of a circular cage elevator also illustrated in FIG. 48.

FIG. 51 is enlarged a cross sectional view of an expendable section 412 of a circular cage elevator 400 also illustrated in FIG. 48. The circular cage 400 has inner wall (ring) 404 and outer wall (ring) 406 providing an opening 405 in middle of the cage 400 so that it can slide over excavation line 370 up and down as needed for delivering and installing metal sheets 410 and concrete for casing 374. The cage 400 has several compartments (sections): a compartment that is expendable 412 (illustrated here); a compartment for containers carrying concrete 414; a compartment for containers carrying air 416; a compartment with motors and gears 418; and a compartment with brakes and sensors 420. Here is shown outer wall (ring) 406 and inner wall (ring) 404. The cage 400 is assembled by array of tubes 408 arranged so to provide strength and integrity of the cage. A compartment 412 is an expendable section of the circular cage 400. At the bottom of the compartment 412 there are 4 lower flaps 421, 422, 423 and 424 comprising hydraulic mechanism 425 which control retracting and expending motion of the lower flaps 421, 422, 423 and 424 and consequently upper flaps 431, 432, 433 and 434 of the compartment 412. The flaps are hinged to the inner ring 404. Between each of the lower and upper flaps of the compartment 412 are installed four inflatable bladders 426. The lower flaps are slightly bigger than upper flaps to completely close, in extended position, gaps between metal sheet 410 and wall of the wellbore 110. After right elevation of the cage 400 with loaded metal sheet 410 is determined with sensors, then lower and upper flaps are extended and bladders 426 are inflated and metal sheet 410 is spread to its predetermined diameter. Extended flaps and inflated bladders 426 support metal sheet 410 during dispersement of the concrete and during curing period. The air for the inflation of the bladders 426 is supply from containers 440 through valves 427 located on upper flaps. On the upper flaps are also installed hydraulic two axes motion control mechanism 450 to control two motions of the nuzzle 452. The purpose of the nuzzle 452 is to disperse liquid concrete from container 460 through hose 462 between metal sheet 410 and side of the wellbore 110 and soon after to retract and to rotate on a side and to dispose leftover concrete into disposal container 454 which is connected to disposal pipe 456 (see FIG. 53). For this cleaning purpose a limited amount of water can be stored into container 440 to be released trough valve (not illustrated) to clean leftover of concrete from container 460, hose 462, nuzzle 452 and disposal line 456. A container 440 contains pump, compressor and valve assembly 442 for compressing and releasing air. A container 460 contains a pump-mixer assembly 463 for mixing concrete during transport from the ground surface and disposing it through hose 462 and nuzzles 452. Optionally, concrete, water and air needed for building casing can be distributed from ground surface with hoses and containers 440 and 460 can be used only for disassembly of the drilling apparatus after drilling process is completed. The bladders 426 could be built of combination of heat and waterproof material such is used for making fire hoses.

Figure 52:
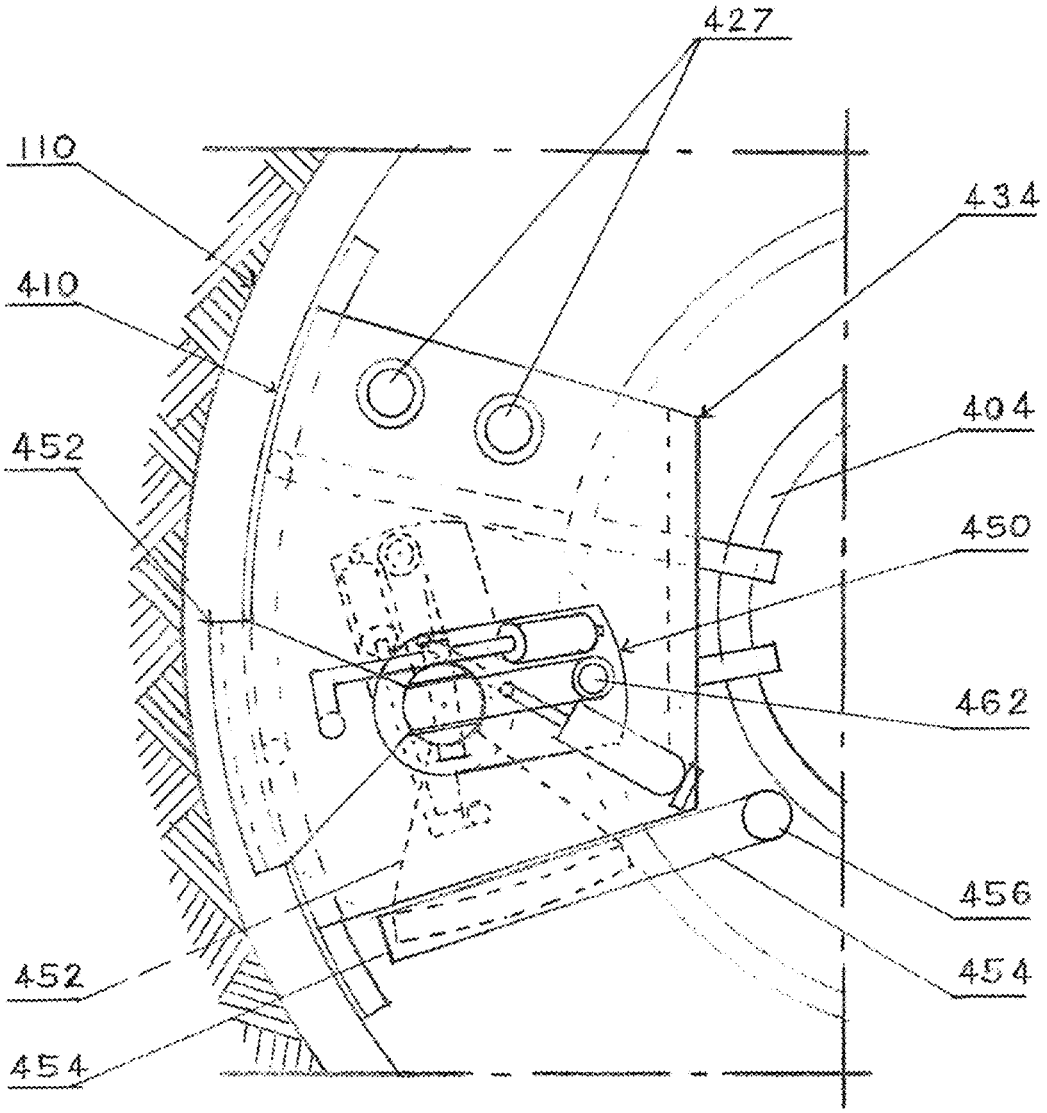
FIGS. 52 and 53 are enlarged plain and side views of a two axes motorized joint mechanism.
Figure 53:
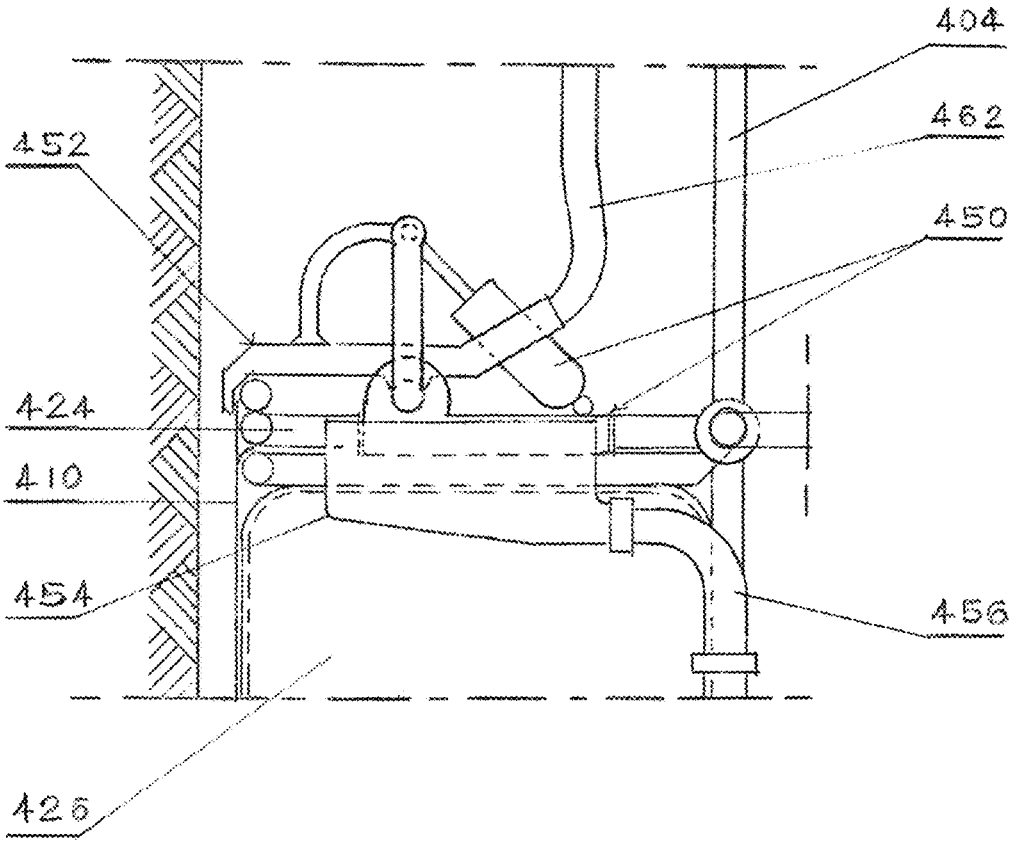

FIGS. 52 and 53 are enlarged plain and side views of a two axes motorized joint mechanism 450 positioned on the upper flaps of the expendable section 412 of the cage 400. In these illustrations the mechanism 450 is shown as hydraulic mechanism although it could be electric. The two axes motorized joint mechanism 450 control two motions of the nuzzle 452. The purpose of the nuzzle 452 is to disperse liquid concrete from container 460 through hose 462 between metal sheet 410 and side of the wellbore 110 and soon after to retract and to rotate on a side (shown in dash line) and to dispose leftover concrete into disposal container 454 which is connected to disposal pipe 456 (see FIG. 53). For this cleaning purpose a limited amount of water can be stored into container 440 to be released trough valve (not illustrated) to clean leftover of concrete from container 460, hose 462, nuzzle 452 and disposal line 456.

Figure 54:
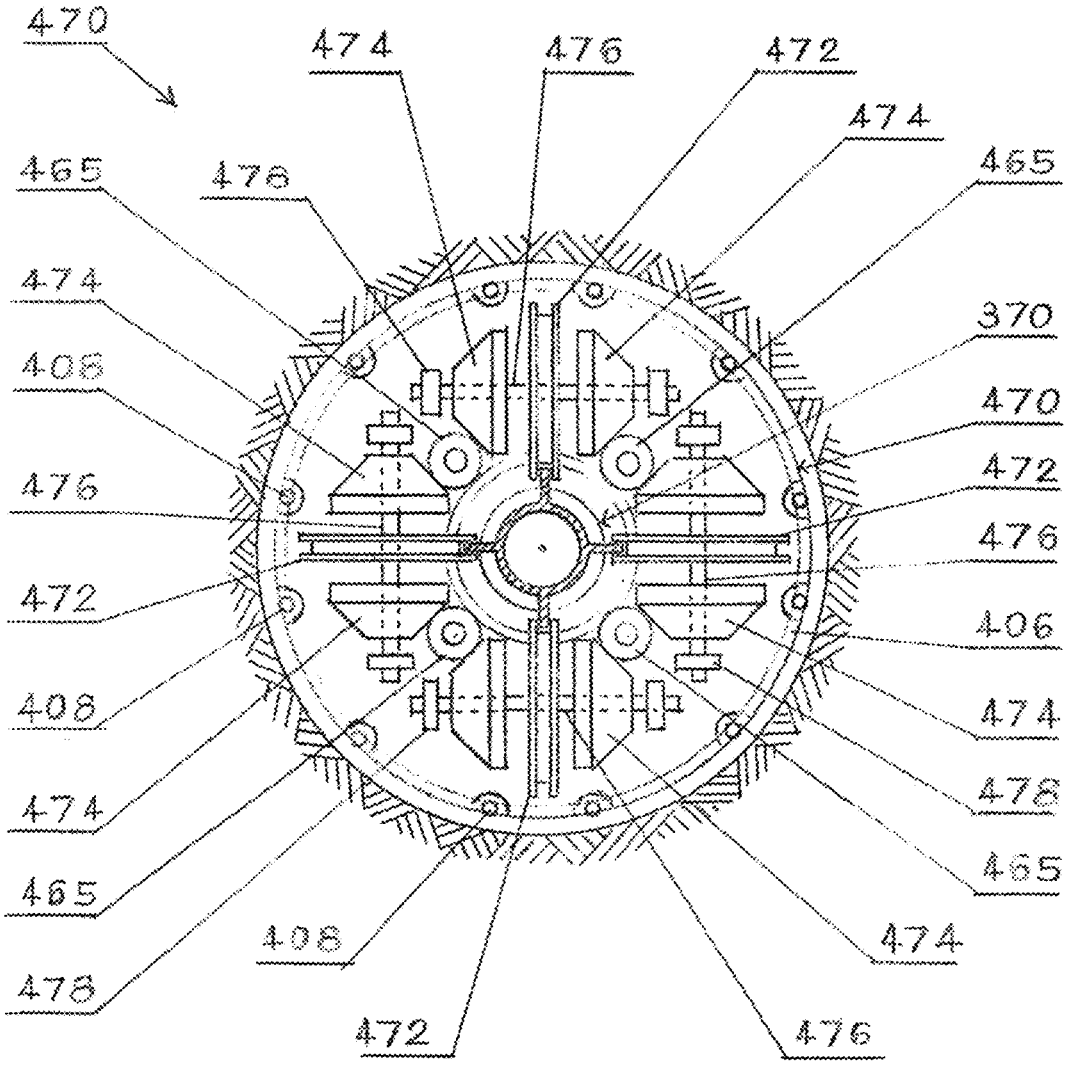
FIG. 54 is a cross-sectional view of a gear box positioned in a motors and gears section of the circular cage elevator, taken along line 54-54" of FIG. 48.

FIG. 54 is a cross-sectional view of a gear box 470 positioned in a motors and gears section 418 of the circular cage elevator 400, taken along line 54-54" of FIG. 48. In this illustration are shown four vertically positioned electric motors 465 which are engaged with eight corresponding gears 474 and shafts 476 which are engaged to corresponding bearings 478 in gearbox 470 and spin four main gears 472. The four main gears 472 slightly extend from sealed gear box 470 and are engaged with four extended ribs 345 of the excavation line assembly 370 providing motion to the circular cage 400 up and down as needed. The electric motors 465 are synchronized with hoisting line 402.

Figure 55:
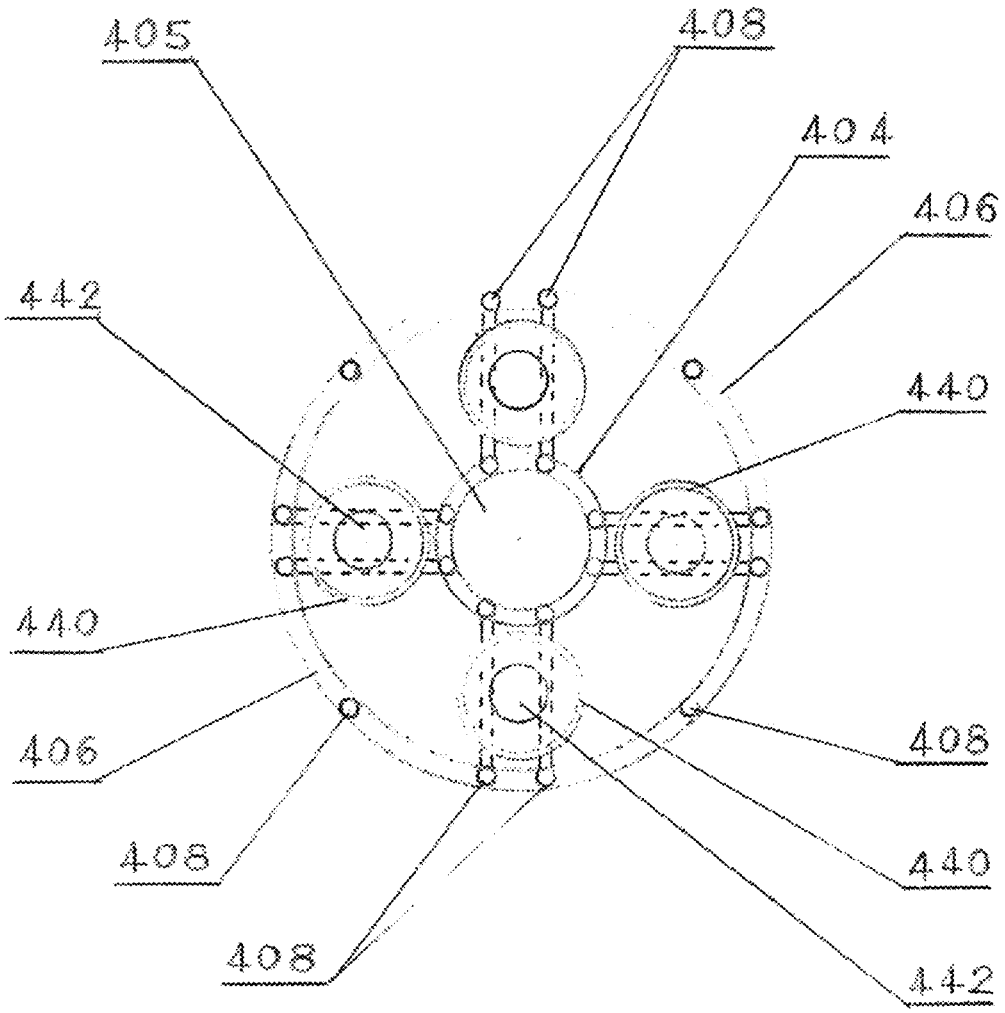
FIG. 55 is a cross-sectional view of the air containers positioned in upper section of the circular cage elevator, taken along line 55-55" of FIG. 48.

FIG. 55 is a cross-sectional view of the air containers 440 positioned in upper section 416 of the circular cage elevator 400, taken along line 55-55" of FIG. 48. In this illustration are shown four containers 440 secured between inner wall 406 and outer wall 404. The containers 440 contain pump, compressor and valve assembly 442 for compressing and releasing air.

Figures 56, 57:
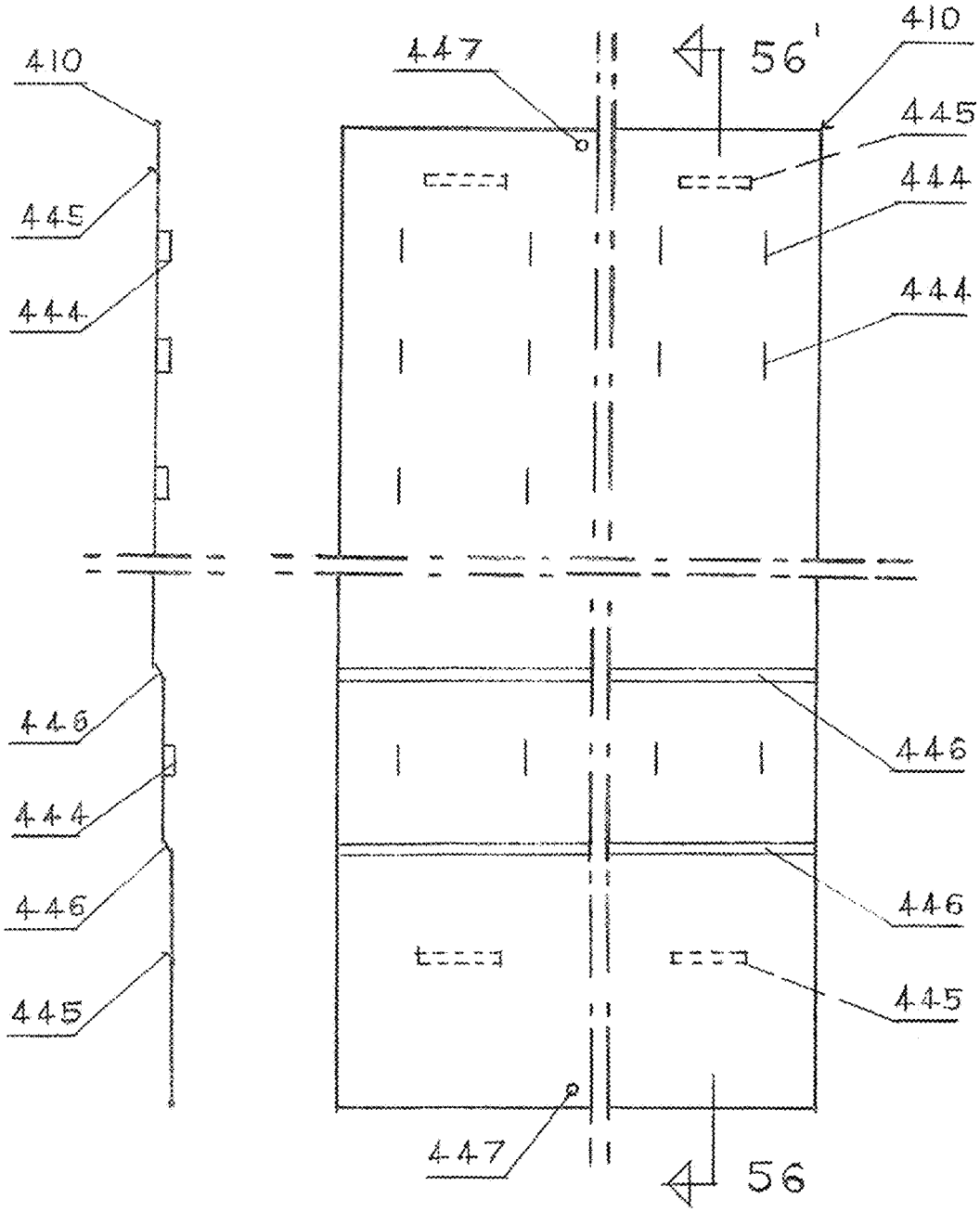
FIG. 56 is a cross-sectional view of the metal sheet for casing taken along line 56-56" of FIG. 57.
FIG. 57 is a plain view of the metal sheet illustrated in FIG. 56.

FIG. 56 is a cross-sectional view of the metal sheet 410 for casing taken along line 56-56" of FIG. 57. In this illustration are shown metal sheet 410 with several spacers 444 welded to the metal sheet to keep proper space between walls of the wellbore 110 during insertion of the concrete. Here are also shown several indentations 446 for accommodating joining metal sheet. Here is also shown several protrusions 445 positioned near the top and bottom of the metal sheet for loading and carrying it on upper and lower flaps of the expendable section 412 of the circular cage 400.

FIG. 57 is a plain view of the metal sheet 410 illustrated in FIG. 56. Here is also shown several protrusions 445 positioned near the top and bottom of the metal sheet for loading and carrying it on upper and lower flaps of the expendable section 412 of the circular cage 400. Here are also shown several indentations 446 for accommodating joining metal sheet. Here are also shown openings 447 positioned near the top and bottom of the metal sheet for loading and carrying it on upper and lower flaps of the expendable section 412 of the circular cage 400. The openings 447 are also positioned at the middle of the wideness of the upper and lower edge of a metal sheet 410 to allow pinning it with retractable pin of the mechanism preferably positioning on selected one upper and one corresponding lower flap of the expendable section of the circular cage 400, to fix the central portion of the metal sheet 410 and to allow sides edges of the metal sheet to slide and expend to its determined volume during expending process (The pinning mechanism is not illustrated). The same pinning mechanism can be used for holding, loading and unloading casing metal sheet 410 on the expendable section 412 of the circular cage 400.

Figure 58:
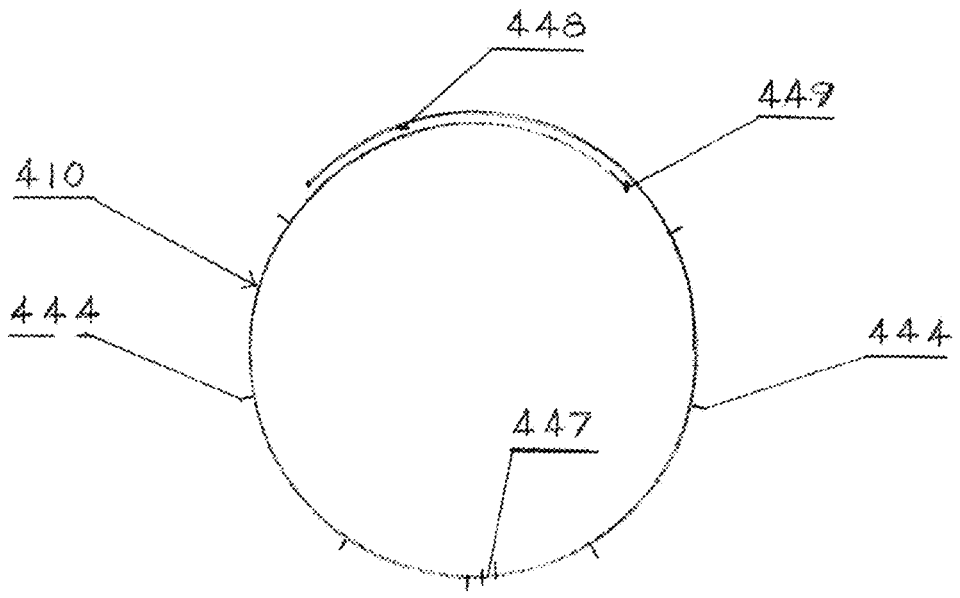
FIG. 58 is a cross-sectional view of the metal sheet in retracted position during loading it on the flaps of the expandable section of the circular cage.

FIG. 58 is a cross-sectional view of the metal sheet 410 in retracted position during loading it on the flaps of the expandable section of the circular cage 400. Here are also shown corresponding protrusions 448 and 449 for locking metal sheet 410 when reached predetermine volume.

Figure 59:
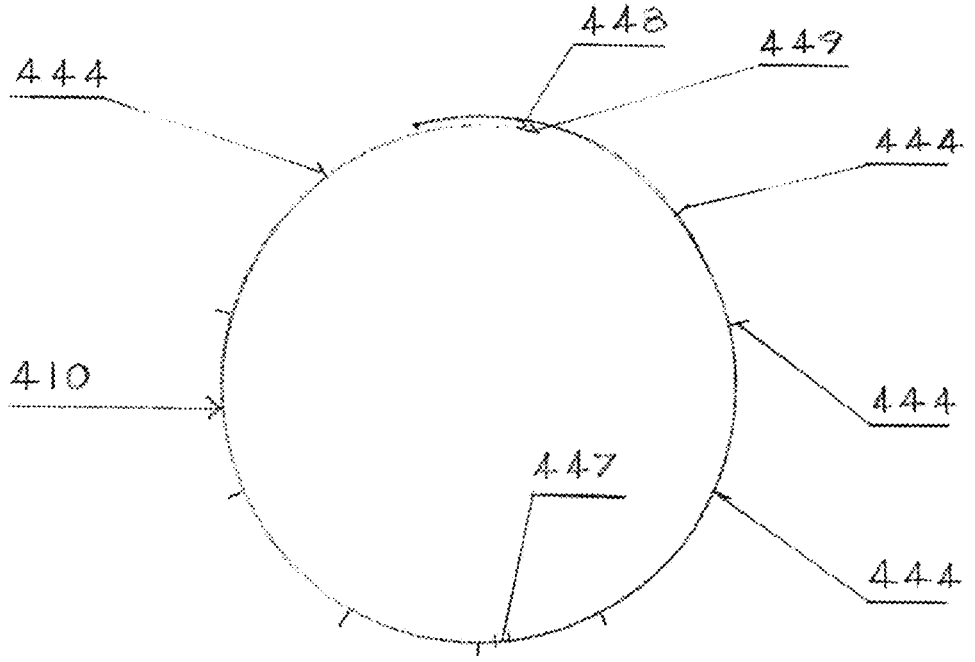
FIG. 59 is a cross-sectional view of the metal sheet in expended position after is installed into wall of the well bore.

FIG. 59 is a cross-sectional view of the metal sheet 410 in expended position after is installed into wall of the well bore 110. Here are also shown corresponding protrusions 448 and 449 for locking metal sheet 410 when reached predetermine volume.

Figure 60:
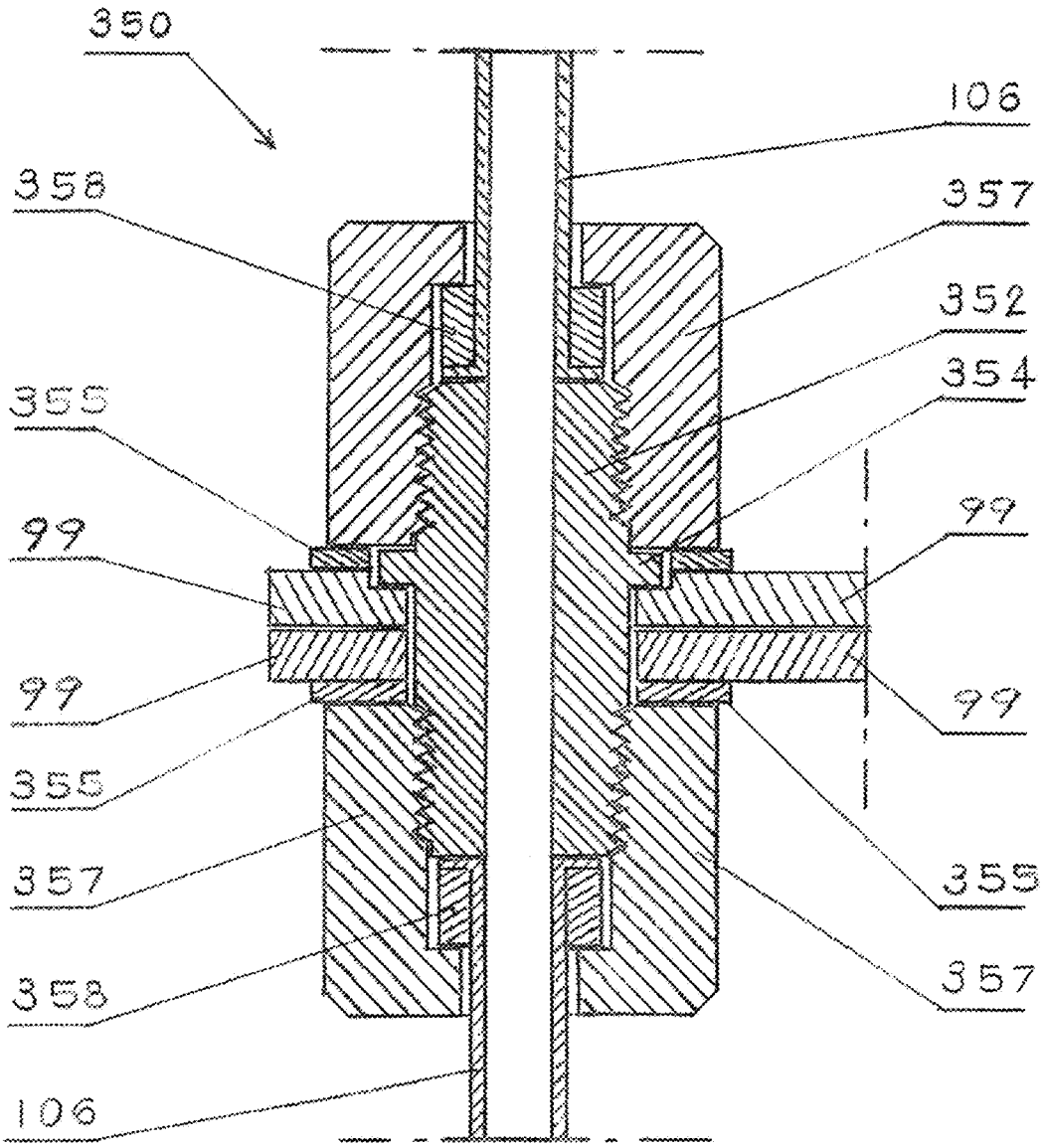
FIG. 60 is a cross-sectional view of a special bolt and nut assembly for connecting two joining segments of the excavation line.

FIG. 60 is a cross-sectional view of a special bolt and nut assembly 350 for connecting two joining segments of the excavation line 370. In this illustration are shown flange 99 of two joining segments of the excavation line 370 with bolt and nut assembly 350 The bolt and nut assembly 350 consist of hollow rod (sleeve) 352 with a small flange 354 at its middle section for resting on corresponding recess on the upper flange 99 of the joining excavation pump 370 and two nut-cups 357 for fastening pipe or hoses of joining excavation pump 370. Here are also shown washers 355 for better fastening and sealing connections. The bolt and nut assembly 350 provides a structural connection between two segments and at the same time provide fluid flow between them in limited space. Also, it provides passage for electric cables.

Figure 61:
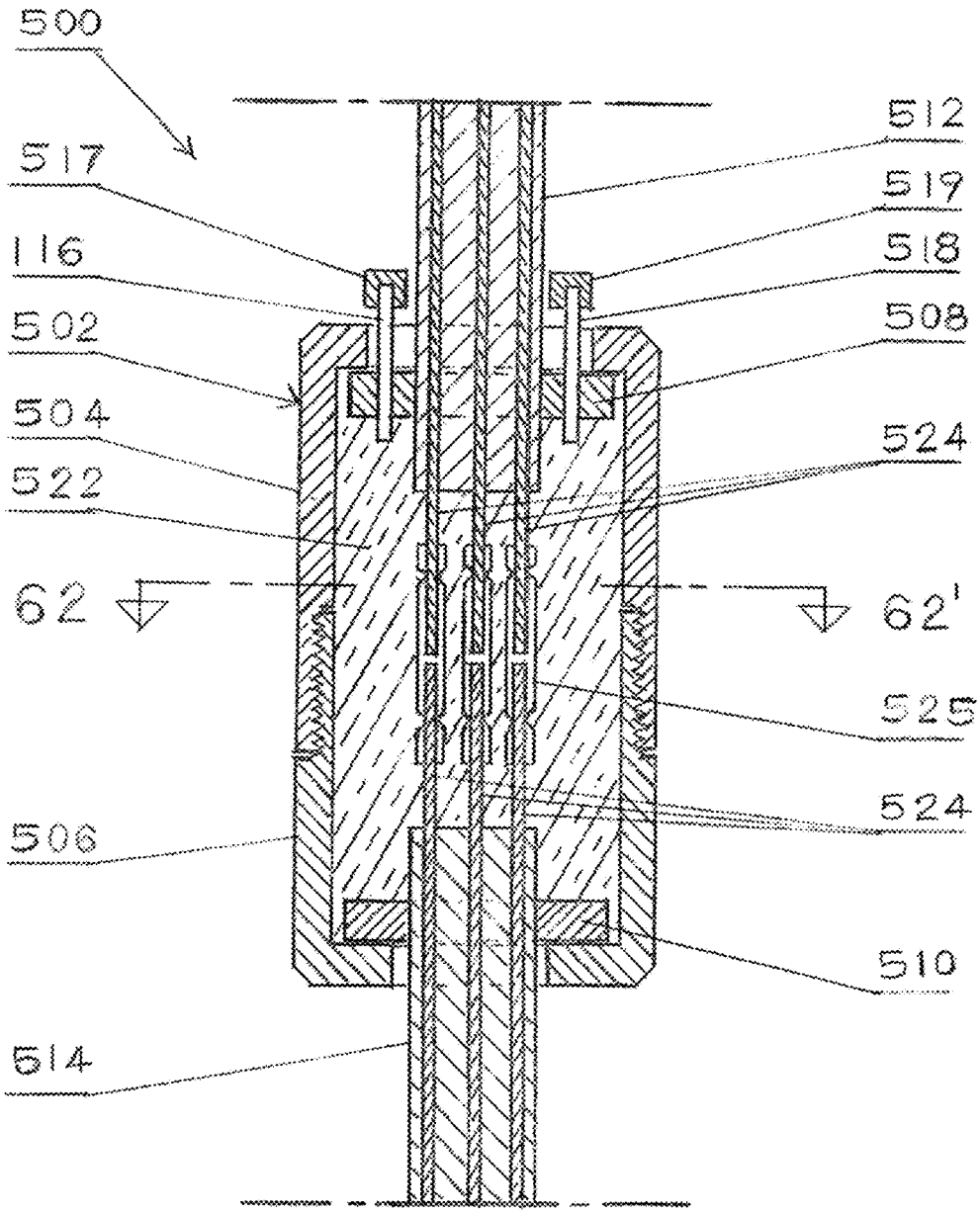
FIG. 61 is cross-sectional views of a special waterproof electrical cable connector taken along line 61-61" of FIG. 62.
Figure 62:
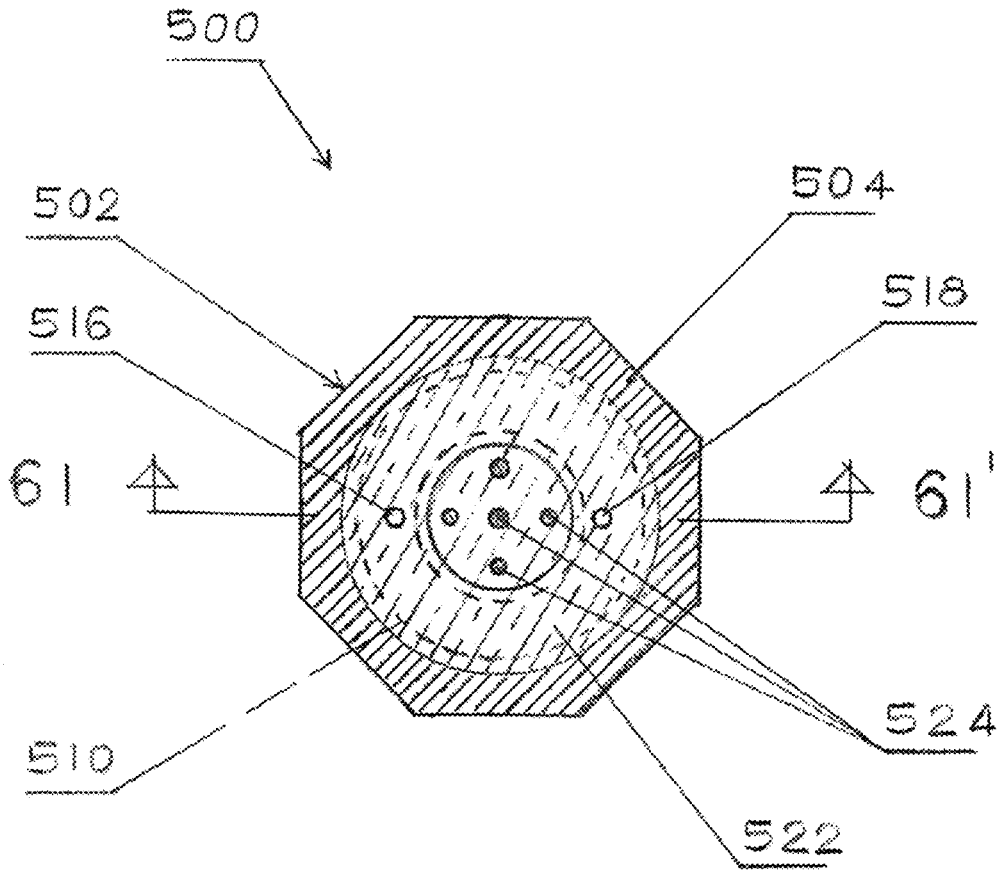
FIG. 62 is cross-sectional views of a special waterproof electrical cable connector assembly 500 taken along line 62-62" of FIG. 61.

FIG. 61 is cross-sectional views of a special waterproof electrical cable connector assembly 500 taken along line 61-61" of FIG. 62. The purpose of a waterproof electrical cable connector 500 is to provide waterproof connections of electrical cable at wet and extreme environment. The waterproof electrical cable connector 500 consist of housing 502 which consist of upper and lower halves 504 and 506; fasteners 508 and 510 attached to electrical cables 512 and 514 which need to be connected; passages with valve 516 and 518 with their cups 517 and 519; wire fasteners 520; and dielectric material 522. In this illustration are shown two insulated electrical cable 512 and 514 that needs to be connected. Two halves 504 and 506 of housing 502 are slid at each cable before fasteners 508 and 510 are secured to the end of insulated portion of the cables 512 and 514. The naked wires 524 of the cables 512 and 514 are secured with wire fasteners (sleeves) 525 before two haves 504 and 506 of the housing 502 are tightly closed. Dielectric material 522 such as silicon, rubber, rubbery silicon, etc. is injected into provided cavity of the housing 502. During the process of injecting dielectric substance 522 into housing 502 through passage 516 the air from housing 502 exits through other passageway 518. When the cavity inside housing 502 is completely filled with dielectric substance 522 then passageways 516 and 518 are sealed with corresponding caps 517 and 519. The dielectric substance 522 will solidified and provide tight electric insulation for the naked wire 524 and prevent water entering inside housing 502 and make contact with wires 524.

FIG. 62 is cross-sectional views of a special waterproof electrical cable connector assembly 500 taken along line 62-62" of FIG. 61. The function of the assembly 500 is explained in illustration in FIG. 61. In this illustration are shown housing 502 of the assembly 500. Also, here are shown fasteners 510 and wires 524 of the cables 512 with dielectric substance 522 surrounding electrical cables.

All mechanisms such as retractable nuzzle for concrete distribution, inline pumps, and a motorized circular cage elevator with its brakes, can be controlled by wires and wirelessly as is practice in avionic industry. Positioning of the motorize drill head and circular cage (elevator) uses wireless radio and computers to monitor and control operation. All exposed elements of the apparatus preferably are coated with ceramic coating to reduce deterioration from corrosion and electrolyses effects.

The foregoing disclosure is not intended to limit the present disclosure to the precise forms or particular fields of use disclosed. As such, it is contemplated that various alternate embodiments and/or modifications, whether explicitly described or implied herein, are possible in light of the disclosure. Having thus described embodiments of the present disclosure, persons of ordinary skill in the art will recognize that changes may be made in form and detail without departing from the scope of the present disclosure.

What is claimed is:

1. A method of in-ground drilling for deeper and wider wells bore with continuous diameter and building casing comprising the steps of:

cutting and shredding bottom of the well bore with motorized drill head;

transporting mud and cuttings through a separate excavation line up to the ground surface;

delivering filtered fluid through a separate close loop delivery line to the bottom of the well bore;

cooling the motorized drill head through a separate close loop cooling line having heat exchanger on the ground surface and producing electricity; and building casing in the wellbore during drilling process with circular cage sliding around excavation line up and down and delivering metal sheets and concrete from ground surface to subsequent segments downwards wellbore as needed.

2. The method of claim 1, further comprising a series of in-line excavation pumps periodically inserted along the excavation line assembly wherein each of the in-line excavation pumps are electromotor comprising spiral blade within a hollow central shaft of the rotor creating a force to move mud and cuttings upward to the next in-line excavation pump.

3. The method of claim 2, further comprising an excavation line assembly consisting of a separate fluid inflow delivery line; a separate closed loop cooling line; a separate electric line; series of in-line excavation pumps containing electromotor with continue spiral blade inside hollow shaft; housing of electromotor having extended ribs for guiding circular cage; reduced diameter of housing of the excavation line assembly having flange and hoses line bolt and nut assembly connectors.

4. The method of claim 3, further comprising an excavation line assembly having reduced diameter of housing of the excavation line assembly having flange and hoses line bolt and nut assembly connectors providing a structural connection between two joining segments and at the same time provide fluid flow between them in limited space.

5. The method of claim 4, further comprising two joining segments hoses line bolt and nut assembly connector consisting of consist of hollow rod (sleeve) with a small flange at its middle section for resting on corresponding recess on the upper flange of the joining excavation line assembly and two nut-cups for fastening hoses (pipe) of joining excavation line assembly; washers for better fastening and sealing connections.

6. The method of claim 5, further comprising bolt and nut assembly provide a structural connection between two segments and at the same time provide fluid flow trough lines between segments and provide passage for electric cables.

7. The method of claim 6, further comprising waterproof electric cable connector assembly consisting of housing which consist of upper and lower halves; fasteners attached to insulated portion of electrical cables which need to be connected; passages with valve with their cups; wire fasteners; and dielectric material.

8. The method of claim 1, further comprising a system for building casing in the wellbore during drilling process with circular cage (elevator) sliding around excavation line up and down and delivering metal sheets and concrete from ground surface to subsequent segments downwards wellbore as needed.

9. The method of claim 8, further comprising a circular cage consisting of several compartments: a compartment that is expendable; a compartment for containers carrying concrete; a compartment for containers carrying air; a compartment with motors and gears; and a compartment with brakes and sensors.

10. The method of claim 9, further comprising a circular cage consisting of inner wall (ring) and outer wall (ring) providing an opening in middle of the cage so that it can slide over excavation line up and down as needed for delivering and installing metal sheets and concrete for casing.

11. The method of claim 10, further comprising a circular cage being assembled by array of tubes arranged so to provide strength and integrity of the cage.

12. The method of claim 9, further comprising an expendable section of the circular cage consisting of four lower and four upper corresponding flaps, hinged to the inner ring, comprising hydraulic mechanism which control retracting and expending motion of the lower flaps and consequently corresponding upper flaps.

13. The method of claim 12, further comprising inflatable bladders installed between lower flaps and upper flaps to support metal sheet when at extended position and when inflated during insertion of concrete and curing period to provide determined diameter of the casing of the wellbore.

14. The method of claim 13, further comprising two axes motion control mechanism to control two motions of the nuzzle positioned on upper flaps to disperse liquid concrete from container from upper compartment of the circular cage through hose between metal sheet and side of the wellbore and to retract and to rotate on a side and to dispose leftover concrete into disposal container which is connected to disposal pipe.

15. The method of claim 9, further comprising an compartment for containers carrying concrete for casing consisting of four containers secured above expendable compartment and connected with hosed to the nuzzle on upper flaps of the expendable compartment.

16. The method of claim 9, further comprising a compartment for containers carrying air for inflating bladders consisting of four containers secured above compartment for containers carrying concrete and connected with hosed to the valve on upper flaps of the expendable compartment.

17. The method of claim 9, further comprising a compartment with motors and gears positioned at lower section of the circular cage and consisting of four vertically positioned electric motors which are engaged with gears and shafts in gearbox above it which spins four main gears that are engaged with four extended ribs of the excavation line assembly for providing motion to the circular cage up and down as needed synchronized with hoisting line on ground surface.

18. The method of claim 9, further comprising a compartment with brakes with pins positioned at lower section of the circular cage which when apply engages corresponding openings on the extended ribs of the excavation line assembly.

19. The method of claim 9, further comprising a metal sheet for casing consisting of several spacers welded to the metal sheet to keep proper space between walls of the wellbore during insertion of the concrete; several indentations for accommodating joining metal sheet; several protrusions positioned near the top and bottom of the metal sheet for loading and carrying it on upper and lower flaps of the expendable section of the circular cage.

20. The method of claim 19, further comprising several openings positioned near the top and bottom of the metal sheet for loading and carrying it on upper and lower flaps of the expendable section of the circular cage and to fix the central portion of the metal sheet and to allow sides edges of the metal sheet to slide and expend to its determined volume during expending process.

* * * * *